US006425357B2

(12) United States Patent
Shimizu et al.

(10) Patent No.: US 6,425,357 B2
(45) Date of Patent: Jul. 30, 2002

(54) VARIABLE VALVE DRIVE MECHANISM AND INTAKE AIR AMOUNT CONTROL APPARATUS OF INTERNAL COMBUSTION ENGINE

(75) Inventors: Kouichi Shimizu, Toyota; Hiroyuki Kawase, Okazaki; Yuuji Yoshihara, Toyota, all of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/805,928

(22) Filed: Mar. 15, 2001

(30) Foreign Application Priority Data

Mar. 21, 2000 (JP) ..... 2000-078134

(51) Int. Cl.[7] ..... F01L 1/34

(52) U.S. Cl. ..... 123/90.16; 123/90.15; 123/90.17; 123/90.2; 123/90.27; 464/2

(58) Field of Search ..... 123/90.2, 90.12, 123/90.15, 90.16, 90.17; 464/2, 160

(56) References Cited

U.S. PATENT DOCUMENTS

| | | | | |
|---|---|---|---|---|
| 4,708,101 A | * | 11/1987 | Hara et al. | 123/90.16 |
| 5,367,991 A | * | 11/1994 | Asai et al. | 123/90.16 |
| 5,431,132 A | | 7/1995 | Kreuter et al. | 123/90.16 |
| 5,474,037 A | * | 12/1995 | Paul | 123/90.16 |
| 5,592,906 A | | 1/1997 | Kreuter et al. | 123/90.16 |
| 5,803,029 A | * | 9/1998 | Yoshihara et al. | 123/90.16 |
| 6,009,842 A | | 1/2000 | Hiereth | 123/90.27 |
| 6,016,779 A | * | 1/2000 | Nemoto et al. | 123/90.16 |
| 6,182,623 B1 | * | 2/2001 | Sugi et al. | 123/90.17 |

FOREIGN PATENT DOCUMENTS

| | | | |
|---|---|---|---|
| EP | 0 521 412 A1 | | 1/1993 |
| EP | 0 761 935 A2 | | 6/1996 |
| EP | 0 780 547 A1 | | 6/1997 |
| EP | 0 909 882 A2 | | 4/1999 |
| EP | 0 911 495 A1 | | 4/1999 |
| JP | A 11-324625 | | 11/1999 |
| JP | 2001234767 A | * | 8/2001 |

* cited by examiner

*Primary Examiner*—Thomas Denion
*Assistant Examiner*—Ching Chang
(74) *Attorney, Agent, or Firm*—Oliff & Berridge, PLC

(57) ABSTRACT

A variable valve drive mechanism of an internal combustion engine is provided which includes a camshaft that is operatively connected to a crankshaft of the engine such that the camshaft is rotated by the crankshaft, a rotating cam provided on the camshaft, and an intermediate drive mechanism disposed between the camshaft and an intake or exhaust valve of the engine. The intermediate drive mechanism is supported rockably on a shaft that is different from the camshaft, and includes an input portion operable to be driven by the rotating cam of the camshaft, and an output portion operable to drive the valve when the input portion is driven by the rotating cam. The variable valve drive mechanism further includes an intermediate phase-difference varying device for varying a relative phase difference between the input portion and the output portion of the intermediate drive mechanism.

22 Claims, 51 Drawing Sheets

VARIABLE VALVE DRIVE MECHANISM AND INTAKE AIR AMOUNT CONTROL APPARATUS OF INTERNAL COMBUSTION ENGINE

INCORPORATION BY REFERENCE

The disclosure of Japanese Patent Application No. 2000-078134 filed on Mar. 21, 2000 including the specification, drawings and abstract is incorporated herein by reference in its entirety.

BACKGROUND OF THE INVENTION

1. Field of the Invention

The invention relates to a variable valve drive mechanism of an internal combustion engine capable of varying valve characteristics of intake valves or exhaust valves of the engine, and also relates to an intake air amount control apparatus of an internal combustion engine that employs the variable valve drive mechanism.

2. Description of Related Art

Variable valve drive mechanisms adapted to vary the amount of lift or the operating angle of intake valves or exhaust valves of an internal combustion engine in accordance with the operating state or conditions of the engine are known in the art. An example of such mechanisms is disclosed in Japanese laid-open Patent Publication (Kokai) No. 11-324625, in which a rocking cam is provided coaxially with a rotating cam that rotates or moves in accordance with a crankshaft, and the rotating cam and the rocking cam are connected to each other by a complicated link mechanism. The variable valve drive mechanism further includes a control shaft disposed midway in the complicated link mechanism. The phase of the rocking cam may be changed by causing the control shaft to displace or offset the center of rocking of an arm that forms a portion of the link mechanism. By changing the phase of the rocking cam in this manner, the amount of lift or the operating angle of the intake or exhaust valves can be varied. This makes it possible to improve the fuel economy and achieve stable operating characteristics of the engine during, for example, low-speed and low-load operations, and to improve the intake air charging efficiency to thereby ensure sufficiently large outputs during, for example, high-speed and high-load operations.

However, the link mechanism, which links the rotating cam and the rocking cam that are disposed on the same axis, is likely to be long and complicated. This may result in reduced certainty or reliability in the operations of the variable valve drive mechanism.

SUMMARY OF THE INVENTION

It is therefore an object of the invention to provide a variable valve drive mechanism of an internal combustion engine that operates with sufficient certainty or reliability, without requiring a long and complicated link mechanism as employed in the conventional engine. It is another object of the invention to provide an intake air amount control apparatus that utilizes the variable valve drive mechanism.

To accomplish the above object and/or other object(s), a first aspect of the invention provides a variable valve drive mechanism of an internal combustion engine, which is capable of varying a valve characteristic of an intake valve or an exhaust valve of the internal combustion engine, comprising: (a) a camshaft that is operatively connected with a crankshaft of the engine such that the camshaft is rotated by the crankshaft; (b) a rotating cam provided on the camshaft; (c) an intermediate drive mechanism disposed between the camshaft and the valve and supported rockably on a shaft that is different from the camshaft, the intermediate drive mechanism including an input portion operable to be driven by the rotating cam of the camshaft, and an output portion operable to drive the valve when the input portion is driven by the rotating cam; and (d) an intermediate phase-difference varying device positioned and configured to vary a relative phase difference between the input portion and the output portion of the intermediate drive mechanism.

The intermediate drive mechanism having the input portion adapted to be driven by the rotating cam and the output portion that drives the valve when the input portion is driven by the rotating cam is rockably supported by the shaft that is different from the camshaft on which the rotating cam is provided. With this arrangement, there is no need to provide a long, complicated link mechanism for connecting the rotating cam with the intermediate drive mechanism (or rocking cam). Thus, when the rotating cam drives the input portion of the intermediate drive mechanism, the driving force is readily transmitted from the input portion to the output portion within the drive mechanism, so that the output portion drives the intake or exhaust valve in accordance with the driving state of the rotating cam.

The intermediate phase-difference varying device is capable of varying a relative phase difference between the input and output portions of the intermediate drive mechanism. It is thus possible to advance or retard the start of lifting of the intake or exhaust valve that occurs in accordance with the driving state (or rotational phase) of the rotating cam, thus making it possible to adjust the amount of lift or operating angle of the valve that varies with the driving state or rotational phase of the rotating cam.

As described above, the amount of lift or operating angle of the intake or exhaust valve may be changed with a relatively simple construction in which the relative phase difference between the input and output portions is changed, without requiring the conventional long and complicated link mechanism. It is thus possible to provide a variable valve drive mechanism of an internal combustion engine that operates with improved certainty and reliability.

In one preferred embodiment of the invention, the output portion comprises a rocking cam that includes a nose, and the intermediate phase-difference varying device is operable to vary the relative phase difference between the nose of the rocking cam and the input portion.

In the above-described variable valve drive mechanism in which the output portion principally consists of the rocking cam, the intermediate phase-difference varying device is able to vary the relative phase difference between the nose formed on the rocking cam and the input portion, thereby to advance or retard (or delay) the start of lifting of the intake or exhaust valve that occurs in accordance with the driving state (or rotational phase) of the rotating cam provided on the camshaft. Since the amount of lift or operating angle of the intake or exhaust valve can be varied with such a simple construction, the variable valve drive mechanism can operate with improved certainty and reliability.

BRIEF DESCRIPTION OF THE DRAWINGS

The foregoing and further objects, features and advantages of the present invention will become apparent from the following description of preferred embodiments with reference to the accompanying drawings in which like numerals are used to represent like elements and wherein.

DETAILED DESCRIPTION OF PREFERRED EMBODIMENTS

First Embodiment

Figure 1:
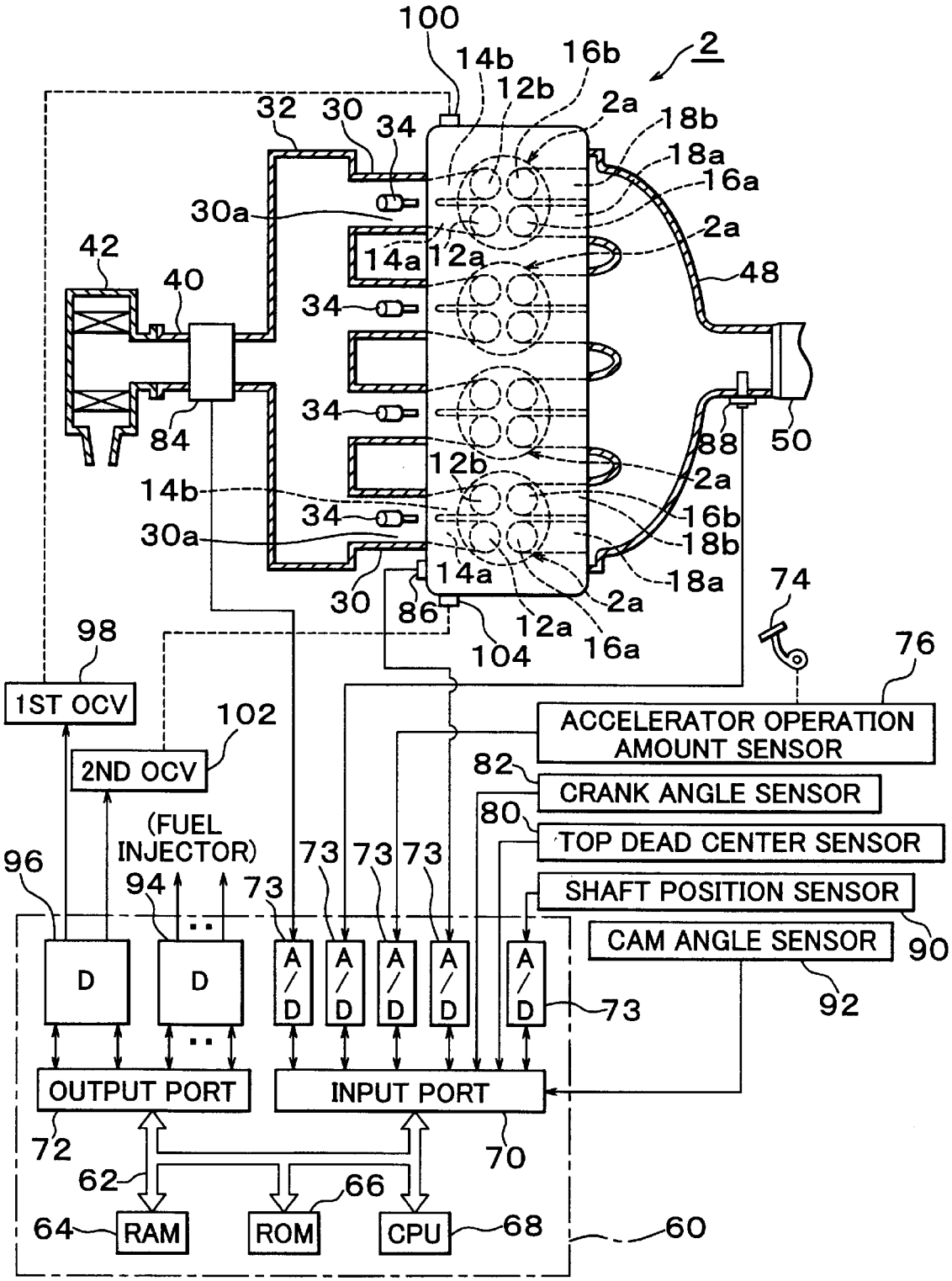
FIG. 1 is a schematic block diagram illustrating the construction of an internal combustion engine and a control system thereof according to a first embodiment of the invention.
Figure 2:
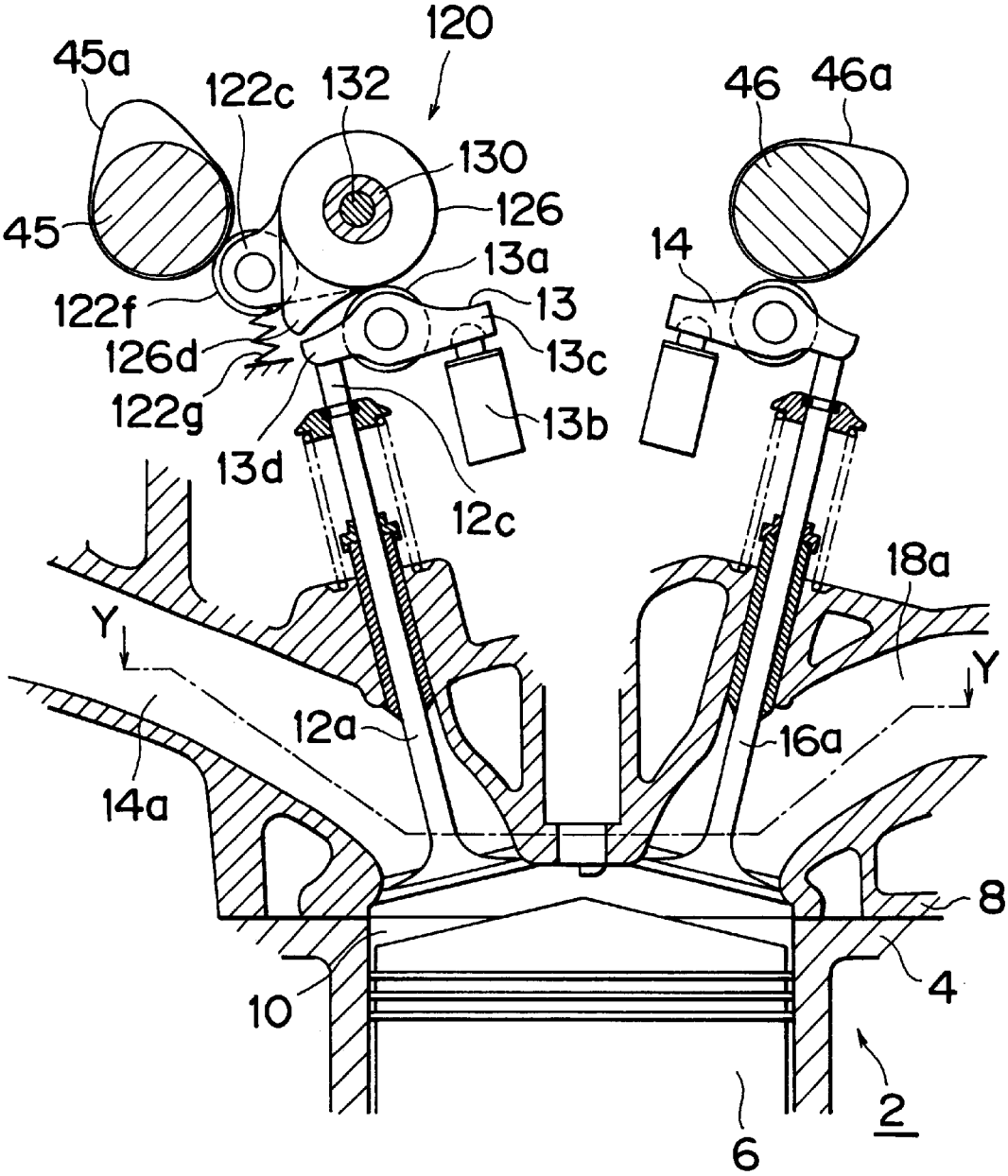
FIG. 2 is a vertical cross-sectional view of the engine of FIG. 1.
Figure 3:
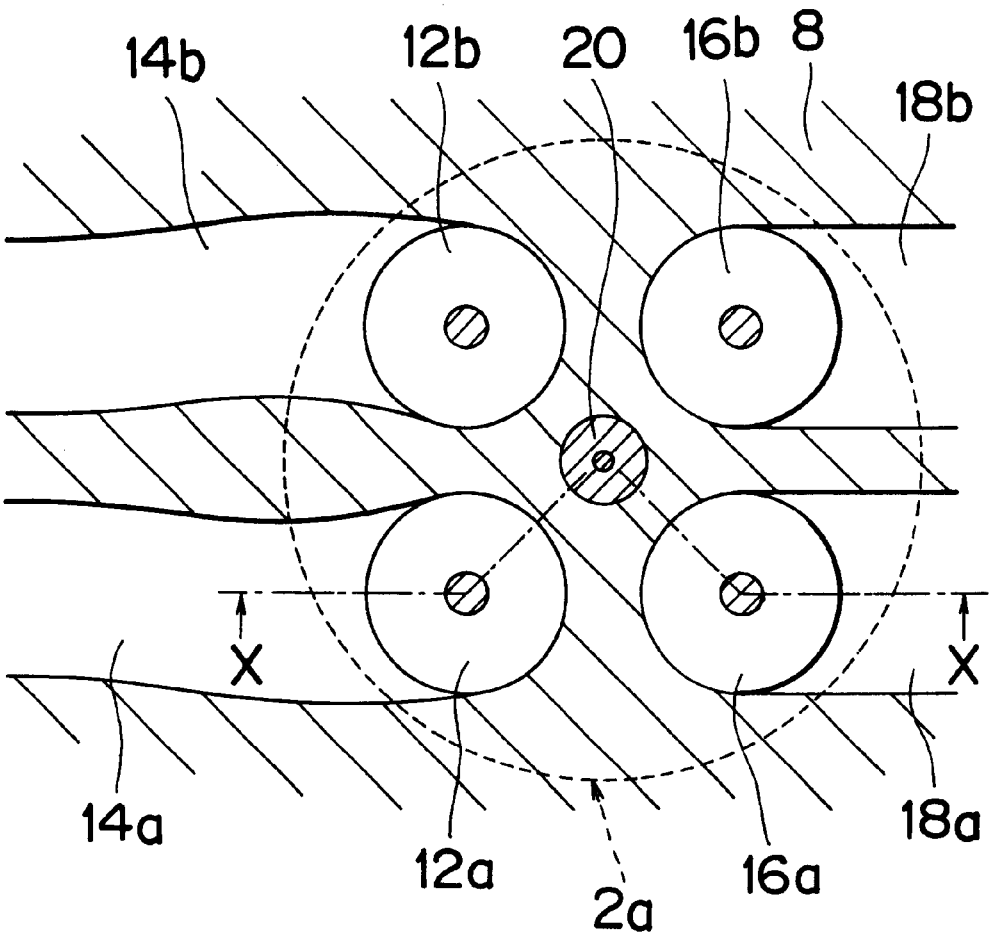
FIG. 3 is a cross-sectional view taken along line Y—Y of FIG. 2.

FIG. 1 is a block diagram schematically illustrating a gasoline engine (hereinafter simply referred to as "engine") 2 as one type of internal combustion engine to which the invention is applied, and a control system for controlling the engine 2. FIG. 2 is a vertical cross-sectional view of the engine 2 (which is taken along line X—X indicated in FIG. 3). FIG. 3 is a cross-sectional view taken along line Y—Y indicated in FIG. 2.

The engine 2 is installed in an automobile for driving the automobile. The engine 2 includes a cylinder block 4, pistons 6 provided for reciprocating movements in the cylinder block 4, a cylinder head 8 mounted on the cylinder block 4, etc. Four cylinders 2*a* are formed in the cylinder block 4. In each cylinder 2*a*, a combustion chamber 10 is defined by the cylinder block 4, the corresponding piston 6 and the cylinder head 8.

As shown in FIG. 1, a first intake valve 12*a*, a second intake valve 12*b*, a first exhaust valve 16*a* and a second exhaust valve 16*b* are disposed so as to face each combustion chamber 10. These valves are arranged such that the first intake valve 12*a* opens and closes a first intake port 14*a*, the second intake valve 12*b* opens and closes a second intake port 14*b*, the first exhaust valve 16*a* opens and closes a first exhaust port 18*a*, and the second exhaust valve 16*b* opens and closes a second exhaust port 18*b*.

The first intake port 14*a* and the second intake port 14*b* of each cylinder 2*a* are connected to a surge tank 32 via a corresponding one of intake channels 30*a* formed in an intake manifold 30. Each intake channel 30*a* is provided with a fuel injector 34, so that a required amount of fuel can be injected into the first intake port 14*a* and the second intake port 14*b*.

The surge tank 32 is connected to an air cleaner 42 via an intake duct 40. A throttle valve is not provided in the intake duct 40. Control of the amount of intake air in accordance with the operation of an accelerator pedal 74 and the engine speed NE during idle speed control is accomplished by adjusting the amount of lift of the first and second intake valves 12*a*, 12*b*. The amount of lift of the intake valves 12*a*, 12*b* is adjusted by causing a lift-varying actuator 100 (FIG. 1) to drive intermediate drive mechanisms 120 (which will be described later) disposed between rocker arms 13 and intake cams 45*a* (corresponding to "rotating cam") provided on an intake camshaft 45. The valve timing of the intake valves 12*a*, 12*b* is adjusted by a rotational-phase-difference-varying actuator 104 (FIG. 1) (which will be simply referred to as "phase-different-varying actuator 104) in accordance with the operation state or conditions of the engine 2.

The first exhaust valve 16*a* for opening and closing the first exhaust port 18*a* of each cylinder 2*a* and the second exhaust valve 16*b* for opening and closing the second exhaust port 18*b* are opened and closed by means of rocker arms 14 with a constant amount of lift while exhaust cams 46*a* provided on an exhaust camshaft 46 are being rotated in accordance with the operation of the engine 2. The first exhaust port 18*a* and the second exhaust port 18*b* of each cylinder 2*a* are connected to an exhaust manifold 48. With this arrangement, exhaust gases are discharged to the outside through a catalytic converter 50.

An electronic control unit (hereinafter referred to as "ECU") 60, which is in the form of a digital computer, includes a RAM (random access memory)) 64, a ROM (read-only memory) 66, a CPU (microprocessor) 68, an input port 70, and an output port 72 that are interconnected by a bidirectional bus 62.

An accelerator operation amount sensor 76 is attached to the accelerator pedal 74, and produces an output voltage signal that is proportional to the amount of depression of the accelerator pedal 74 (hereinafter referred to as "accelerator operating amount ACCP"). The output voltage signal is transmitted to the input port 70 through an A/D converter 73. A top dead center sensor 80 generates an output pulse when, for example, the number 1 cylinder of the cylinders 2*a* reaches the top dead center during the intake stroke. The output pulses thus generated by the top dead center sensor 80 are transmitted to the input port 70. A crank angle sensor 82 generates an output pulse at every 30° rotation of the crankshaft. The output pulses thus generated by the crank angle sensor 82 are transmitted to the input port 70. The CPU 68 calculates a current crank angle based on the output pulses received from the top dead center sensor 80 and the output pulses received from the crank angle sensor 82, and calculates an engine speed NE based on the frequency of the output pulses received from the crank angle sensor 82.

The intake duct 40 is provided with an intake air amount sensor 84 that produces an output voltage signal corresponding to the amount of intake air GA flowing in the intake duct 40. The output voltage signal is transmitted from the sensor 84 to the input port 70 via an A/D converter 73. The cylinder block 4 of the engine 2 is provided with a water temperature sensor 86 that detects the temperature THW of cooling water of the engine 2 and produces an output voltage signal in accordance with the cooling water temperature THW. The output voltage signal is transmitted from the sensor 86 to the input port 70 via an A/D converter 73. Furthermore, the exhaust manifold 48 is provided with an air-fuel ratio sensor 88 that produces an output voltage signal indicative of the air-fuel ratio of exhaust gases flowing through the manifold 48. The output voltage signal is transmitted from the sensor 88 to the input port 70 via an A/D converter 73.

Furthermore, a shaft position sensor 90 is provided for detecting the displacement of a control shaft 132 in the axial direction thereof when the shaft 132 is moved by the lift-varying actuator 100. The shaft position sensor 90 generates an output voltage signal indicative of the axial displacement of the shaft to the input port 70 via an A/D converter 73. A cam angle sensor 92 is provided for detecting the cam angle of the intake cams 45*a* that drive the intake valves 12*a*, 12*b* via an intermediate drive mechanisms 120. The cam angle sensor 92 generates output pulses to the input port 70 as the intake camshaft 45 rotates. The input port 70 also receives various other signals, which are not essential to the first embodiment of the invention and are thus not illustrated in FIG. 1.

The output port 72 is connected to each fuel injector 34 via a corresponding drive circuit 94. The ECU 60 performs valve opening control on each fuel injector 34 in accordance with the operating state of the engine 2, to thereby control the fuel injection timing and the fuel injection amount.

The output port 72 is also connected to a first oil control valve 98 via a drive circuit 96, so that the ECU 60 controls the lift-varying actuator 100 in accordance with the operating state of the engine 2, such as a required amount of intake air. The output port 72 is further connected to a second oil control valve 102 via a drive circuit 96, so that the ECU 60 controls the phase-difference-varying actuator 104 in accordance with the operating state of the engine 2. With this arrangement, the ECU 60 controls the valve timing and the amount of lift of the intake valves 12*a*, 12*b*, so as to implement the intake air amount control and other controls (such as those for improving the volumetric efficiency or controlling an EGR amount).

Figure 4:
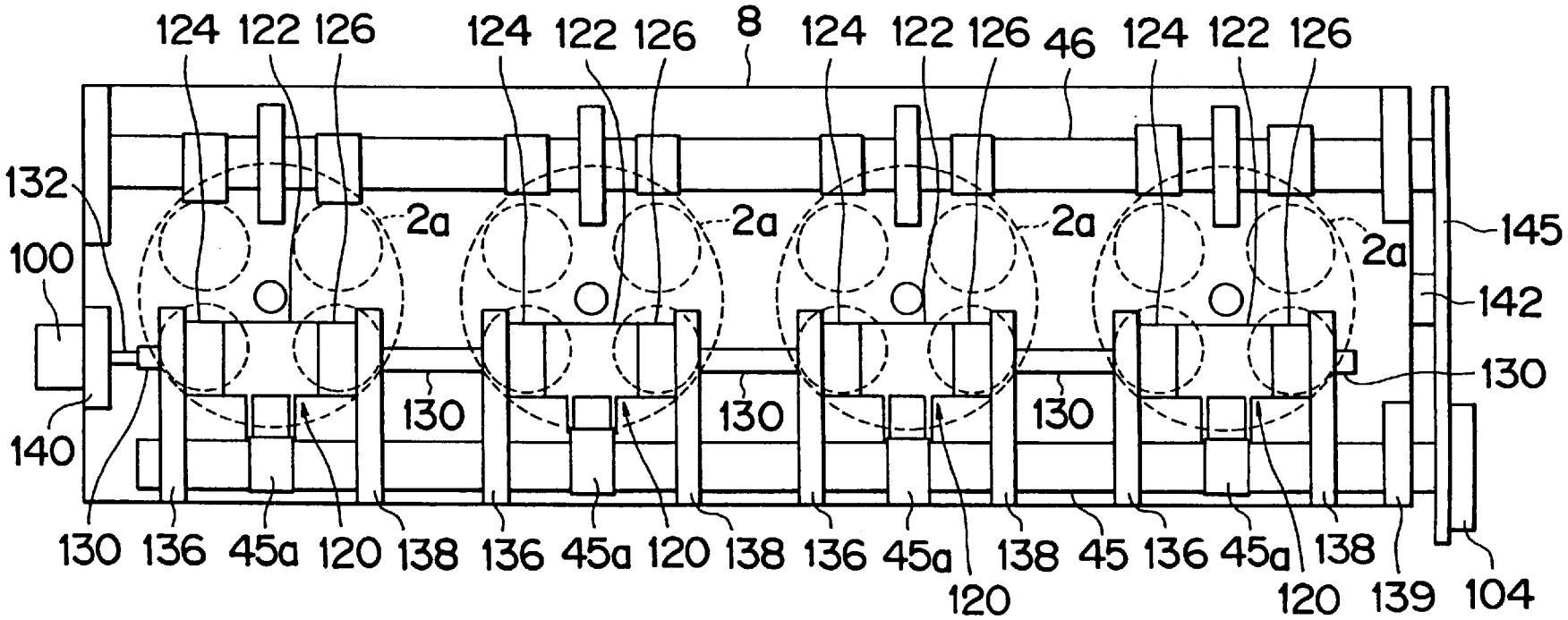
FIG. 4 is a view showing a portion of the cylinder head of the engine of FIG. 1, including intake and exhaust camshafts and a variable valve drive mechanism.

The variable valve drive mechanism for the intake valves 12*a*, 12*b* will be now described. FIG. 4 shows in detail a portion of the cylinder head 8 including the intake camshaft 45, a variable valve drive mechanism attached to the intake camshaft 45, and other components.

The variable valve drive mechanism includes a total of four intermediate drive mechanisms 120 provided for the respective cylinders 2*a*, the lift-varying actuator 100 attached to one end of the cylinder head 8, and the phase-difference-varying actuator 104 attached to the other end of the cylinder head 8.

Figure 5:
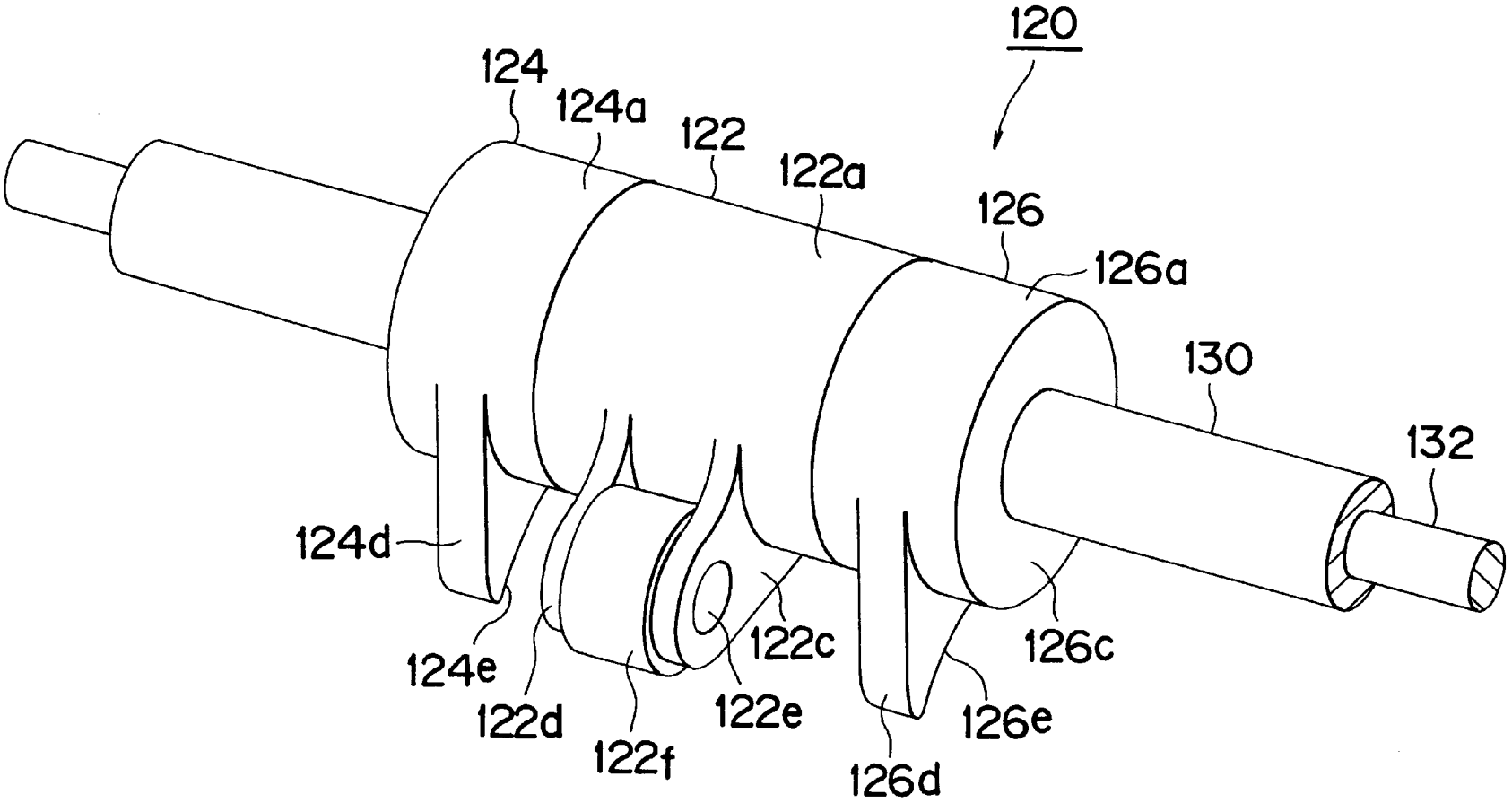
FIG. 5 is a perspective view showing an intermediate drive mechanism included in the first embodiment of the invention.
Figure 6A:
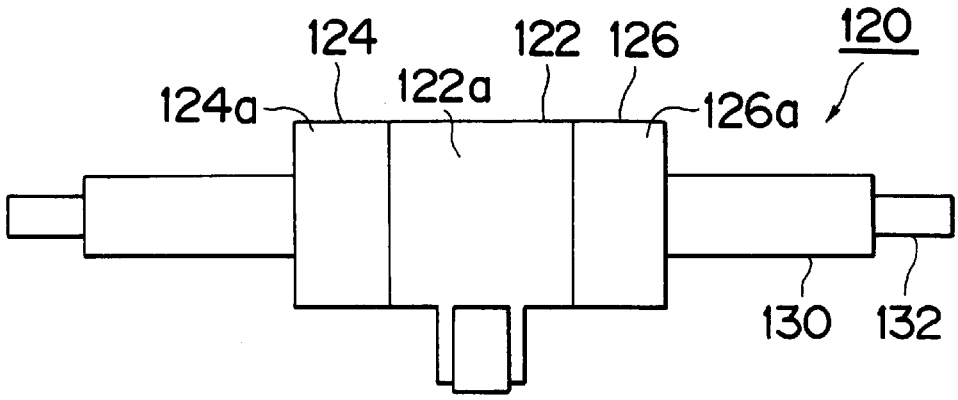
FIGS. 6A, 6B and 6C are a plan view, a front elevational view, and a right-hand side view, respectively, of the intermediate drive mechanism of FIG. 5.
Figure 6B:
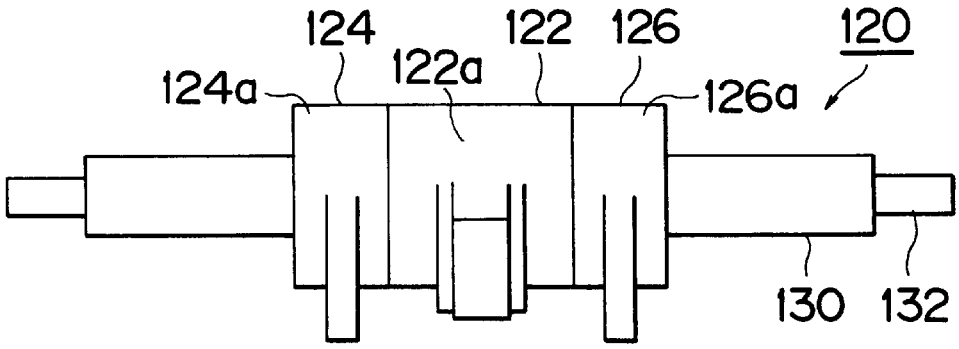
Figure 6C:
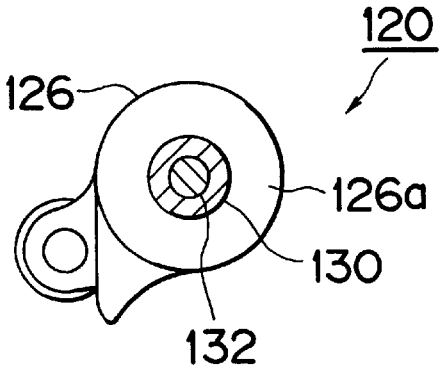

One of the intermediate drive mechanisms 120 is illustrated in FIGS. 5 and 6A to 6C. FIG. 5 is a perspective view of the intermediate drive mechanism 120. FIGS. 6A, 6B and 6C are a plan view, a front elevational view, and a right-hand side view of the drive mechanism 120, respectively. The intermediate drive mechanism 120 has an input portion 122 formed in a central portion thereof, a first rocking cam 124 formed to the left of the input portion 122, and a second rocking cam 126 formed to the right of the input portion 122. A housing 122*a* of the input portion 122, and housings 124*a*, 126*a* of the rocking cams 124, 126 have cylindrical shapes with equal outside diameters.

Figure 7:
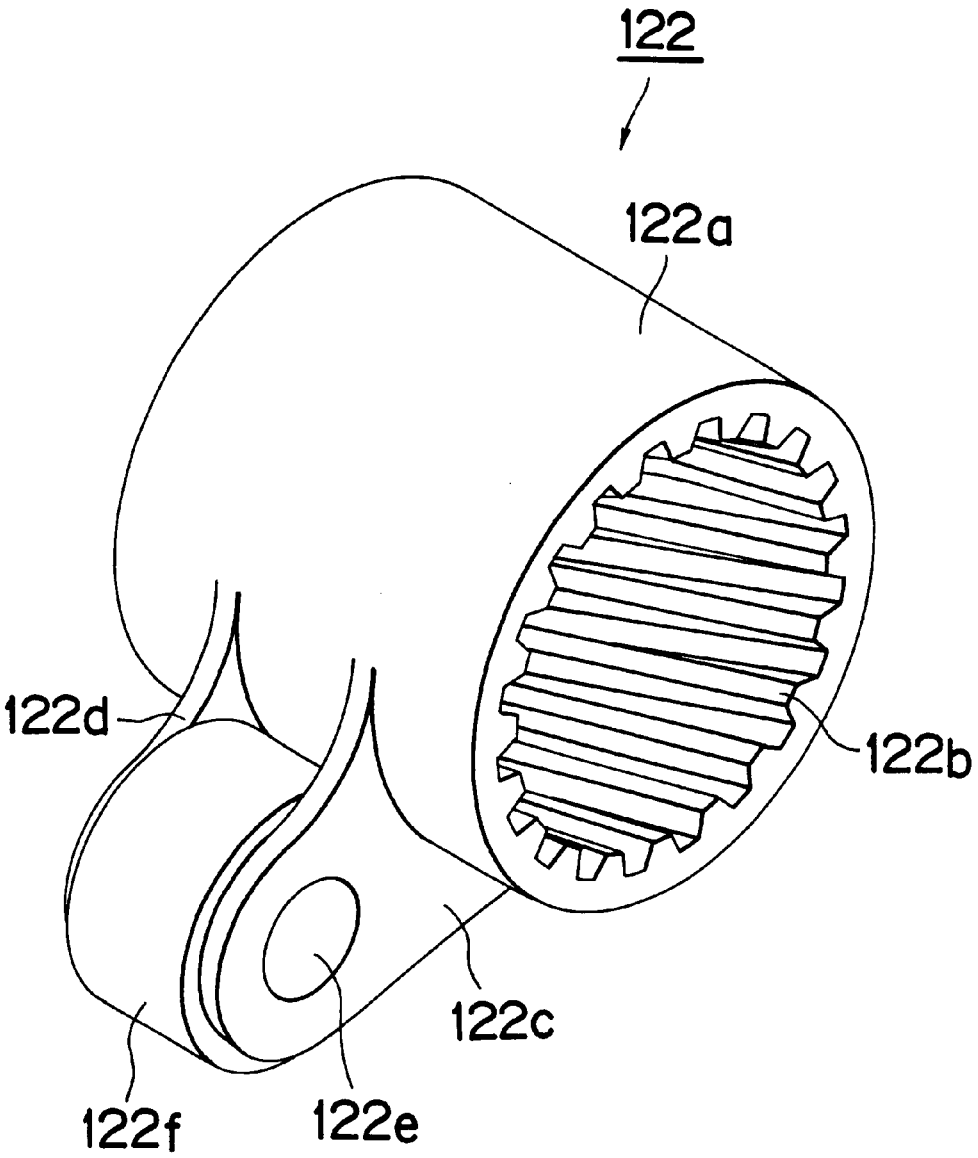
FIG. 7 is a perspective view showing an input portion included in the first embodiment of the invention.
Figure 8A:
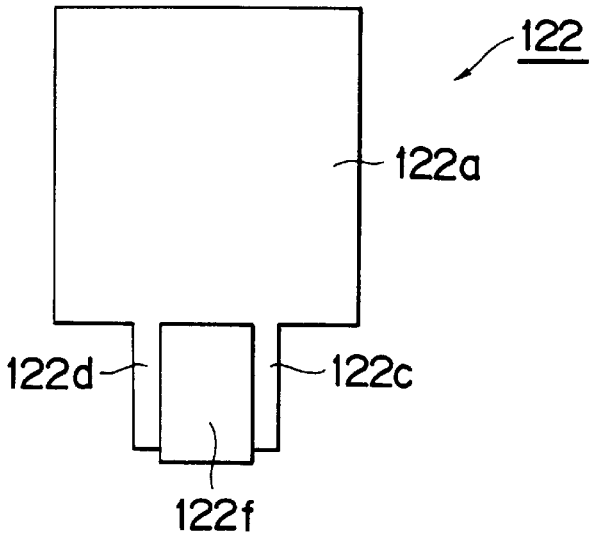
FIGS. 8A, 8B and 8C are a plan view, a front elevational view, and a right-hand side view, respectively, of the input portion of FIG. 7.
Figure 8B:
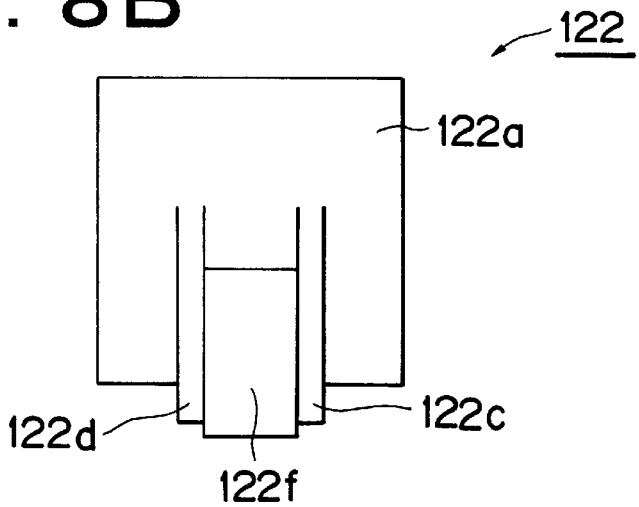
Figure 8C:
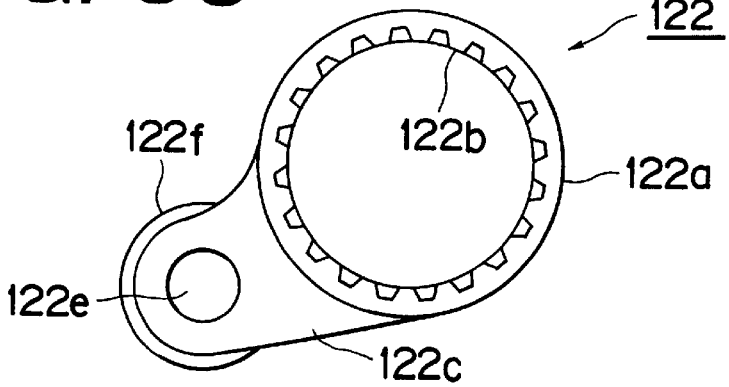
Figure 9:
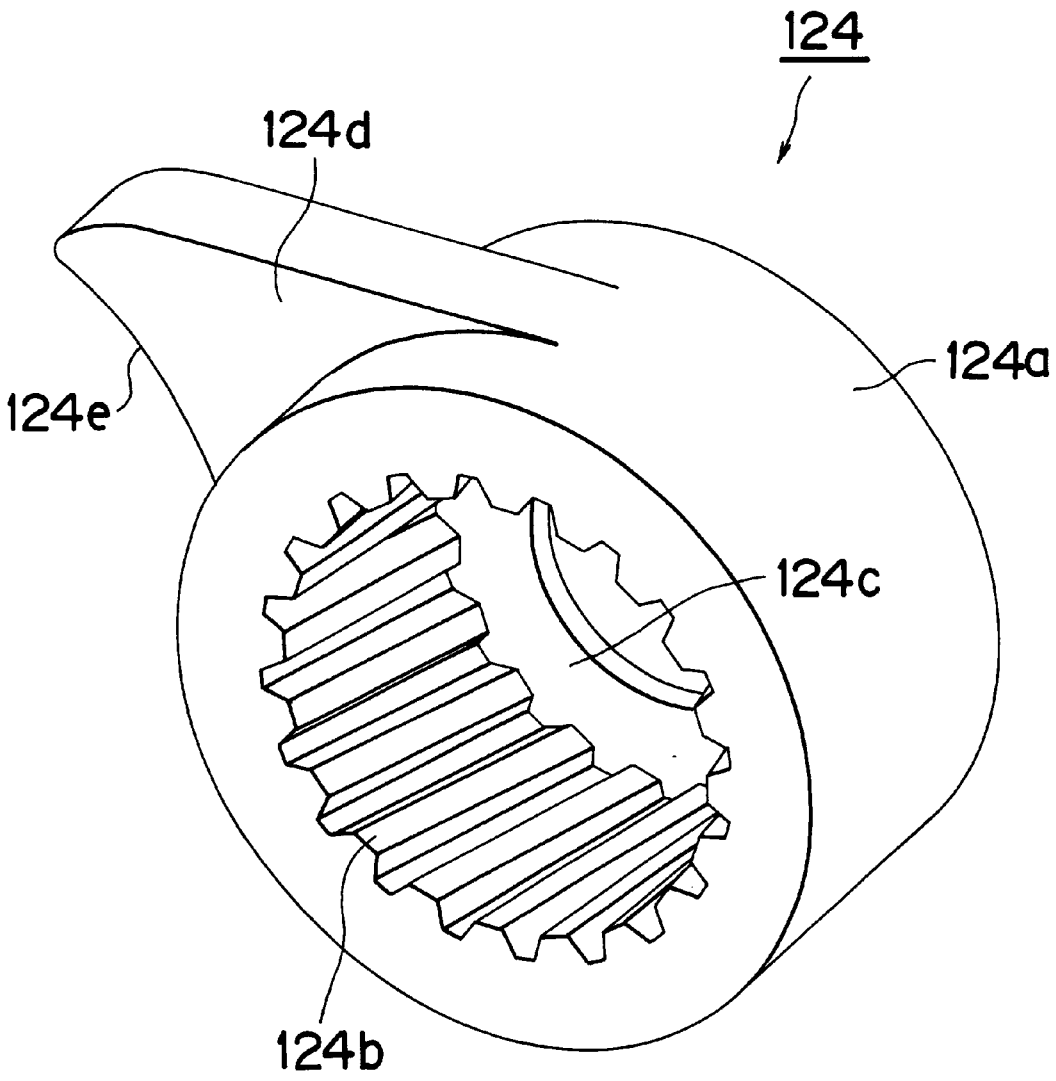
FIG. 9 is a perspective view showing a first rocking cam included in the first embodiment of the invention.
Figure 10A:
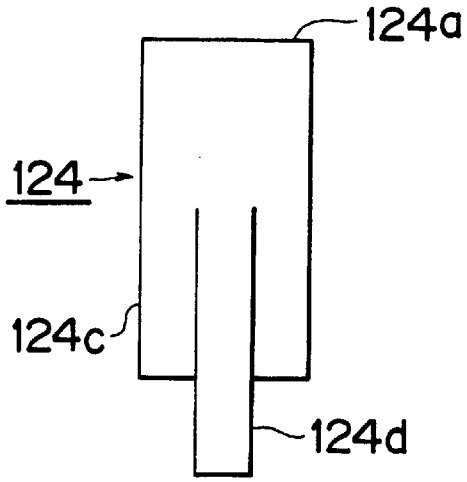
FIGS. 10A, 10B, 10C, 10D and 10E are a plan view, a front elevational view, a bottom plan view, and a right-hand side view, respectively, of the first rocking cam of FIG. 9.
Figure 10B:
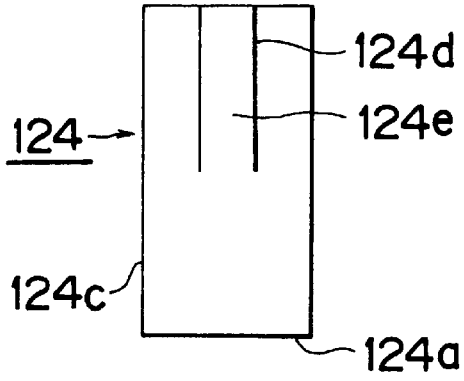
Figure 10C:
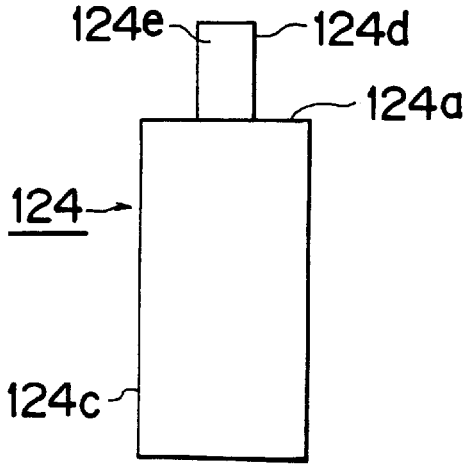
Figure 10D:
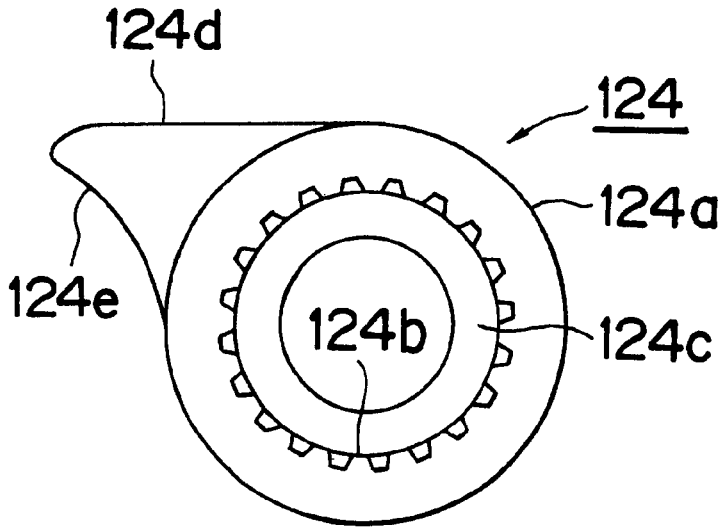
Figure 10E:
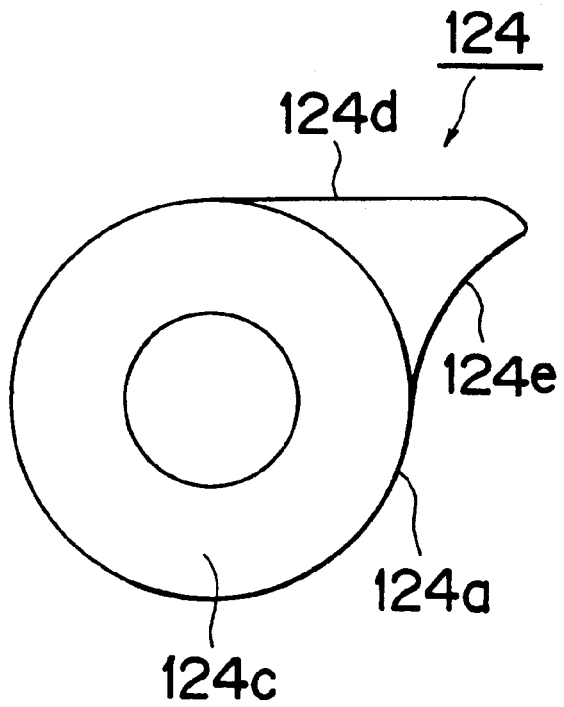
Figure 11:
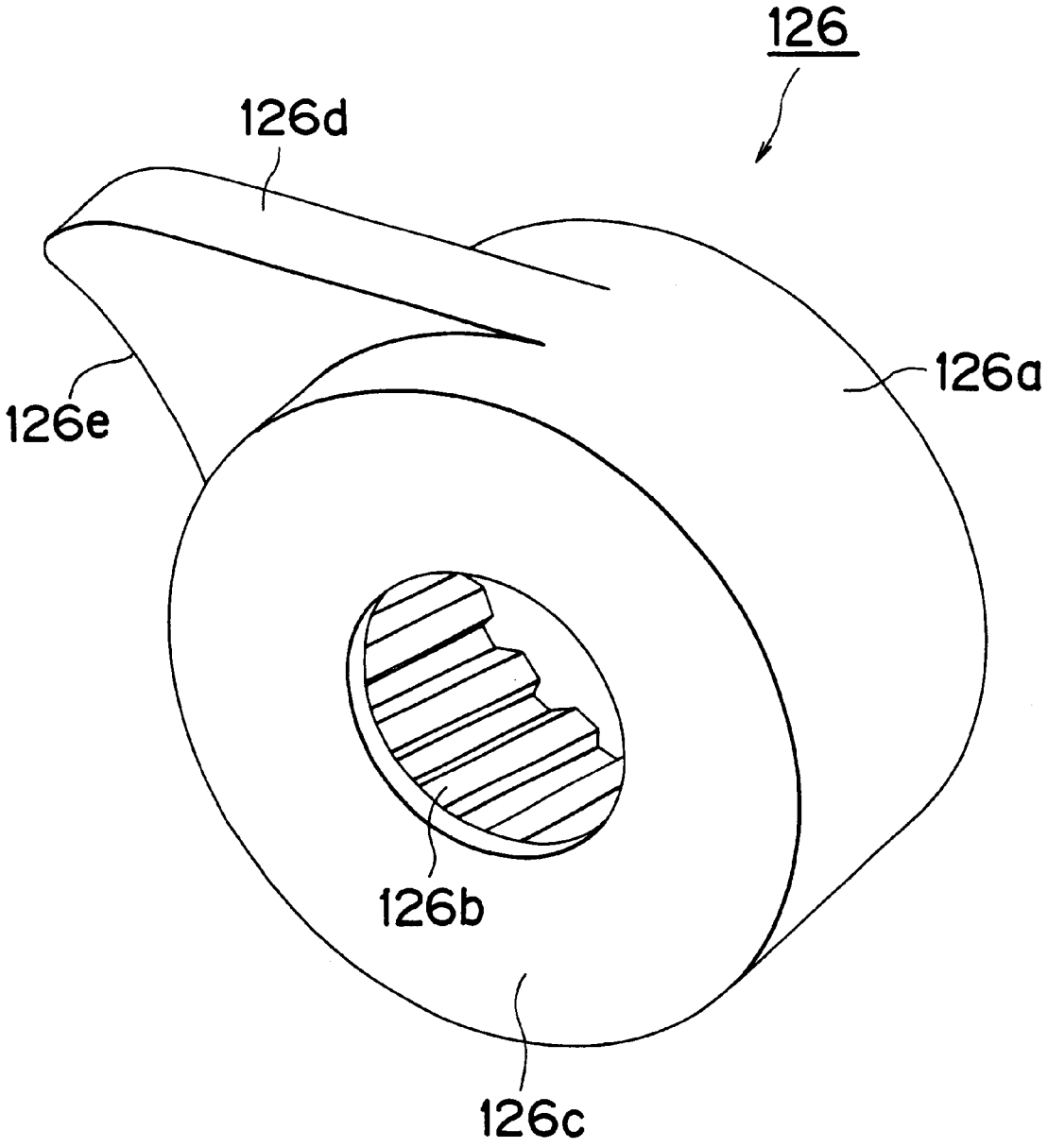
FIG. 11 is a perspective view showing a second rocking cam included in the first embodiment of the invention.
Figure 12A:
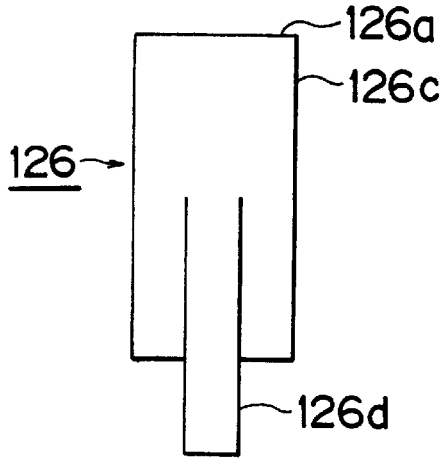
FIGS. 12A, 12B, 12C, 12D and 12E are a plan view, a front elevational view, a bottom plan view, a right-hand side view, and a left-hand side view, respectively, of the second rocking cam of FIG. 11.
Figure 12B:
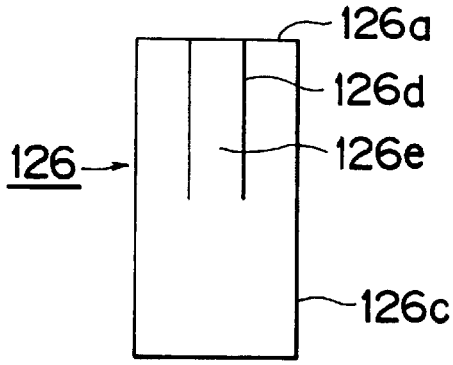
Figure 12C:
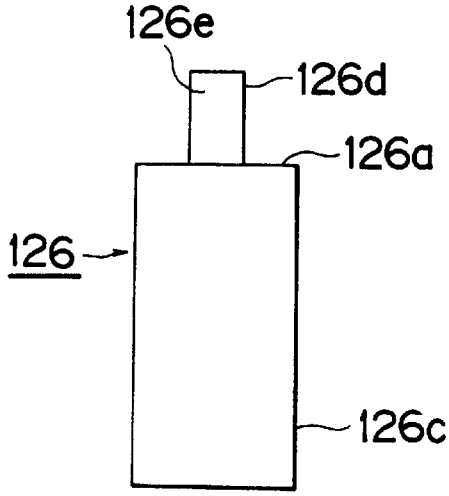
Figure 12D:
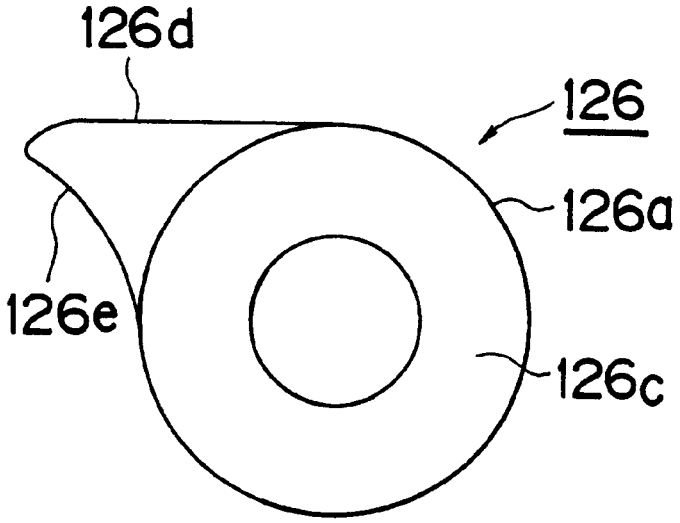
Figure 12E:
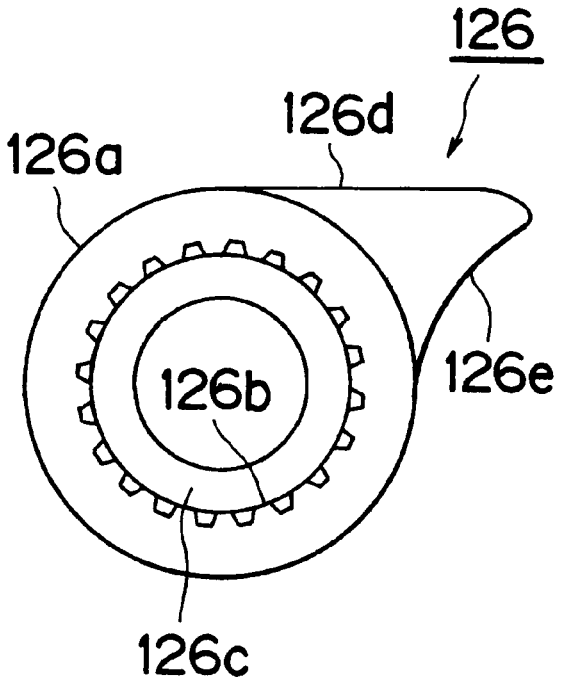
Figure 13:
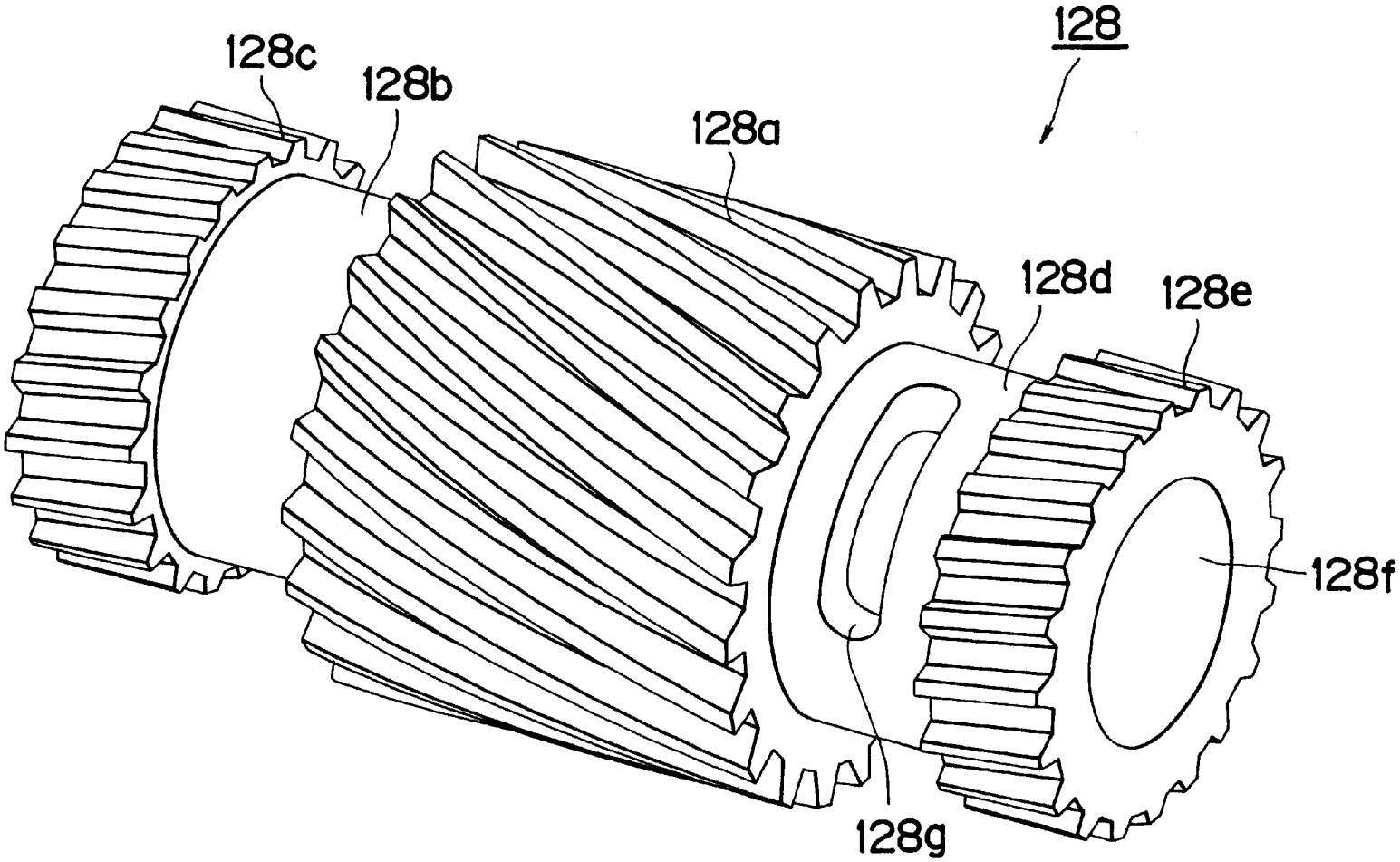
FIG. 13 is a perspective view showing a slider gear included in the first embodiment of the invention.
Figure 14A:
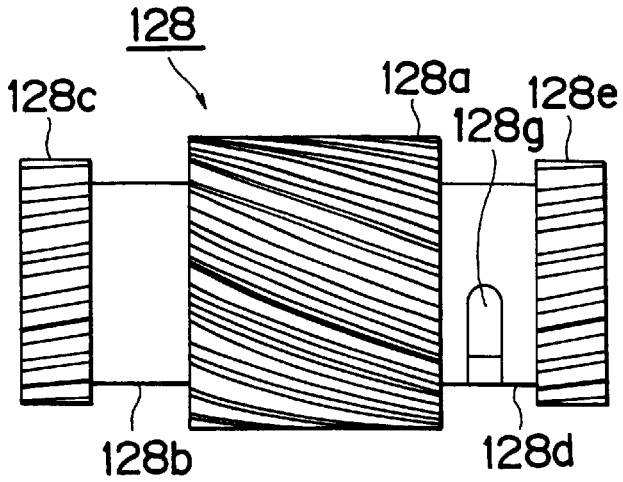
FIGS. 14A, 14B and 14C are a plan view, a front elevational view, and a right-hand side view, respectively, of the slider gear of FIG. 13.
Figure 14B:
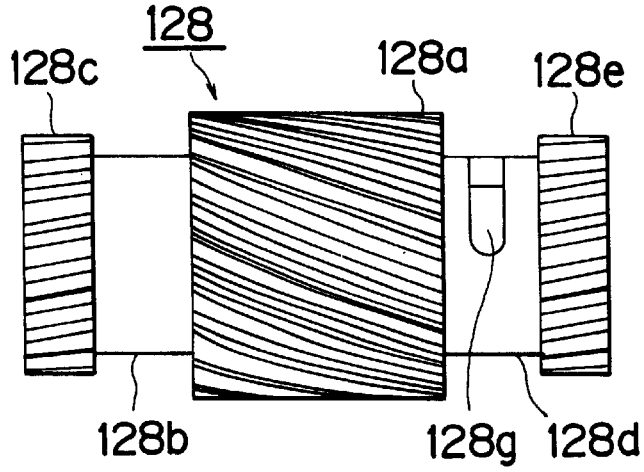
Figure 14C:
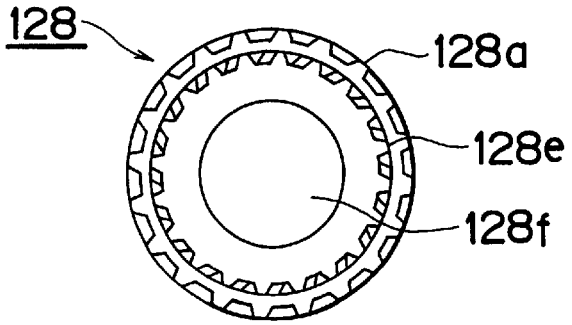
Figure 15A:
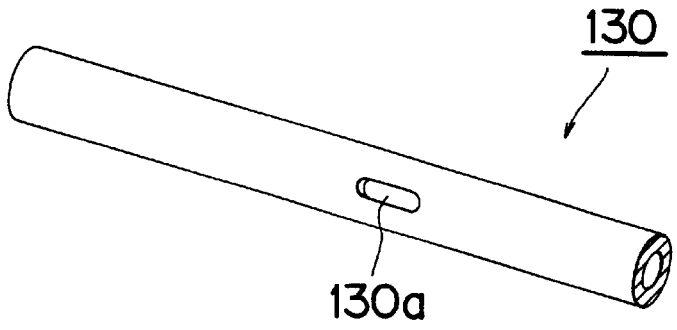
FIGS. 15A, 15B, 15C and 15D are a perspective view, a plan view, a front elevational view, and a right-hand side view, respectively, of a support pipe included in the first embodiment of the invention.
Figure 15B:
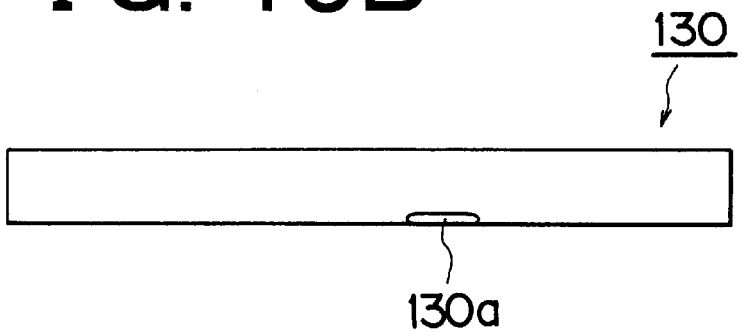
Figure 15C:
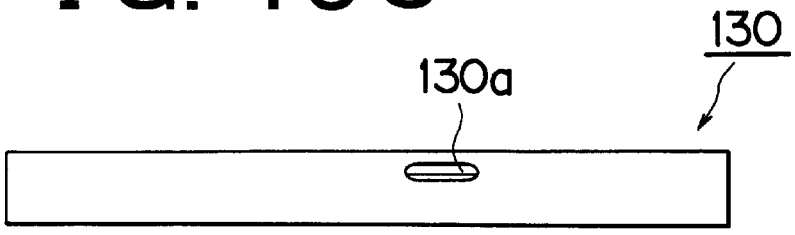
Figure 15D:
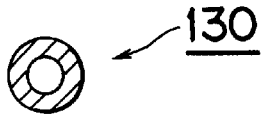
Figure 16A:
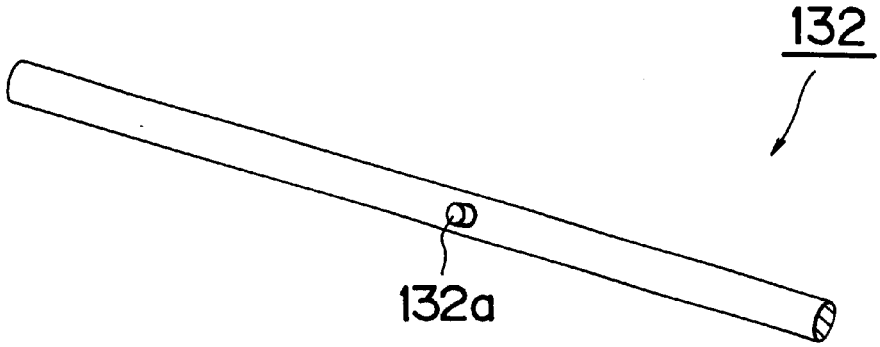
FIGS. 16A, 16B, 16C and 16D are a perspective view, a plan view, a front elevational view, and a right-hand side view, respectively, of a control shaft included in the first embodiment of the invention.
Figure 16B:
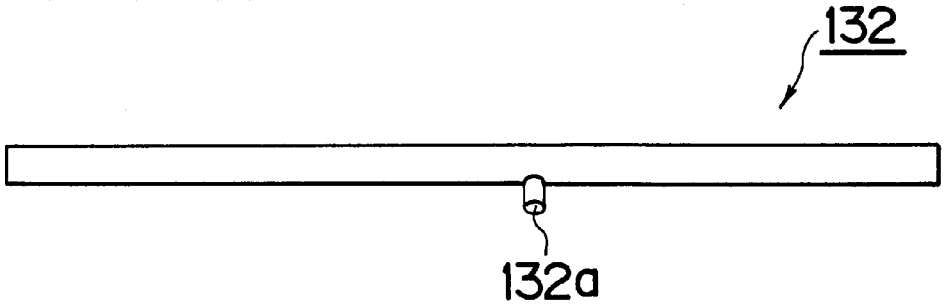
Figure 16C:
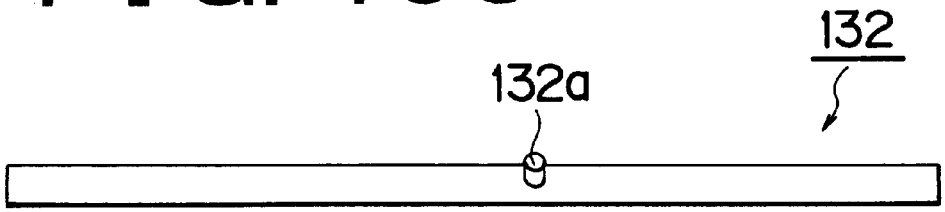
Figure 16D:
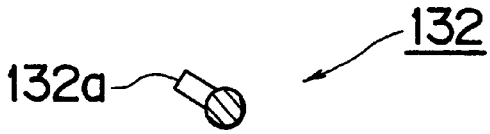
Figure 17:
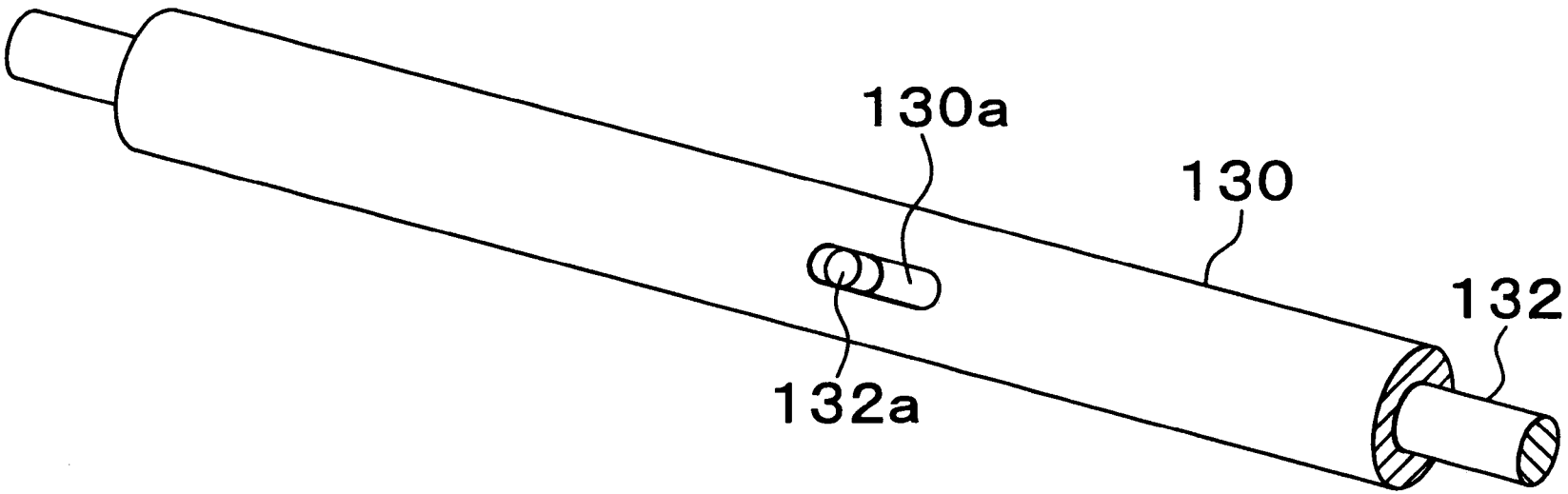
FIG. 17 is a perspective view showing an assembly of the support pipe and the control pipe of the first embodiment.
Figure 18A:
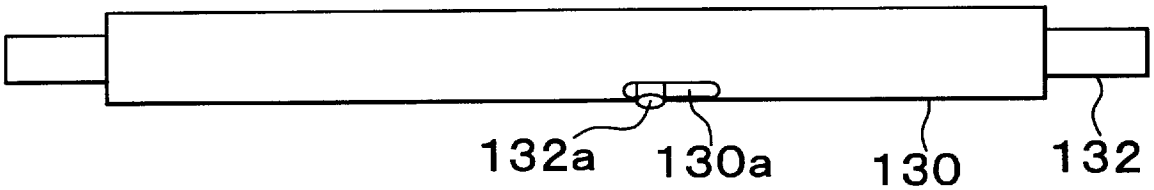
FIGS. 18A, 18B and 18C are a plan view, a front elevational view, and a right-hand side view, respectively, of the assembly of the support pipe and the control pipe of FIG. 17.
Figure 18B:
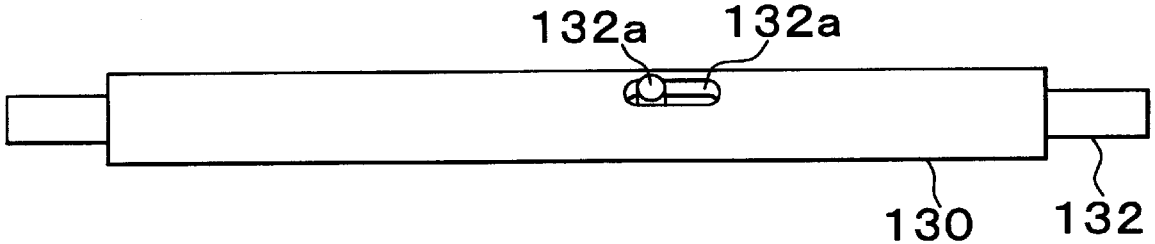
Figure 18C:
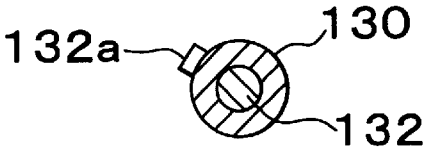
Figure 19:
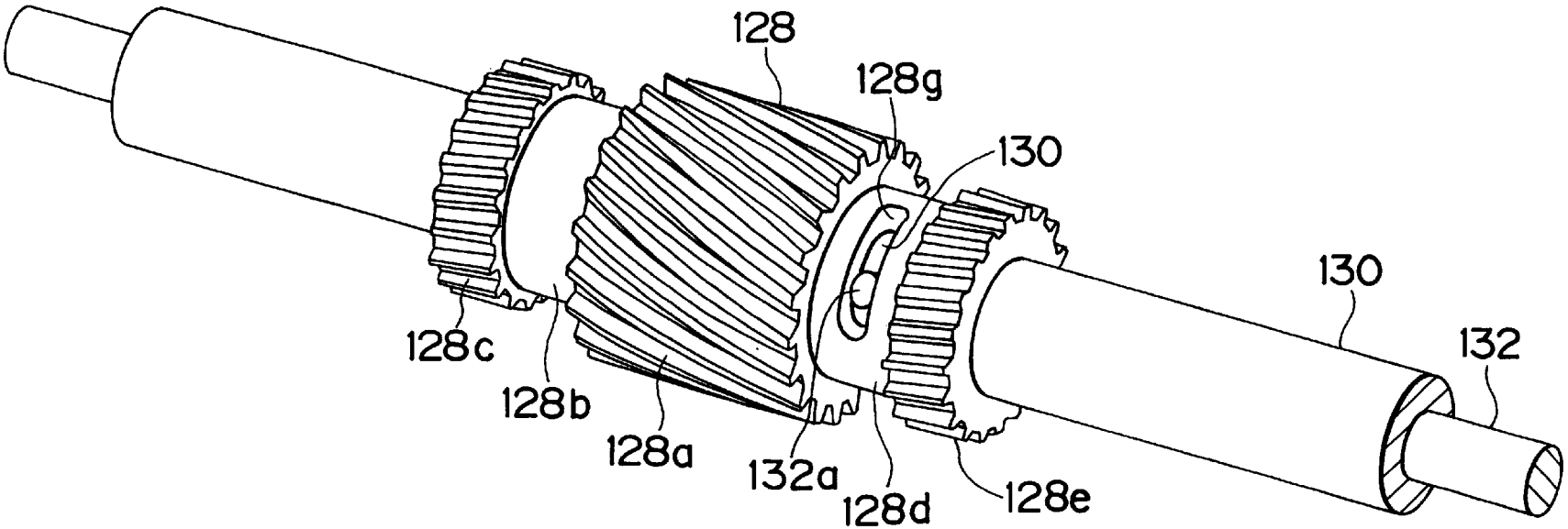
FIG. 19 is a perspective view of an assembly of the support pipe, the control shaft and the slider gear of the first embodiment.
Figure 20A:
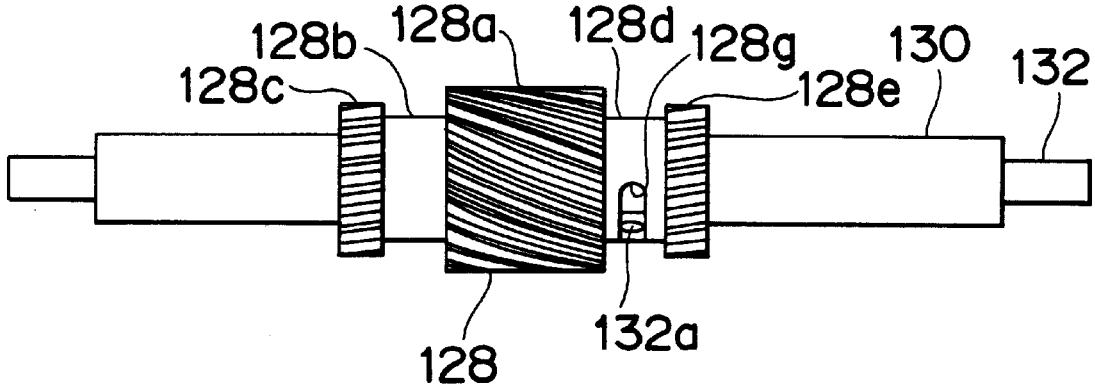
FIGS. 20A, 20B and 20C are a plan view, a front elevational view, and a right-hand side view, respectively, of the assembly of the support pipe, the control shaft and the slider gear of FIG. 19.
Figure 20B:
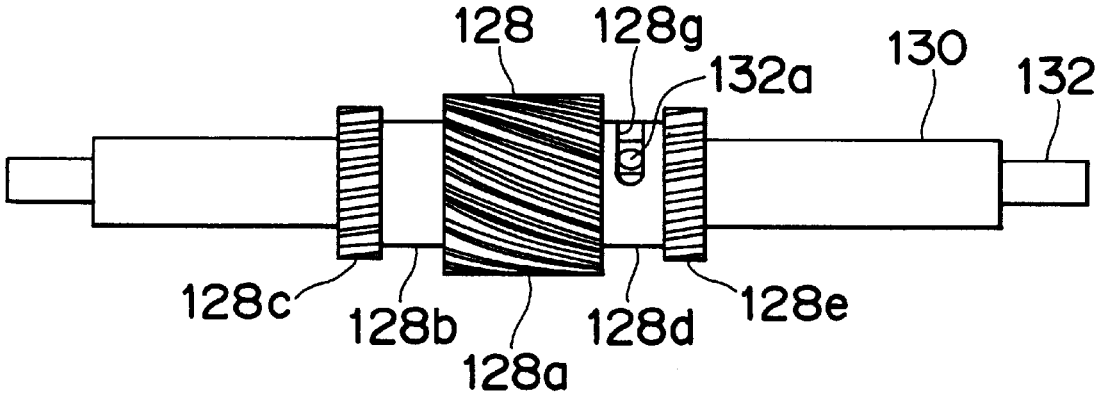
Figure 20C:
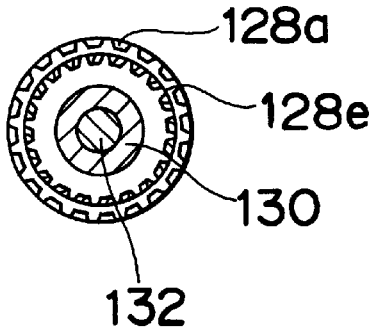

The construction of the input portion 122 is illustrated in FIGS. 7 and 8A to 8C. FIG. 7 is a perspective view of the input portion 122. FIGS. 8A, 8B and 8C are a plan view, a front elevational view, and a right-hand side view of the input portion 122, respectively. The housing 122*a* of the input portion 122 defines an internal space that extends in the direction of the axis of the housing 122*a*. An inner circumferential surface of the housing 122*a* defining the internal space has helical splines 122*b* that are formed in the axial direction in a helical fashion of a right-hand thread. Two parallel arms 122*c*, 122*d* protrude from an outer circumferential surface of the housing 122*a*. Distal end portions of the arms 122*c*, 122*d* support a shaft 122*e* extending between the arms 122*c*, 122*d*. The shaft 122*e* extends in parallel with the axis of the housing 122*a*. A roller 122*f* is rotatably mounted on the shaft 122*e*.

The construction of the first rocking cam 124 is illustrated in FIGS. 9 and 10A to 10E. FIGS. 9, 10A, 10B, 10C, 10D and 10E are a perspective view, a plan view, a front elevational view, a bottom plan view, a right-hand side view, and a left-hand side view, respectively. The housing 124*a* of the first rocking cam 124 defines an internal space that extends in the axial direction of the housing 124*a*. An inner circumferential surface of the housing 124*a* defining the internal space has helical splines 124*b* that are formed in the axial direction in a helical fashion of a left-hand thread. A left-side end of the internal space is covered with a ring-like bearing 124*c* having a small-diameter central hole. A generally triangular nose 124*d* protrudes from an outer circumferential surface of the housing 124*a*. One side of the nose 124*d* forms a cam face 124*e* that is a concavely curved face.

The construction of the second rocking cam 126 is illustrated in FIGS. 11 and 12A to 12E. FIGS. 11, 12A, 12B, 12C, 12D and 12E are a perspective view, a plan view, a front elevational view, a bottom plan view, a right-hand side view, and a left-hand side view, respectively. The housing 126*a* of the second rocking cam 126 defines an internal space that extends in the axial direction of the housing 126*a*. An inner circumferential surface of the housing 126*a* defining the internal space has helical splines 126*b* that are formed in the axial direction in a helical form of a left-hand thread. A right-side end of the internal space is covered with a ring-like bearing 126*c* having a small-diameter central hole. A generally triangular nose 126*d* protrudes from an outer circumferential surface of the housing 126*a*. One side of the nose 126*d* forms a cam face 126*e* that is a concavely curved face.

The first rocking cam 124 and the second rocking cam 126 are disposed on the opposite sides of the input portion 122 such that the bearings 124*c*, 126*c* face axially outward, and such that corresponding end faces of the cams and input portion contact with each other. Thus, the assembly of the cams 124, 126 and the input portion 122 that are arranged on the same axis has a generally cylindrical shape with an internal space as shown in FIG. 5.

A slider gear 128 as shown in FIGS. 13 and 14A to 14C is disposed in the internal space defined by the input portion 122 and the two rocking cams 124, 126. FIGS. 13, 14A, 14B and 14C are a perspective view, a plan view, a front elevational view, and a right-hand side view of the slider gear 128, respectively. The slider gear 128 has a generally cylindrical shape. A central portion of an outer circumferential surface of the slider gear 128 has input helical splines 128*a* that are formed in a helical fashion of a right-hand thread. First output helical splines 128*c* that are formed in a helical fashion of a left-hand thread are located on the left-hand side of the input helical splines 128*a*. A small-diameter portion 128*b* is interposed between the input helical splines 128*a* and the first output helical splines 128*c*. Second output helical splines 128*e* that are formed in a helical fashion of a left-hand thread are located on the right-hand side of the input helical splines 128*a*. A small-diameter portion 128*d* is interposed between the input helical splines 128*a* and the second output helical splines 128*e*. The first and second output helical splines 128*c*, 128*e* have a smaller outside diameter than the input helical splines 128*a*. When the input portion 122 is mounted onto the input helical splines 128*a*, therefore, the first output helical splines 128*c*, 128*e* are allowed to pass through the internal space of the input portion 122.

A through-hole 128*f* is formed through the slider gear 128 in the direction of the center axis of the gear 128. The small-diameter portion 128*d* has an elongate hole 128*g* through which the through-hole 128*f* is open onto the outer circumferential surface of the slider gear 128. The elongate hole 128*g* has a larger dimension in the circumferential direction of the slider gear 128.

A support pipe 130 that is partially shown in FIGS. 15A to 15D is disposed within the through-hole 128*f* of the slider gear 128 such that the support pipe 130 is slidable in the circumferential direction. FIGS. 15A, 15B, 15C and 15D are a perspective view, a plan view, a front elevational view, and a right-hand side view, respectively. The support pipe 130 is a single support pipe that is shared by all the intermediate drive mechanisms 120 as shown in FIG. 4. The support pipe 130 has an elongate hole 130*a* for each intermediate drive mechanism 120. Each elongate hole 130*a* has a larger dimension in the axial direction of the support pipe 130.

The control shaft 132 extends through an interior of the support pipe 130 such that the control shaft 132 is slidable in the axial direction. FIGS. 16A, 16B, 16C and 16D are a perspective view, a plan view, a front elevational view and a right-hand side view each showing a part of the control shaft 132. Like the support pipe 130, the single control shaft 132 is shared or commonly used by all the intermediate drive mechanisms 120. A stopper pin 132*a*, which protrudes from the control shaft 132, is provided for each intermediate drive mechanism 120. Each stopper pin 132*a* extends through a corresponding one of the axially elongated holes 130*a* of the support pipe 130. A sub-assembly of the support pipe 130 and the control shaft 132 is illustrated in FIGS. 17 and 18A to 18C. FIGS. 17, 18A, 18B and 18C are a perspective view, a plan view, a front elevational view, and a right-hand side view of the assembly, respectively.

An assembly in which the slider gear 128 is assembled with the support pipe 130 and the control shaft 132 is shown in FIGS. 19 and 20A to 20C. FIGS. 19, 20A, 20B and 20C are a perspective view, a plan view, a front elevational view, and a right-hand side view, respectively.

Each stopper pin 132*a* of the control shaft 132 extends through a corresponding one of the axially elongated holes 130*a* of the support pipe 130 having a larger dimension in the axial direction. Furthermore, a distal end of each stopper pin 132*a* is inserted through the circumferentially elongated hole 128*g* of a corresponding one of the slider gears 128. To provide the arrangement of FIGS. 19 and 20A to 20C, it is possible to form the stopper pin 132*a* on the control shaft 132 by passing the pin 132 through the elongated holes 128*g* and 130*a* while the control shaft 132, the support pipe 130 and the slider gear 128 are assembled together as shown in FIGS. 19 and 20A to 20C.

With the axially elongated holes 130*a* thus formed in the support pipe 130, it is possible to move the stopper pins 132 of the control shaft 132 in the axial direction so as to move the slider gears 128 in the axial direction even though the support pipe 130 is fixed to the cylinder head 8. Each slider gear 128 engages, at its circumferentially elongated hole 128*g*, with the corresponding one of the stopper pins 132*a*, so that the axial position of each slider gear 128 is determined by the corresponding stopper pin 132*a*. Since the stopper pin 132 is movable in the circumferentially elongated hole 128*g*, the slider gear 128 is rockable about the axis.

Figure 21:
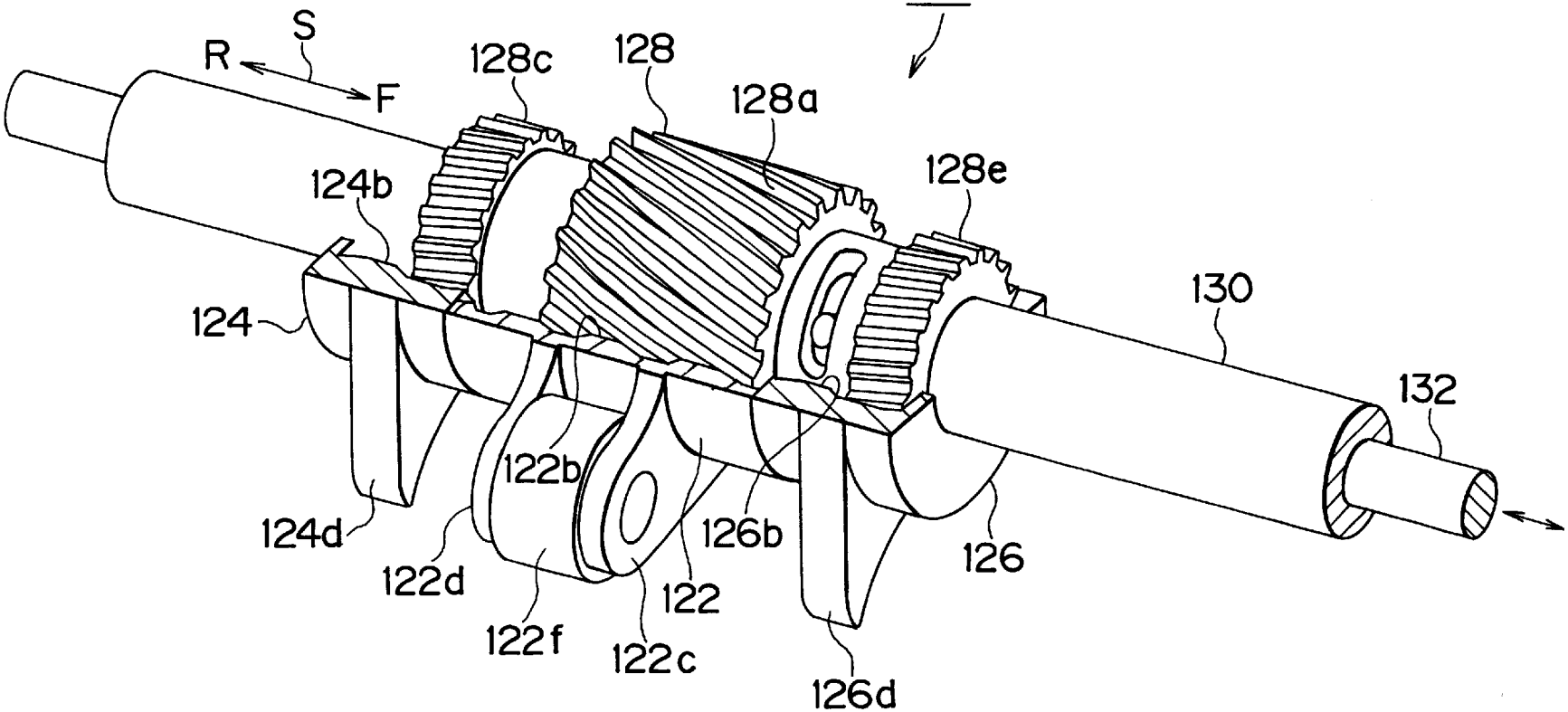
FIG. 21 is a partially cutaway perspective view showing the internal construction of the intermediate drive mechanism according to the first embodiment of the invention.

The structure as shown in FIGS. 19 and 20A to 20C is disposed within the combination of the input portion 122 and the rocking cams 124, 126 as shown in FIGS. 5 and 6, so as to construct each intermediate drive mechanism 120. The inner structure of the intermediate drive mechanism 120 is shown in the perspective view of FIG. 21. In FIG. 21, the inner structure of the intermediate drive mechanism 120 is shown by horizontally cutting the input portion 122 and the rocking cams 124, 126 and removing the upper halves of these portion and cams 122, 124, 126.

As shown in FIG. 21, the input helical splines 128*a* of the slider gear 128 mesh with the helical splines 122*b* formed in the input portion 122. The first output helical splines 128*c* mesh with the helical splines 124*b* formed in the first rocking cam 124. The second output helical splines 128*e* mesh with the helical splines 126*b* formed within the second rocking cam 126.

As shown in FIG. 4, each intermediate drive mechanism 120 constructed as described above is sandwiched, at the sides of the bearings 124*c*, 126*c* of the rocking cams 124, 126, between vertical wall portions 136, 138 formed on the cylinder head 8, so that each intermediate drive mechanism 120 is allowed to rock about the axis but is inhibited from moving in the axial direction. Each of the vertical wall portions 136, 138 has a hole that is aligned with the central hole of the corresponding one of the bearings 124*c*, 126*c*. The support pipe 130 is inserted through the holes of the wall portions 136, 138 and is fixed to these portions. Thus, the support pipe 130 is fixed to the cylinder head 8, and is therefore inhibited from moving in the axial direction or rotating about the axis.

The control shaft 132 disposed in the support pipe 130 extends through the support pipe 130 slidably in the axial direction, and is connected at its one end to the lift-varying actuator 100. The displacement of the control shaft 132 in the axial direction can be adjusted by the lift-varying actuator 100.

Figure 22:
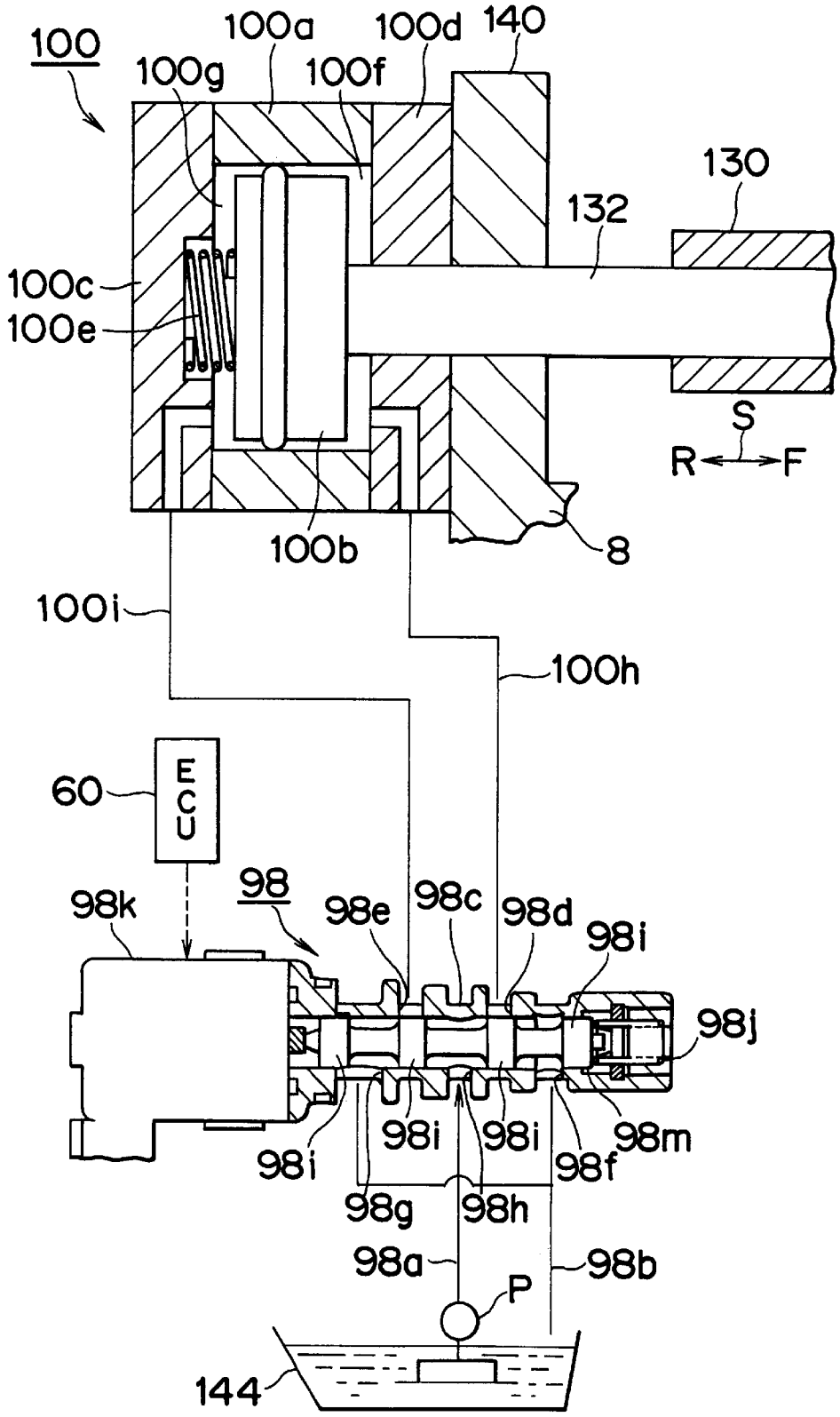
FIG. 22 is a vertical cross-sectional view showing a lift-varying actuator included in the first embodiment of the invention.

The construction of the lift-varying actuator 100 is illustrated in FIG. 22. FIGS. 22 shows a vertical cross section of the lift-varying actuator 100, and also shows the first oil control valve 98.

The lift-varying actuator 100 principally consists of a cylinder tube 100*a*, a piston 100*b* disposed in the cylinder tube 100*a*, a pair of end covers 100*c*, 100*d* for closing the opposite openings of the cylinder tube 100*a*, and a coil spring 100*e* disposed in a compressed state between the piston 100*b* and the outer end cover 100*c* that is located remote from the cylinder head 8. The lift-varying actuator 100 is fixed at the inner end cover 100*d* to a vertical wall portion 140 as part of the cylinder head 8.

The control shaft 132, which extends through the inner end cover 100*d* and the vertical wall portion 140 of the cylinder head 8, is connected at one end thereof to the piston 100*b*. Therefore, the control shaft 132 is moved in accordance with movements of the piston 100*b*.

An internal space of the cylinder tube 100*a* is divided by the piston 100*b* into a first pressure chamber 100*f* and a second pressure chamber 100*g*. A first oil passage 100*h* that is formed in the inner end cover 100*d* is connected to the first pressure chamber 100*f*. A second oil passage 100*i* that is formed in the outer end cover 100*c* is connected to the second pressure chamber 100*g*.

When hydraulic oil is supplied selectively to the first pressure chamber 100*f* and the second pressure chamber 100*g* through the first oil passage 100*h* or the second oil passage 100*i*, the piston 100*b* is moved in the axially opposite directions (as indicated by arrow S in FIG. 22) of the control shaft 132. With the piston 100*b* thus moved, the control shaft 132 is also moved in the axial direction.

The first oil passage 100*h* and the second oil passage 100*i* are connected to the first oil control valve 98. A supply passage 98*a* and a discharge passage 98*b* are connected to the first oil control valve 98. The supply passage 98*a* is connected to an oil pan 144 via an oil pump P that is driven in accordance with rotation of a crankshaft 142 (FIG. 4). The discharge passage 98*b* is directly connected to the oil pan 144.

The first oil control valve 98 includes a casing 98*c*, which has a first supply/discharge port 98*d*, a second supply/discharge port 98*e*, a first discharge port 98*f*, a second discharge port 98*g*, and a supply port 98*h*. The first oil passage 100*h* is connected to the first supply/discharge port 98*d*. The second oil passage 100*i* is connected to the second supply/discharge port 98*e*. Furthermore, the supply passage 98*a* is connected to the supply port 98*h*. The discharge passage 98*b* is connected to the first discharge port 98*f* and the second discharge port 98*g*. The casing 98*c* receives a spool 98*m* that has four valve portions 98*i*. The spool 98*m* is urged by a coil spring 98*j* in one of the axially opposite directions, and is moved in the other direction by means of an electromagnetic solenoid 98*k*.

When the electromagnetic solenoid 98*k* is in a non-energized state in the first oil control valve 98 constructed as described above, the spool 98*m* is biased toward the electromagnetic solenoid 98*k* in the casing 98*c* under the bias force of the coil spring 98*j*. In this state, the first supply/discharge port 98*d* communicates with the first discharge port 98*f*, and the second supply/discharge port 98*e* communicates with the supply port 98*h*. When the first oil control valve 98 is in this state, hydraulic oil is supplied from the oil pan 144 into the second pressure chamber 100*g* through the supply passage 98*a*, the first oil control valve 98 and the second oil passage 100*i*. At the same time, hydraulic oil is returned from the first pressure chamber 100*f* into the oil pan 144 through the first oil passage 100*h*, the first oil control valve 98 and the discharge passage 98*b*. As a result, the piston 100*b* is moved toward the cylinder head 8. With the piston 100*b* thus moved, the control shaft 132 is moved in the direction F as one of the directions indicated by the arrows S.

For example, an operating state of each intermediate drive mechanism 120 when the piston 100*b* is moved closest to the cylinder head 8 is illustrated in FIG. 21. In this state, the phase difference between the roller 122*f* of the input portion 122 and the noses 124*d*, 126*d* of the rocking cams 124, 126 is maximized. It is to be noted that this state is also established by the urging or bias force of the coil spring 100*e* when the engine 2 is not operated and thus no hydraulic pressure is generated by the oil pump P.

When the electromagnetic solenoid 98*k* is energized, the spool 98*m* is moved toward the coil spring 98*j* in the casing 98*c* against the bias force of the coil spring 98*j*, so that the second supply/discharge port 98*e* communicates with the second discharge port 98*g* and the first supply/discharge port 98*d* communicates with the supply port 98*h*. In this state, hydraulic oil is supplied from the oil pan 144 to the first pressure chamber 100*f* through the supply passage 98*a*, the first oil control valve 98 and the first oil passage 100*h*. At the same time, hydraulic oil is returned from the second pressure chamber 100*g* into the oil pan 144 through the second oil passage 100*i*, the first oil control valve 98 and the discharge passage 98*b*. As a result, the piston 100*b* is moved away from the cylinder head 8. In accordance with the movement of the piston 100*b*, the control shaft 132 is moved in the direction R as one of the directions indicated by the arrows S.

Figure 23:
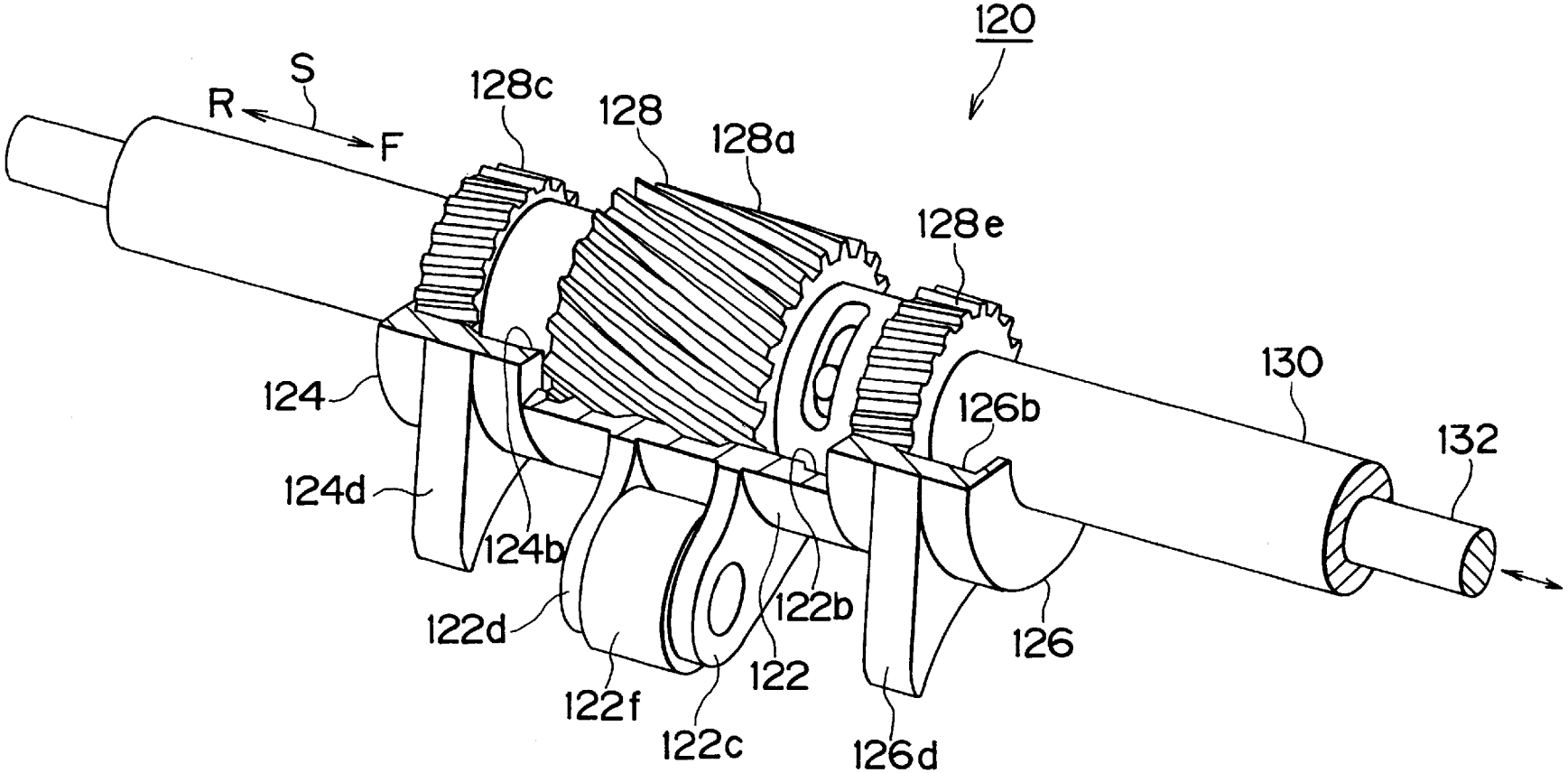
FIG. 23 is a view showing a driving state of the intermediate drive mechanism of the first embodiment.

For example, an operating state of each intermediate drive mechanism 120 when the piston 100*b* is moved farthest from the cylinder head 8 is illustrated in FIG. 23. In this state, the phase difference between the roller 122*f* of the input portion 122 and the noses 124*d*, 126*d* of the rocking cams 124, 126 is minimized.

When the spool 98*m* is positioned at an intermediate position in the casing 98*c* by controlling electric current applied to the electromagnetic solenoid 98*k*, the first supply/discharge port 98*d* and the second supply/discharge port 98*e* are closed, and hydraulic oil is inhibited from moving through the supply/discharge ports 98*d*, 98*e*. In this state, no hydraulic oil is supplied to or discharged from either the first pressure chamber 100*f* or the second pressure chamber 100*g*, and hydraulic oil is held within the first pressure chamber 100*f* and the second pressure chamber 100*g*. Therefore, the piston 100*b* and the control shaft 132 are fixed in position in the axial direction thereof. This state in which the piston 100*b* and the control shaft 132 are fixed in position is illustrated in FIG. 22. By fixing the piston 100*b* and the control shaft 132 to an intermediate state between the states indicated in FIG. 21 and FIG. 23, for example, the phase difference between the roller 122*f* of the input portion 122 and the noses 124*d*, 126*d* of the rocking cams 124, 126 can be fixed to an intermediate state.

Furthermore, by controlling the duty cycle with which the electromagnetic solenoid 98*k* is energized, the degree of opening of the first supply/discharge port 98*d* and the degree of opening of the second supply/discharge port 98*e* may be adjusted so as to control the rate of supply of hydraulic oil from the supply port 98*h* to the first pressure chamber 100*f* or to the second pressure chamber 100*g*.

As shown in FIG. 2, the roller 122*f* provided in the input portion 122 of each intermediate drive mechanism 120 is held in contact with the corresponding intake cam 45*a*. Therefore, the input portion 122 of each intermediate drive mechanism 120 rocks about the axis of the support pipe 130 in accordance with the profile of the cam face of the intake cam 45*a*. Compressed springs 122*g* are provided between the cylinder head 8 and the arms 122*c*, 122*d* supporting the roller 122*f* such that the roller 122*f* is urged by the compressed springs 122*g* toward the corresponding intake cam 45*a*. Therefore, each roller 122*f* is always held in contact with the corresponding intake cam 45*a*.

A base circular portion of each of the rocking cams 124, 126 (i.e., a portion that excludes the nose 124*d* or 126*d*) is in contact with a roller 13*a* that is provided at a center of a corresponding one of two rocker arms 13. Each rocker arm 13 is rockably supported by an adjuster 13*b* at a proximal end portion 13*c* thereof located close to the center of the cylinder head 8, while a distal end portion 13*d* of the rocker arm 13 located outwardly of the cylinder head 8 is in contact with a stem end 12*c* of a corresponding intake valve 12*a* or 12*b*.

As described above, the phase difference between the roller 122*f* of the input portion 122 and the noses 124*d*, 126*d* of the rocking cams 124, 126 can be adjusted via the control shaft 132 and slider gear 128, by adjusting the position of the piston 100*b* of the lift-varying actuator 100. With the position of the piston 100*b* of the lift-varying actuator 100 thus adjusted, the amount of lift of the intake valves 12*a*, 12*b* can be continuously varied in the manner as described below and as shown in FIGS. 24A to 27B.

Figure 24B:
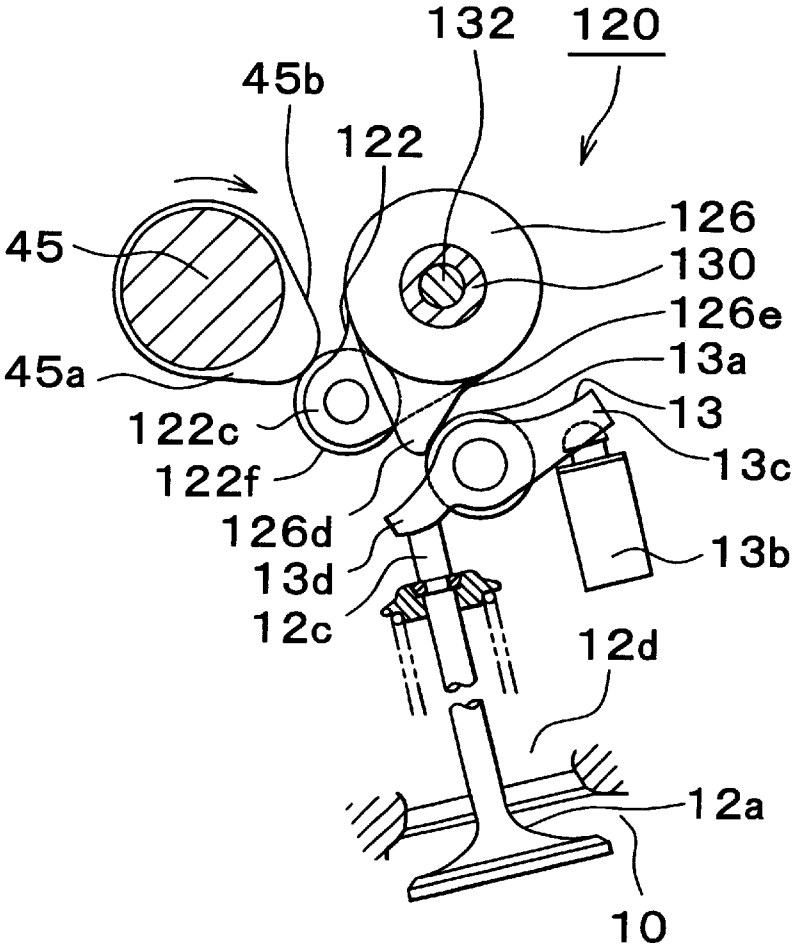
FIGS. 24A and 24B are views for explaining the operation of the variable valve drive mechanism of the first embodiment that is shown in cross section.
Figure 24A:
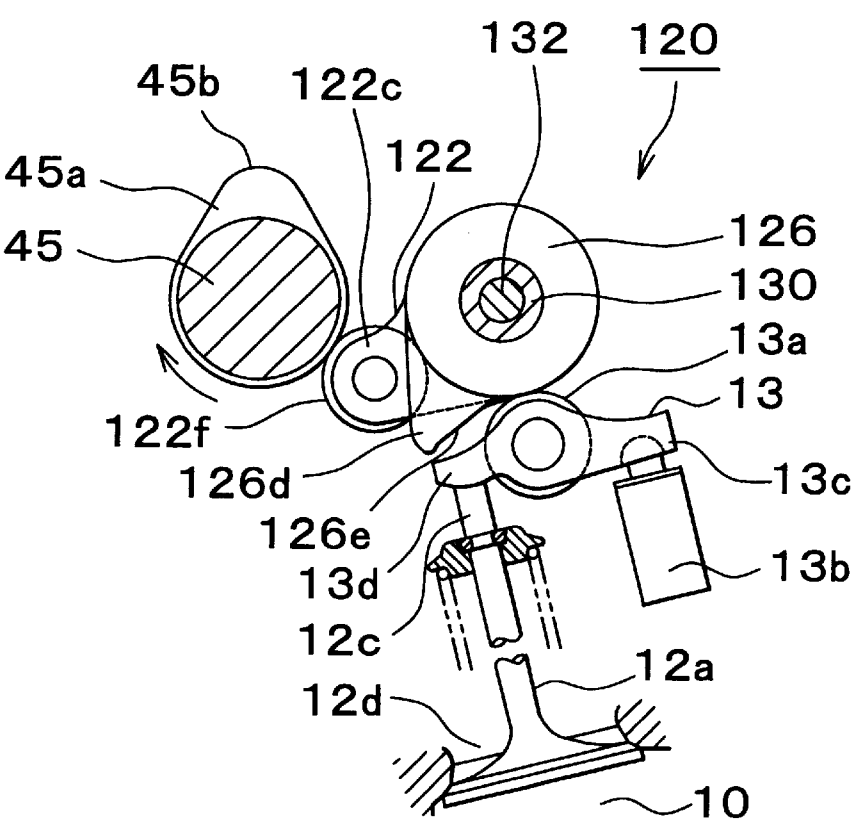

FIGS. 24A and 24B are vertical cross-sectional views corresponding to that of FIG. 21. FIGS. 24A and 24B illustrate operating states of an intermediate drive mechanism 120 after the piston 100*b* of the lift-varying actuator 100 is moved to the most advanced position (closest to the cylinder block 8) in the direction F as viewed in FIG. 22. While FIGS. 24A to 27B illustrate only a mechanism in which the second rocking cam 126 drives the first intake valve 12*a*, a mechanism in which the first rocking cam 124 drives the second intake valve 12*b* is substantially the same as the mechanism shown in the drawings. In the following description, therefore, reference numerals denoting the first rocking cam 124 and the second intake valve 12*b* as well as those denoting the second rocking cam 126 and the first intake valve 12*a* will be provided.

In FIG. 24A, a base circular portion of the intake cam 45*a* (which excludes a nose 45*b*) is in contact with the roller 122*f* of the input portion 122 of the intermediate drive mechanism 120. In this condition, the nose 124*d*, 126*d* of the rocking cam 124, 126 is not in contact with the roller 13*a* of the rocker arm 13, but a base circular portion of the rocking cam 124, 126 adjacent to the nose 124*d*, 126*d* is in contact with the roller 13*a*. As a result, the intake valve 12*a*, 12*b* is in a closed state or position.

When the nose 45*b* of the intake cam 45*a* pushes down the roller 122*f* of the input portion 122 as the intake camshaft 45 turns, the rocking motion is transmitted from the input portion 122 to the rocking cam 124, 126 via the slider gear 128 in the intermediate drive mechanism 120, so that the rocking cam 124, 126 rocks or swivels in such a direction that the nose 124*d*, 126*d* moves downward. As a result, the curved cam face 124*e*, 126*e* formed on the nose 124*d*, 126*d* immediately contacts the roller 13*a* of the rocker arm 13, and pushes down the roller 13*a* of the rocker arm 13 with the entire area of the cam face 124*e*, 126*e* being in contact with the roller 13*a*, as shown in FIG. 24B. As a result, the rocker arm 13 pivots about the proximal end portion 13*c* so that the distal end portion 13*d* of the rocker arm 13 pushes down the stem end 12*c* to a great extent. In this manner, the intake valve 12*a*, 12*b* is lifted the greatest distance away from the valve seat to thus open the intake port 14*a*, 14*b*. Thus, the maximum amount of lift is provided.

Figure 25B:
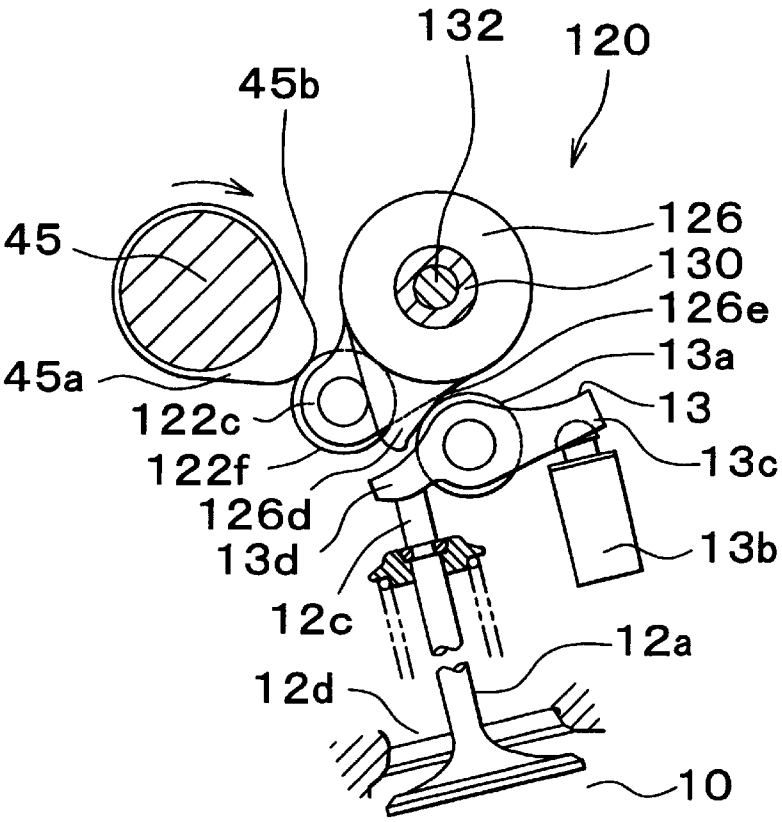
FIGS. 25A and 25B are views for explaining the operation of the variable valve drive mechanism of the first embodiment that is shown in cross section.
Figure 25A:
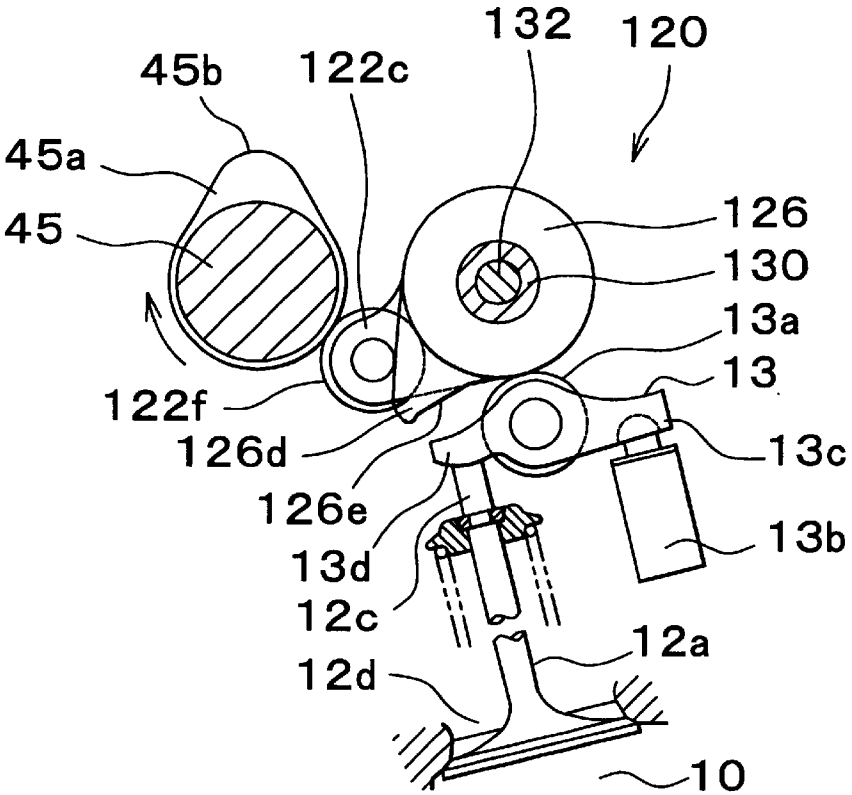

FIGS. 25A and 25B illustrate operating states of the intermediate drive mechanism 120 after the piston 100*b* of the lift-varying actuator 100 is slightly moved in the direction R from the most advanced position as established in FIGS. 24A and 24B. In FIG. 25A, the base circular portion of the intake cam 45*a* is in contact with the roller 122*f* of the input portion 122 of the intermediate drive mechanism 120. In this condition, the nose 124*d*, 126*d* of the rocking cam 124, 126 is not in contact with the roller 13*a* of the rocker arm 13, but a base circular portion of the rocking cam 124, 126 is in contact with the roller 13*a*. Therefore, the intake valve 12*a*, 12*b* is in the closed state or position. The base circular portion of the rocking cam 124, 126 contacting the roller 13*a* in FIG. 25A is slightly remote from the nose 124*d*, 126*d* as compared with the case of FIG. 24A. This is because the slider gear 128 has been slightly moved in the direction R within the intermediate drive mechanism 120, so that the phase difference between the roller 122*f* of the input portion 122 and the nose 124*d*, 126*d* of the rocking cam 124, 126 has been reduced.

When the nose 45*b* of the intake cam 45*a* pushes down the roller 122*f* of the input portion 122 as the intake camshaft 45 turns, the rocking motion is transmitted from the input portion 122 to the rocking cam 124, 126 via the slider gear 128 in the intermediate drive mechanism 120, so that the rocking cam 124, 126 rocks in such a direction that the nose 124*d*, 126*d* moves downward.

In the state of FIG. 25A, the roller 13*a* of the rocker arm 13 is in contact with the base circular portion of the rocking cam 124, 126 that is located slightly remote from the nose 124*d*, 126*d*, as described above. Therefore, after the rocking cam 124, 126 starts rocking, the roller 13*a* of the rocker arm 13 is not immediately brought into contact with the curved cam face 124*e*, 126*e* formed on the nose 124*d*, 126*d*, but remains in contact with the base circular portion for a while. After a while, the curved cam face 124*e*, 126*e* comes into contact with the roller 13*a*, and pushes down the roller 13*a* of the rocker arm 13 as shown in FIG. 25B. As a result, the rocker arm 13 pivots about its proximal end portion 13*c*. Since the roller 13*a* of the rocker arm 13 is initially located slightly remote from the nose 124*d*, 126*d*, the area of the cam face 124*e*, 126*e* that contacts with the roller 13*a* is correspondingly reduced, and the pivot angle of the rocker arm 13 is also reduced. As a result, the amount by which the distal end portion 13*d* of the rocker arm 13 pushes down the stem end 12*c* of the intake valve 12*a*, 12*b* is reduced, which means that the amount of lift of the intake valve 12*a*, 12*b* is reduced. Thus, the intake valve 12*a*, 12*b* opens the intake port 14*a*, 14*b* while providing an amount of lift that is smaller than the above-indicated maximum amount.

Figure 26B:
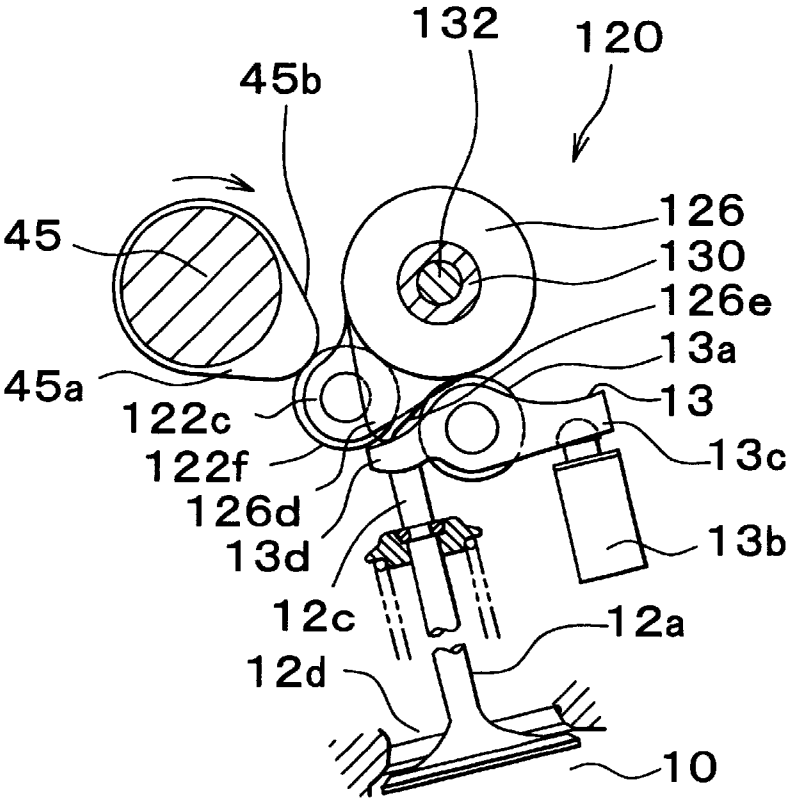
FIGS. 26A and 26B are views for explaining the operation of the variable valve drive mechanism of the first embodiment that is shown in cross section.
Figure 26A:
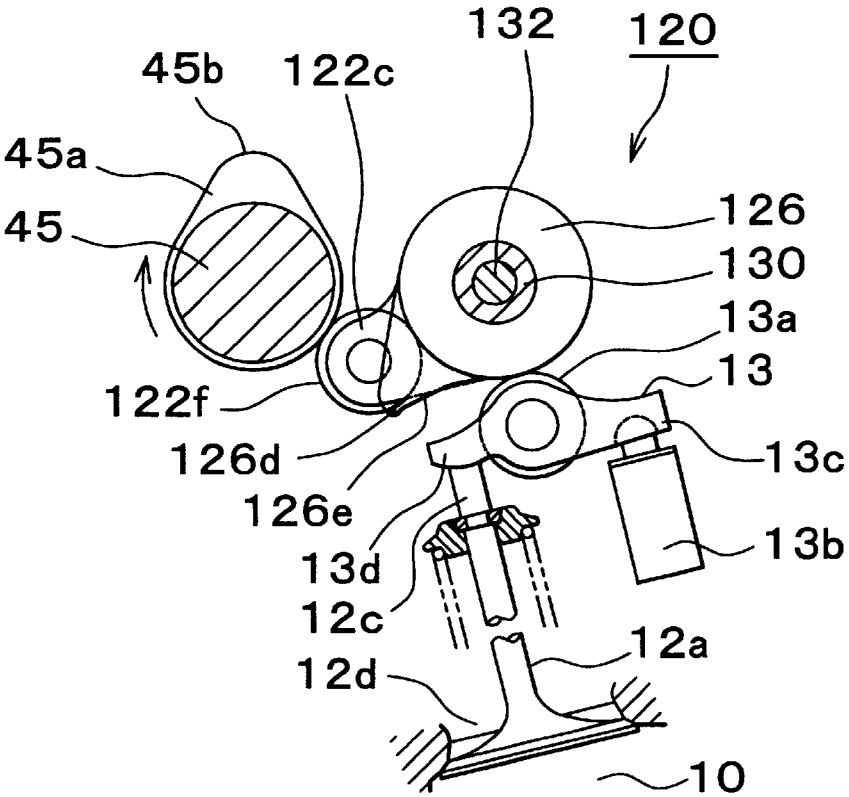

FIGS. 26A and 26B illustrate operating states of the intermediate drive mechanism 120 after the piston 100*b* of the lift-varying actuator 100 is further moved in the direction R from the position established in FIGS. 25A and 25B.

In FIG. 26A, the base circular portion of the intake cam 45*a* is in contact with the roller 122*f* of the input portion 122 of the intermediate drive mechanism 120. At this moment, the nose 124*d*, 126*d* of the rocking cam 124, 126 is not in contact with the roller 13*a* of the rocker arm 13, but a base circular portion of the rocking cam 124, 126 is in contact with the roller 13*a*. Therefore, the intake valve 12*a*, 12*b* is in the closed state. The base circular portion of the rocking cam 124, 126 that is in contact with the roller 13*a* in FIG. 26A is located further remote from the nose 124*d*, 126*d* as compared with the case of FIG. 25A. This is because the slider gear 128 has been moved in the direction R within the intermediate drive mechanism 120 as mentioned above, so that the phase difference between the roller 122*f* of the input portion 122 and the nose 124*d*, 126*d* of the rocking cam 124, 126 has been further reduced.

When the nose 45*b* of the intake cam 45*a* pushes down the roller 122*f* of the input portion 122 as the intake camshaft 45 turns, the rocking motion is transmitted from the input portion 122 to the rocking cam 124, 126 via the slider gear 128 in the intermediate drive mechanism 120, so that the rocking cam 124, 126 rocks in such a direction that the nose 124*d*, 126*d* moves downward.

In the state of FIG. 26A, the roller 13*a* of the rocker arm 13 is in contact with the base circular portion of the rocking cam 124, 126 that is located considerably remote from the nose 124*d*, 126*d*, as described above. Therefore, after the rocking cam 124, 126 starts rocking, the roller 13*a* of the rocker arm 13 is not immediately brought into contact with the curved cam face 124*e*, 126*e* formed on the nose 124*d*, 126*d*, but remains in contact with the base circular portion for a while. After a while, the curved cam face 124*e*, 126*e* comes into contact with the roller 13*a*, and pushes down the roller 13*a* of the rocker arm 13 as shown in FIG. 26B. Thus, the rocker arm 13 pivots about its proximal end portion 13*c*. Since the roller 13*a* of the rocker arm 13 is initially located significantly remote from the nose 124*d*, 126*d*, the area of the cam face 124*e*, 126*e* that contacts with the roller 13*a* is further reduced, and the pivot angle of the rocker arm 13 is also further reduced. Consequently, the amount by which the distal end portion 13*d* of the rocker arm 13 pushes down the stem end 12*c* of the intake valve 12*a*, 12*b* is considerably reduced, which means that the amount of lift of the intake valve 12*a*, 12*b* is considerably reduced. Thus, the intake valve 12*a*, 12*b* slightly opens the intake port 14*a*, 14*b* while providing an amount of lift that is far smaller than the above-indicated maximum amount.

Figure 27B:
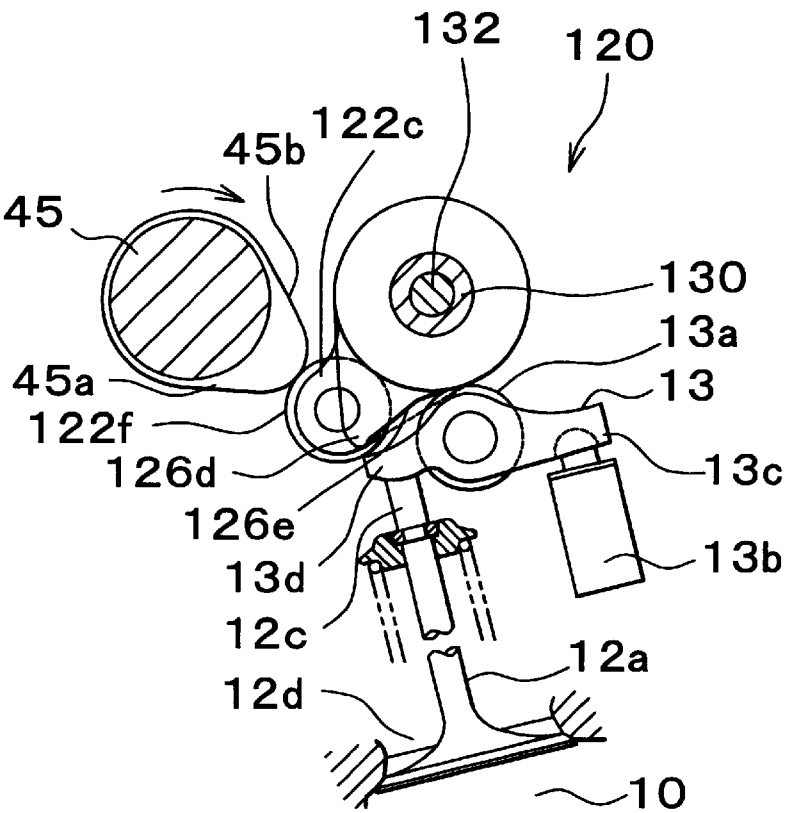
FIGS. 27A and 27B are views for explaining the operation of the variable valve drive mechanism of the first embodiment that is shown in cross section.
Figure 27A:
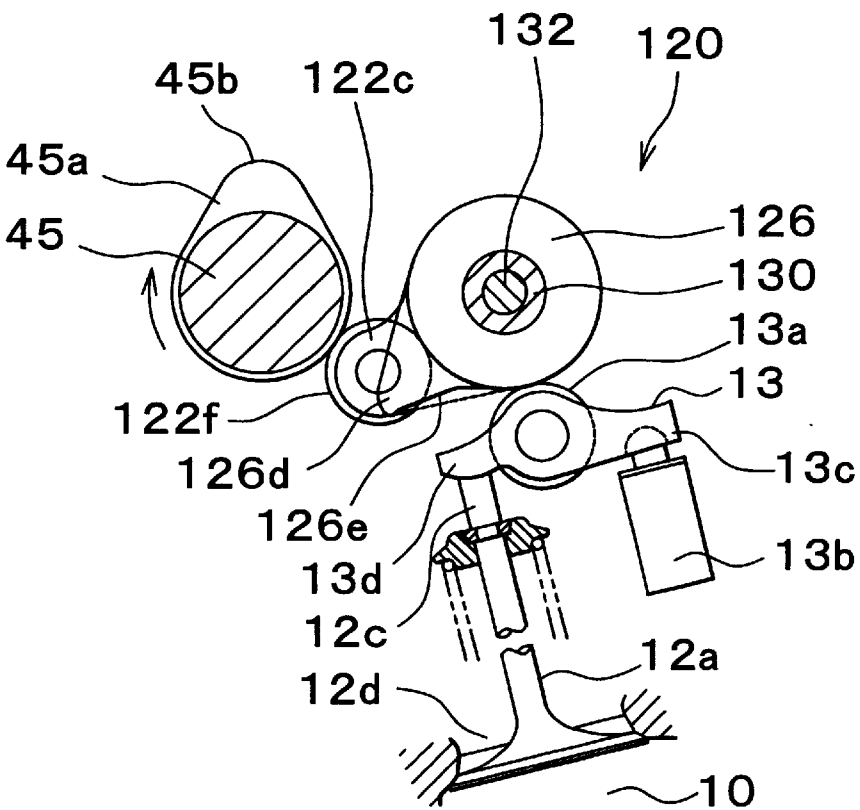

FIGS. 27A and 27B are vertical cross-sectional views corresponding to that of FIG. 23. FIGS. 27A and 27B illustrate operating states of the intermediate drive mechanism 120 after the piston 100*b* of the lift-varying actuator 100 is moved in the direction R to the most retracted position (that is farthest from the cylinder block 8 in FIG. 22).

In FIG. 27A, the base circular portion of the intake cam 45*a* is in contact with the roller 122*f* of the input portion 122 of the intermediate drive mechanism 120. At this moment, the nose 124*d*, 126*d* of the rocking cam 124, 126 is not in contact with the roller 13*a* of the rocker arm 13, but a base circular portion of the rocking cam 124, 126 is in contact with the roller 13*a*. Therefore, the intake valve 12*a*, 12*b* is in the closed state. The base circular portion of the rocking cam 124, 126 that is in contact with the roller 13*a* in FIG. 27A is greatly remote from the nose 124*d*, 126*d*. This is because the slider gear 128 has been moved to the maximum extent in the direction R within the intermediate drive mechanism 120 as mentioned above, so that the phase difference between the roller 122*f* of the input portion 122 and the nose 124*d*, 126*d* of the rocking cam 124, 126 is minimized.

When the nose 45*b* of the intake cam 45*a* pushes down the roller 122*f* of the input portion 122 as the intake camshaft 45 turns, the rocking motion is transmitted from the input portion 122 to the rocking cam 124, 126 via the slider gear 128 in the intermediate drive mechanism 120, so that the rocking cam 124, 126 rocks in such a direction that the nose 124*d*, 126*d* moves downward.

In the state of FIG. 27A, the roller 13*a* of the rocker arm 13 is in contact with the base circular portion of the rocking cam 124, 126 that is greatly remote from the nose 124*d*, 126*d*, as described above. Therefore, during the entire period of the rocking action of the rocking cam 124, 126, the roller 13*a* of the rocker arm 13 remains in contact with the base circular portion of the rocking cam 124, 126 without contacting with the curved cam face 124*e*, 126*e* formed on the nose 124*d*, 126*d*. That is, even when the nose 45*b* of the intake cam 45*a* pushes down the roller 122*f* of the input portion 122 to the maximum extent, the curved cam face 124*e*, 126*e* is not used for pushing down the roller 13*a* of the rocker arm 13.

Therefore, the rocker arm 13 does not pivot about its proximal end portion 13*c*, and the amount by which the distal end portion 13*d* of the rocker arm 13 pushes down the stem end 12*c* of the intake valve 12*a*, 12*b* becomes equal to zero, which means that the amount of lift of the intake valve 12*a*, 12*b* becomes zero. Thus, the intake port 14*a*, 14*b* is kept closed by the intake valve 12*a*, 12*b*.

Figure 28:
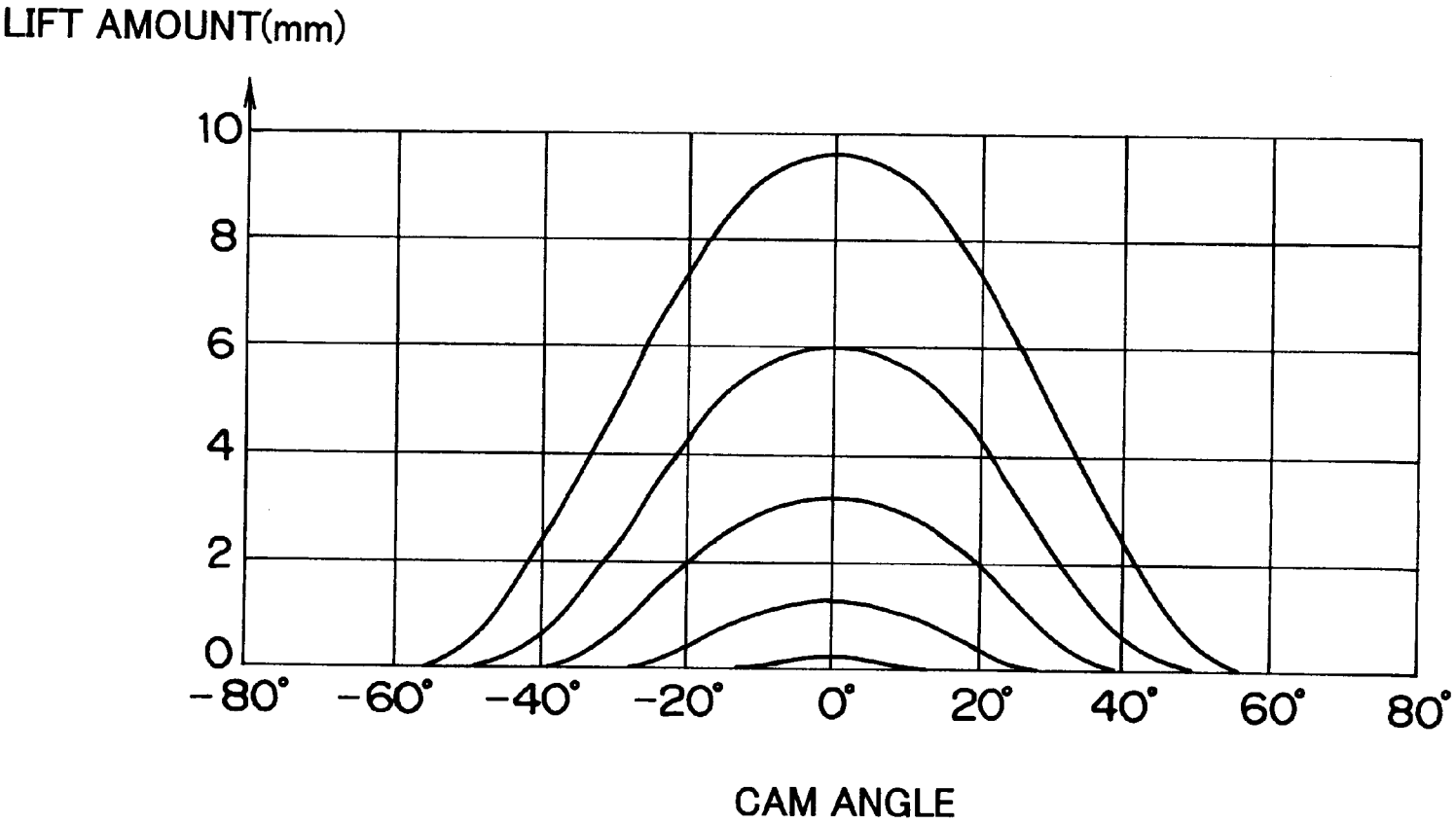
FIG. 28 is a graph indicating changes in the amount of lift of an intake valve adjusted by the variable valve drive mechanism of the first embodiment.

By adjusting the position of the piston 100*b* of the lift-varying actuator 100 as described above, the amount of lift of the intake valves 12*a*, 12*b* can be continuously adjusted so as to vary in accordance with a selected one of lift patterns as indicated in FIG. 28. That is, the lift-varying actuator 100, the control shaft 132, the slider gear 128, the helical splines 122*b* of the input portion 122, and the helical splines 124*b*, 126*b* of the rocking cams 124, 126 constitute an intermediate phase-difference-varying device adapted for varying the phase difference between the roller 122*f* of the input portion 122 and the nose 124*d*, 126*d* of the rocking cam 124, 126.

The rotational-phase-difference-varying actuator 104 will be now described with reference to FIGS. 29 and 30. The phase-difference-varying actuator 104 is disposed such that that toque can be transmitted from the crankshaft 142 to the intake camshaft 45 via the actuator 104. The phase-difference-varying actuator 104 is capable of varying the rotational phase difference between the intake camshaft 45 and the crankshaft 142.

Figure 29:
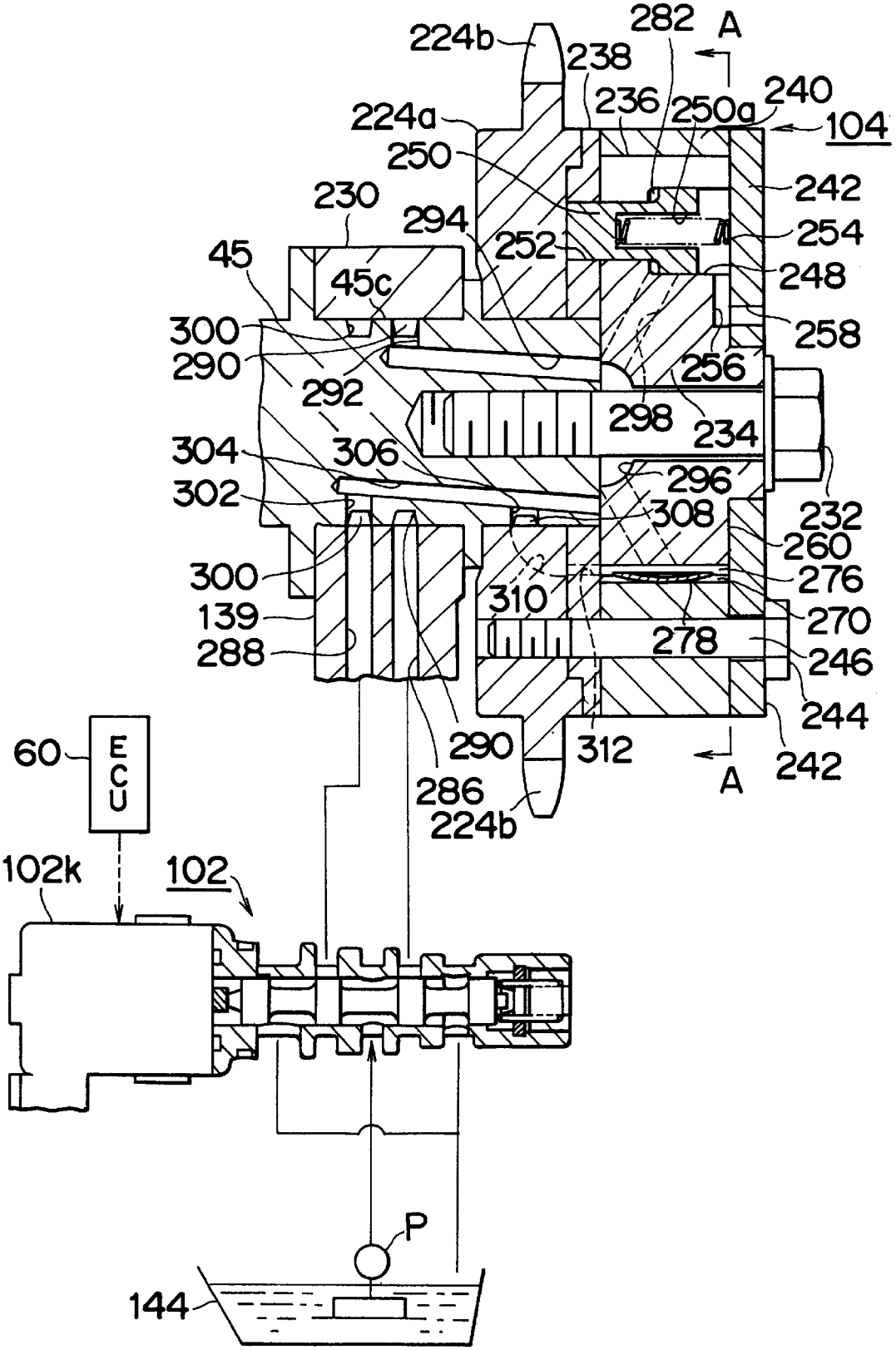
FIG. 29 is a vertical cross-sectional view showing a rotational-phase-difference-varying actuator according to the first embodiment of the invention.
Figure 30:
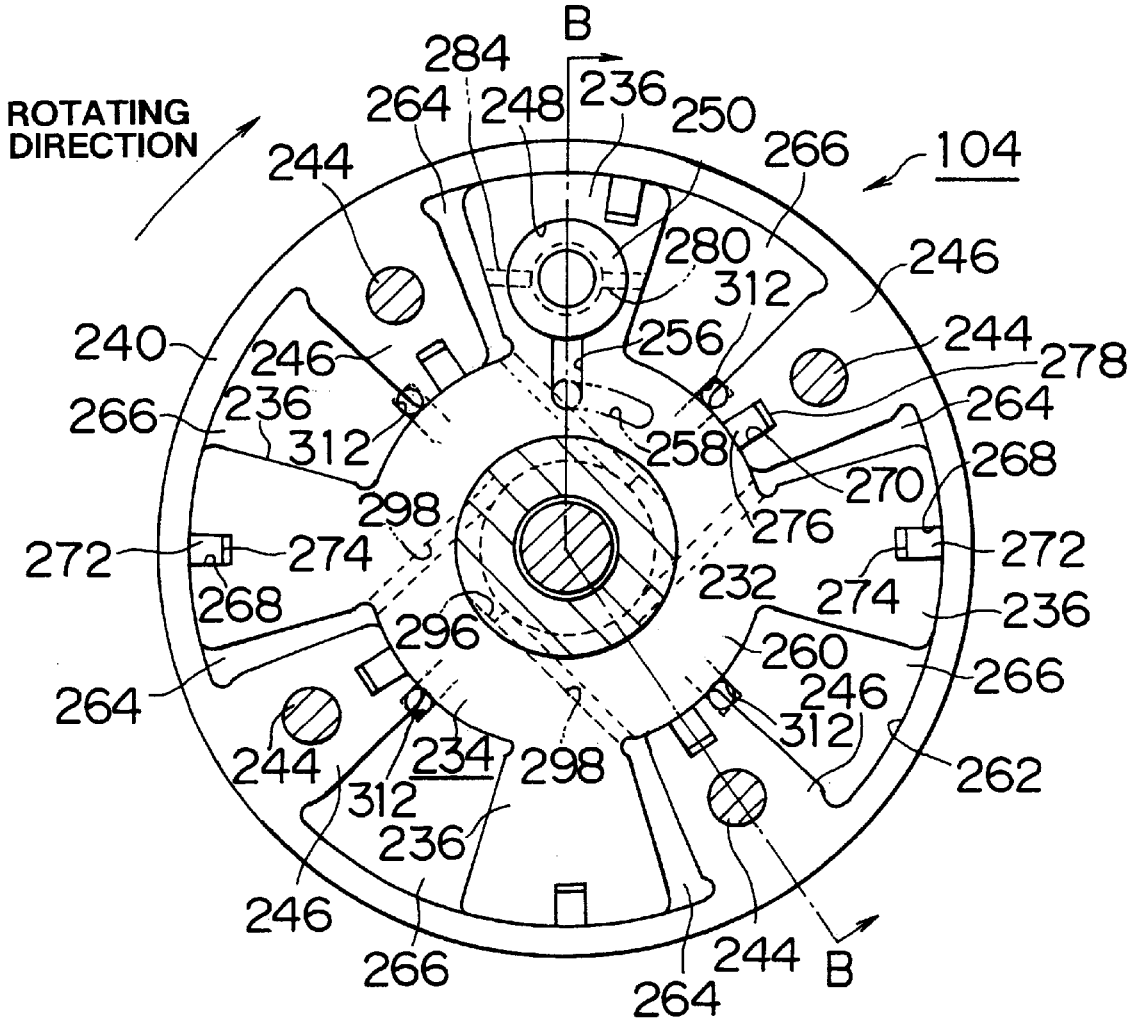
FIG. 30 is a cross-sectional view taken along line A—A of FIG. 29.

FIG. 29 is a vertical cross-sectional view, and FIG. 30 is a cross-sectional view taken along line A—A of FIG. 29. Furthermore, the cross-sectional view of FIG. 29 illustrating an internal rotor 234 and its associated components is taken along line B—B in FIG. 30.

The vertical wall portions 136, 138, 139 of the cylinder head 8 as shown in FIG. 4 serve as journal bearings for the intake camshaft 45. Thus, the vertical wall portion 139 of the cylinder head 8 and a bearing cap 230 rotatably support a journal 45*c* of the intake camshaft 45, as shown in FIG. 29. The internal rotor 234 that is secured to a distal end face of the intake camshaft 45 by a bolt 232 is prevented from rotating relative to the intake camshaft 45 by a knock pin (not shown), so that the internal rotor 234 rotates together with the intake camshaft 45. The internal rotor 234 has a plurality of vanes 236 formed on its outer circumferential surface.

A timing sprocket 224*a* is provided on a distal end portion of the intake camshaft 45 such that the timing sprocket 224*a* is rotatable relative to the intake camshaft 45. The timing sprocket 224*a* has a plurality of outer teeth 224*b* formed on its outer periphery. A side plate 238, a main body 240 and a cover 242, all of which form parts of a housing, are mounted in this order on a distal end face of the timing sprocket 224*a*, and are fixed to the timing sprocket 224*a* by bolts 244 such that the side plate 238, the main body 240 and the cover 242 rotate together with the timing sprocket 224*a*.

The cover 242 is provided for covering distal end faces of the housing body 240 and the internal rotor 234. The main body 240 is arranged to receive the internal rotor 234, and has a plurality of projections 246 formed on its inner circumferential surface.

One of the vanes 236 of the internal rotor 234 has a through-hole 248 that extends in the direction of the axis of the intake camshaft 45. A lock pin 250 that is movably disposed within the through-hole 248 has a receiving hole 250*a* formed therein. A spring 254 is provided in the receiving hole 250*a* for urging the lock pin 250 toward the side plate 238. When the lock pin 250 faces a stopper hole 252 formed in the side plate 238, the lock pin 250 enters and engages with the stopper hole 252 under the bias force of the spring 254 so as to fix or lock the position of the internal rotor 234 relative to the side plate 238 in the circumferential direction. As a result, rotation of the internal rotor 234 relative to the main body 240 of the housing is restricted or inhibited, and therefore the intake camshaft 45 fixed to the internal rotor 234 and the timing sprocket 224*a* fixed to the housing are adapted to rotate together as a unit while maintaining the relative positional relationship therebetween.

The internal rotor 234 has an oil groove 256 formed in a distal end face thereof. The oil groove 256 communicates an elongate hole 258 formed in the cover 242 with the through-hole 248. The oil groove 256 and the elongate hole 258 function to discharge the air or oil present at around the distal end portion of the lock pin 250 in the through-hole 248 to the outside of the actuator 104.

As shown in FIG. 30, the internal rotor 234 has a cylindrical boss 260 located in a central portion of the rotor 234, and vanes 236, for example, four vanes 236 that are formed at equal intervals of 90° to extend radially outwards from the boss 260.

The main body 240 of the housing four projections 246 formed on its inner circumferential surface at substantially equal intervals, like the vanes 236. The vanes 236 are respectively inserted in four recesses 262 formed between the projections 246. An outer circumferential surface of each vane 236 is in contact with an inner circumferential surface of a corresponding one of the recesses 262. Also, a distal end face of each projection 246 is in contact with an outer circumferential surface of the boss 260. With this arrangement, each recess 262 is divided by the corresponding vane 236 so that a first oil pressure chamber 264 and a second oil pressure chamber 266 are formed on the opposite sides of each vane 236 in the rotating direction. Each of these vanes 236 is movable between two adjacent projections 246. Thus, the internal rotor 234 is allowed to rotate relative to the housing 240 within a range or region that is defined by two limit positions at which each vane 236 abuts on the corresponding opposite projections 24.

When the valve timing is to be advanced, hydraulic oil is supplied to each of the first oil pressure chambers 264 that is located on one side of each vane 236 that is behind the vane 236 as viewed in the rotating direction of the timing sprocket 224*a* (as indicated by an arrow in FIG. 30). When the valve timing is to be retarded, on the other hand, hydraulic oils is supplied to each of the second oil pressure chambers 266 that is located on the other side of each vane 236 that is ahead of the vane 236 as viewed in the rotating direction. The above-indicated rotating direction of the timing sprocket 224*a* will be hereinafter referred to as "timing advancing direction", and the direction opposite to this rotating direction will be referred to as "timing retarding direction".

A groove 268 is formed in a distal end portion of each of the vanes 236, and a groove 270 is formed in a distal end portion of each of the projections 246. A seal plate 272 and a sheet spring 274 for urging the seal plate 272 are disposed within the groove 268 of each vane 236. Likewise, a seal plate 276 and a sheet spring 278 for urging the seal plate 276 are disposed within the groove 270 of each projection 246.

The lock pin 250 functions to inhibit relative rotation between the internal rotor 234 and the housing 240, for example, when the engine is started, or when the ECU 60 has not initiated hydraulic pressure control. That is, when the hydraulic pressure in the first oil pressure chambers 264 is zero or has not been sufficiently elevated, a cranking operation for starting the engine causes the lock pin 250 to reach a position at which the lock pin 250 can enter the stopper hole 252, so that the lock pin 250 enters and engages with the stopper hole 252 as shown in FIG. 29. When the lock pin 250 is in engagement with the stopper hole 252, the rotation of the internal rotor 234 relative to the housing 240 is prohibited, and the internal rotor 234 and the housing 240 can rotate together as a unit.

The lock pin 250 engaging with the stopper hole 252 is released when the hydraulic pressure supplied to the actuator 104 is sufficiently raised so that hydraulic pressure is supplied from the second oil pressure chamber 266 to an annular oil space 282 via an oil passage 280. That is, when the hydraulic pressure supplied to the annular oil space 282 is elevated, the lock pin 250 is forced out of the stopper hole 252 against the bias force of the spring 254, and is thus disengaged from the stopper hole 252. Hydraulic pressure is also supplied from the first oil pressure chamber 264 to the stopper hole 252 via another oil passage 284, so as to surely hold the lock pin 250 in the disengaged or released state. With the lock pin 250 thus disengaged from the stopper hole 252, the housing 240 and the internal rotor 234 are allowed to rotate relative to each other, so that the rotational phase of the internal rotor 234 relative to the housing 240 can be adjusted by controlling the hydraulic pressure supplied to the first oil pressure chambers 264 and the second oil pressure chambers 266.

Next, an oil supply/discharge structure for supplying or discharging hydraulic oil to or from each of the first oil pressure chambers 264 and second oil pressure chambers 266 will be now described with reference to FIG. 29.

The vertical wall portion 139 of the cylinder head 8 formed as a journal bearing has a first oil passage 286 and a second oil passage 288 formed therein. The first oil passage 286 is connected to an oil channel 294 formed within the intake camshaft 45, via an oil hole 292 and an oil groove 290 that extends over the entire circumference of the intake camshaft 45. One end of the oil channel 294 remote from the oil hole 292 is open to an annular space 296. Four oil holes 298 that generally radially extend through the boss 260 connect the annular space 296 to the corresponding first oil pressure chambers 264, and permit hydraulic oil in the annular space 296 to be supplied to the first oil pressure chambers 264.

The second oil passage 288 communicates with an oil groove 300 that is formed over the entire circumference of the intake camshaft 45. The oil groove 300 is connected to an annular oil groove 310 formed in the timing sprocket 224*a*, via an oil hole 302, an oil channel 304, an oil hole 306 and an oil groove 308 formed in the intake camshaft 45 The side plate 238 has four oil holes 312, each of which is open at a location adjacent to a side face of a corresponding one of the projections 246 as shown in FIGS. 29 and 30. Each of the oil holes 312 connects the oil groove 310 to a corresponding one of the second oil pressure chambers 266, and allows hydraulic oil to be supplied from the oil groove 310 to the corresponding second oil pressure chamber 266.

The first oil passage 286, the oil groove 290, the oil hole 292, the oil channel 294, the annular space 296 and each of the oil holes 298 form an oil passage for supplying oil into a corresponding one of the first oil pressure chambers 264. The second oil passage 288, the oil groove 300, the oil hole 302, the oil channel 304, the oil hole 306, the oil groove 308, the oil groove 310 and each of the oil holes 312 form an oil passage for supplying hydraulic oil into a corresponding one of the second oil pressure chambers 266. The ECU 60 drives the second oil control valve 102 so as to control hydraulic pressures applied to the first oil pressure chambers 264 and to the second oil pressure chambers 266 via these oil passages.

The vane 236 having the through-hole 248 is formed with the oil passage 284 as shown in FIG. 30. The oil passage 284 communicates the first oil pressure chamber 264 with the stopper hole 252, and allows hydraulic pressure supplied to the first oil pressure chamber 264 to be also supplied to the stopper hole 252, so as to maintain the released state of the lock pin 250 as described above.

In the through-hole 248, the annular oil space 282 is formed between the lock pin 250 and the vane 236. The annular oil space 282 communicates with the second oil pressure chamber 266 via the oil passage 280 as shown in FIG. 30, and allows hydraulic pressure supplied to the second oil pressure chamber 266 to be also supplied to the annular oil space 282, so as to disengage or release the lock pin 250 from the stopper hole 252 as described above.

As shown in FIG. 29, the second oil control valve 102 is substantially the same in basic construction as the first oil control valve 98 as described above.

When an electromagnetic solenoid 102*k* of the second oil control valve 102 is in a non-energized state, hydraulic oil is supplied from the oil pan 144 to the second oil pressure chambers 266 via the second oil passage 288, the oil groove 300, the oil hole 302, the oil channel 304, the oil hole 306, the oil groove 308, the oil groove 310, and the respective oil holes 312. Furthermore, hydraulic oil is returned from the first oil pressure chambers 264 to the oil pan 144 via the respective oil holes 298, the annular space 296, the oil channel 294, the oil hole 292, the oil passage 290, and the first oil passage 286. As a result, the internal rotor 234 and the intake camshaft 45 are rotated or turned relative to the timing sprocket 224*a* in a direction opposite to the rotating direction. That is, the intake camshaft 45 is retarded in timing.

Figure 31:
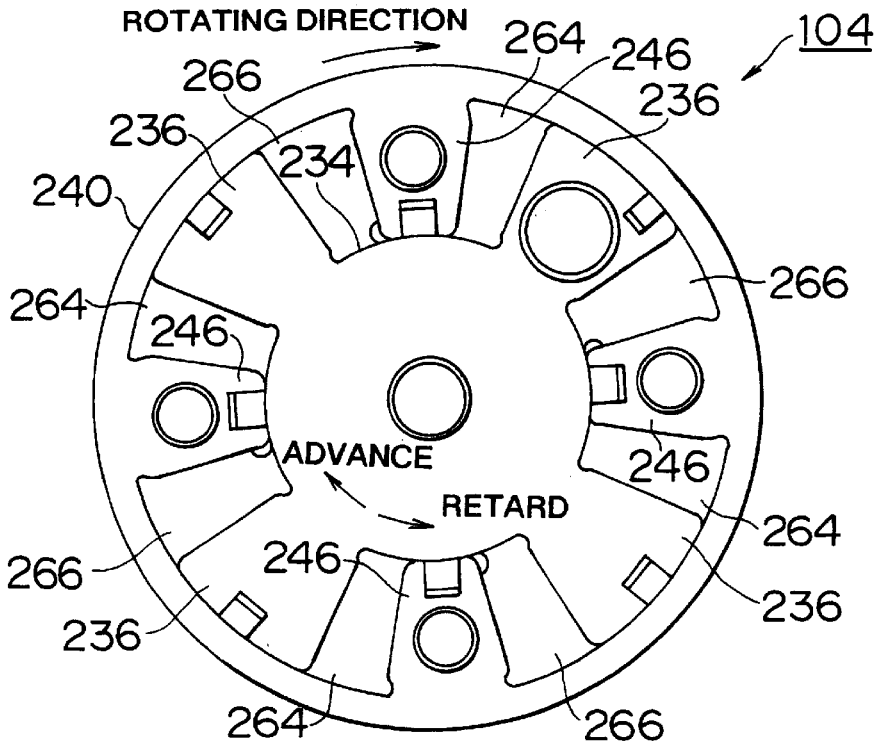
FIG. 31 is a view for explaining the operation of the rotational-phase-difference-varying actuator of the first embodiment.

Conversely, when the electromagnetic solenoid 102*k* is energized, hydraulic oil is supplied from the oil pan 144 to the first oil pressure chambers 264 via the first oil passage 286, the oil passage 290, the oil hole 292, the oil channel 294, the annular space 296, and the respective oil holes 298. Furthermore, hydraulic oil is returned from the second oil pressure chambers 266 to the oil pan 144 via the respective oil holes 312, the oil groove 310, the oil groove 308, the oil hole 306, the oil channel 304, the oil hole 302, the oil groove 300, and the second oil passage 288. As a result, the internal rotor 234 and the intake camshaft 45 are rotated relative to the timing sprocket 224*a* in the same direction as the rotating direction. That is, the intake camshaft 45 is advanced in timing. If the intake camshaft 45 is advanced in timing from the state as shown in FIG. 30, the intake camshaft 45 and the internal rotor 234 are brought into, for example, a state as shown in FIG. 31.

If the electric current applied to the electromagnetic solenoid 102*k* is controlled so as to inhibit movement of hydraulic oil, hydraulic oil is not supplied to nor discharged from the first oil pressure chambers 264 and the second oil pressure chambers 266, and hydraulic oil currently present in the first oil pressure chambers 264 and the second oil pressure chambers 266 is maintained. As a result, the positions of the internal rotor 234 and the intake camshaft 45 relative to the timing sprocket 224*a* are fixed. For example, the operating state as shown in FIG. 30 or 31 is fixed, and the intake camshaft 45 held in this state is rotated by receiving torque from the crankshaft 142.

The manner of controlling the valve timing of the intake valves differs depending upon the type of the engine. For example, the intake camshaft 45 is retarded in timing to thereby retard the opening and closing timing of the intake valves 12*a*, 12*b* during low-speed operations and high-load and high-speed operations of the engine 2. The intake camshaft 45 is advanced in timing to thereby advance the opening and closing timing of the intake valves 12*a*, 12*b* during high-load and middle-speed operations and medium-load operation of the engine 2. This manner of valve timing control is intended to achieve stable engine operations by reducing the valve overlap during the low-speed operations of the engine 2, and to improve the efficiency with which an air/fuel mixture is sucked into the combustion chambers 10 by delaying the closing timing of the intake valves 12*a*, 12*b* during the high-load and high-speed operations of the engine 2. Furthermore, during the high-load and middle-speed operations or medium-load operations of the engine 2, the opening timing of the intake valves 12*a*, 12*b* is advanced so as to increase the valve overlap, thereby reducing the pumping loss and improving the fuel economy.

Figure 32:
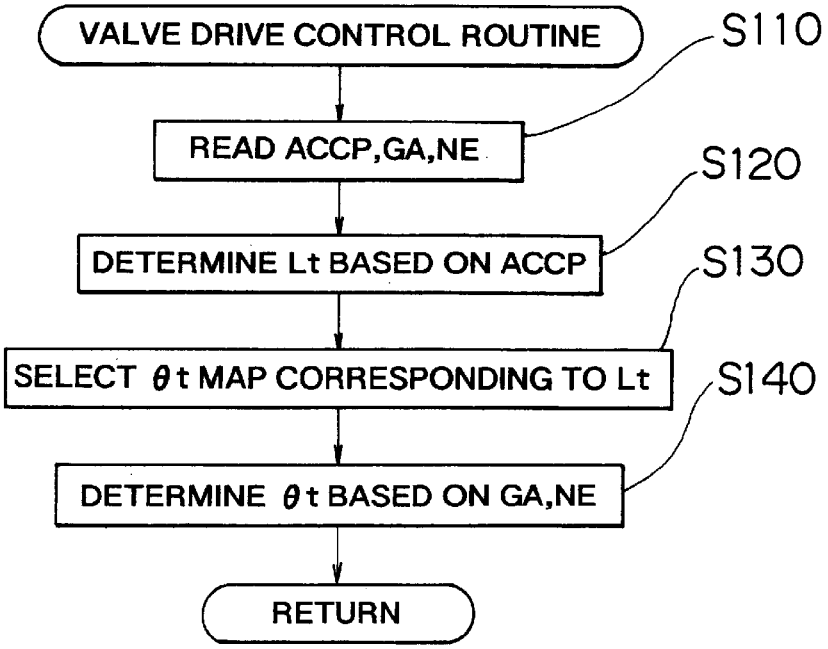
FIG. 32 is a flowchart illustrating a valve drive control routine that is executed by an ECU included in the first embodiment.

Next, valve drive control executed by the ECU 60 for controlling the intake valves 12*a*, 12*b* will be described. FIG. 32 shows a flowchart of a valve drive control routine according to which the valve drive control is performed. This control routine is repeatedly executed at certain time intervals.

Figure 33:
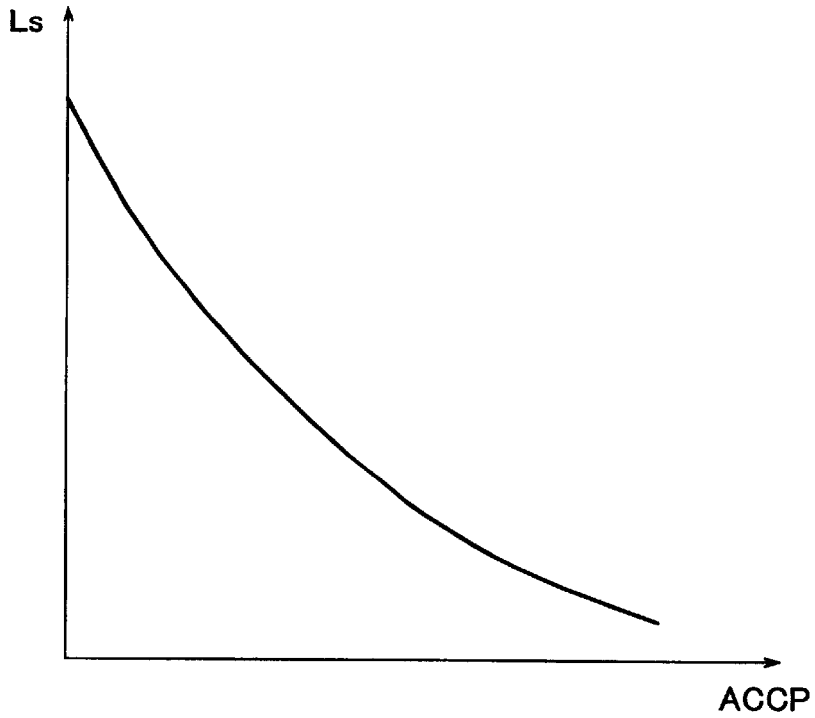
FIG. 33 is a one-dimensional map used for determining a target displacement Lt of the control shaft in the axial direction based on the accelerator operation amount ACCP in the first embodiment.

The valve drive control routine of FIG. 32 is initiated with step S110 to read an accelerator operating amount or position ACCP obtained based on a signal from the accelerator operation amount sensor 76, an amount of intake air GA obtained based on a signal from the intake air amount sensor 84, and an engine speed NE obtained based on a signal from the crank angle sensor 82, and store them into a work area of the RAM 64. The control flow proceeds to step S120 to set a target displacement Lt of the control shaft 132 in the axial direction thereof, based on the accelerator operating amount ACCP read in step S110. In the first embodiment, the target displacement Lt is determined by using a one-dimensional map as indicated in FIG. 33, in which appropriate values are empirically determined and are stored in advance in the ROM 66. That is, the target displacement Lt of the surge tank 32 is set to a smaller value as the accelerator operating amount ACCP increases. As described above, the amount of lift of the intake valves 12*a*, 12*b* decreases with an increase in the displacement of the control shaft 132. Thus, the map of FIG. 33 indicates that as the accelerator operating amount ACCP increases, the amount of lift of the intake valves 12*a*, 12*b* is set to a greater value, resulting in an increase in the amount of intake air GA.

Figure 34:
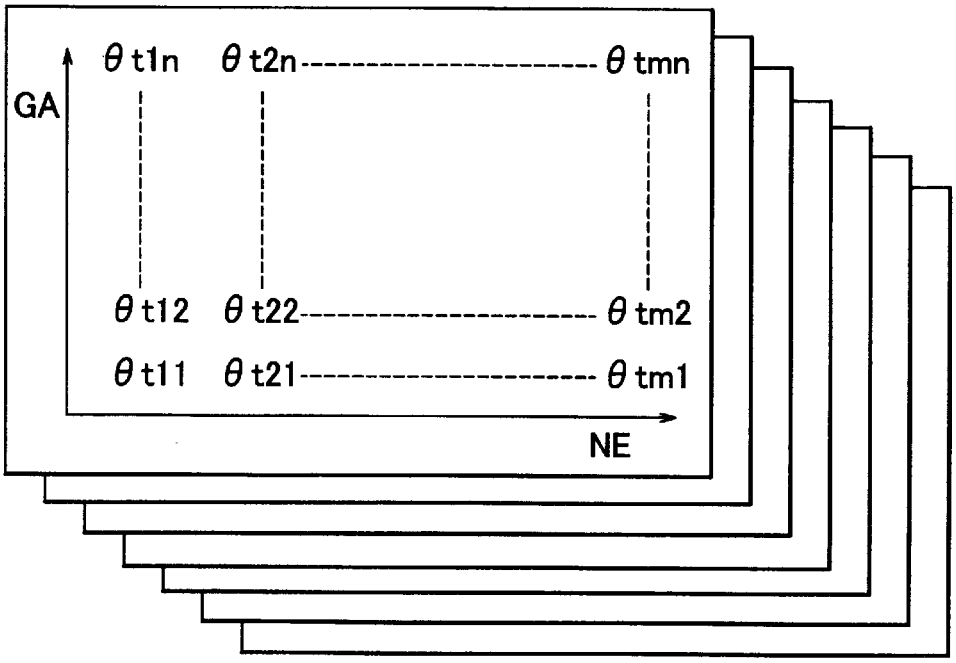
FIG. 34 are two-dimensional maps used for determining a target timing advance value θt based on the engine speed NE and the amount of intake air GA in the first embodiment.

Next, the control flow proceeds to step S130 to select an appropriate map from a plurality of target timing advance value θt maps stored in the ROM 66, in accordance with the target displacement Lt of the control shaft 132, as shown in FIG. 34. The target timing advance value θt maps may be prepared in advance by empirically determining appropriate target timing advance values θt in relation to the amount of intake air GA and the engine speed NE for each range or region of the target displacement Lt. The resulting maps are stored in the ROM 66.

Figure 35:
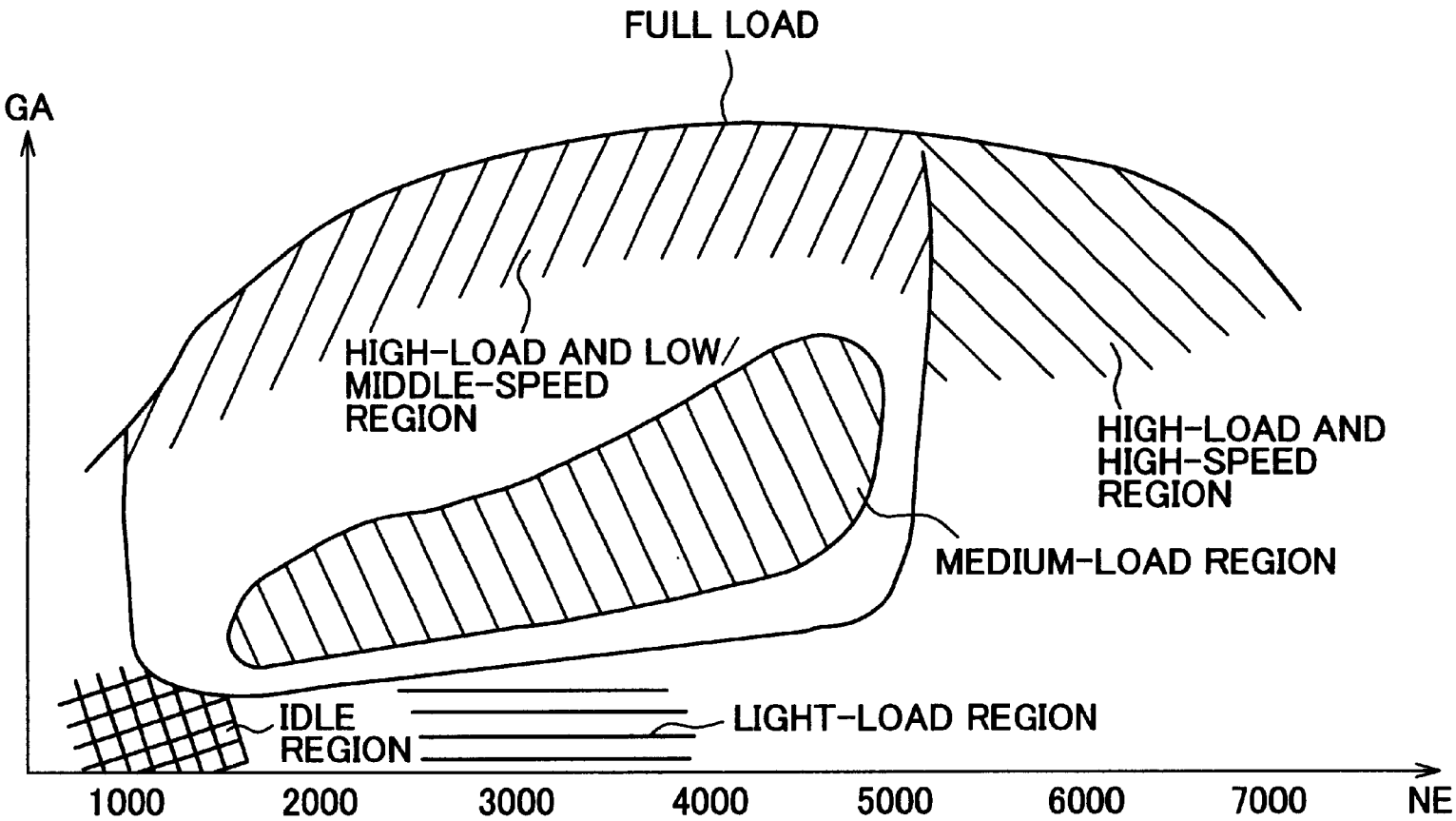
FIG. 35 is a graph indicating various operating regions of the engine for use in the two-dimensional maps shown in FIG. 34.

These maps for one type of engine are different from those for another type of engine. In general, however, the valve overlap may be adjusted differently in respective operating regions of the engine as shown in FIG. 35 by way of example. Namely, (1) when the engine operates in an idling region (i.e., during idling of the engine), the valve overlap is eliminated to thereby prevent exhaust gases from returning to combustion chambers, so that the engine operation is stabilized due to stable or reliable combustion achieved in the combustion chambers. (2) When the engine operates in a light-load region, the valve overlap is minimized to thereby prevent exhaust gases from returning to the combustion chambers, so that the engine operation is stabilized with stable combustion. (3) When the engine operates in a middle-load region, the valve overlap is slightly increased so as to increase the internal EGR rate and reduce the pumping loss. (4) When the engine operates in a high-load and middle-speed region, the valve overlap is maximized so as to improve the volumetric efficiency and increase the torque. (5) When the engine operates in a high-load and high-speed region, the valve overlap is controlled to be medium to large so as to improve volumetric efficiency.

After an appropriate target timing advance value θt map corresponding to the target displacement Lt set in step S120 is selected, the control flow proceeds to step S140 to set a target timing advance value θt of the rotational-phase-difference-varying actuator 104 based on the amount of intake air GA and the engine speed NE, and based on the selected two-dimensional map. Thus, the valve drive control routine is once finished with execution of step S140. Thereafter, the steps S110 to S140 are repeatedly executed in subsequent control cycles, so that the appropriate target displacement Lt and target timing advance value θt are repeatedly updated and established.

Figure 36:
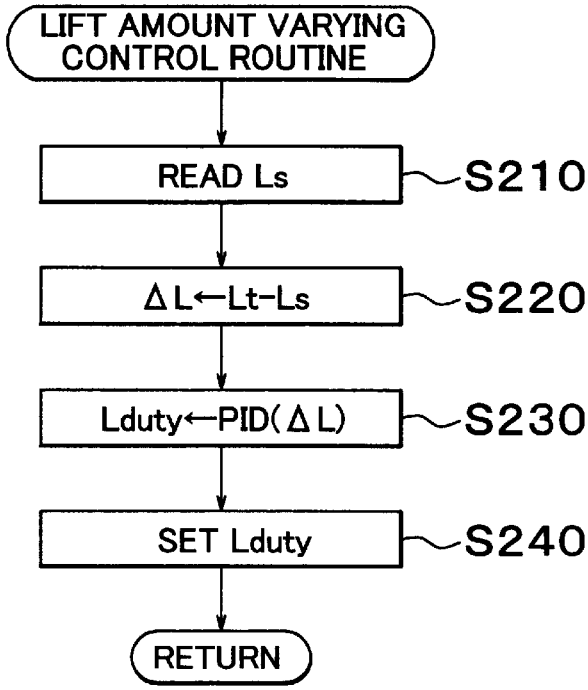
FIG. 36 is a flowchart illustrating a lift amount varying control routine that is executed by the ECU in the first embodiment.

Using the target displacement Lt determined in the above control, the ECU 60 executes a valve lift varying control routine as illustrated in FIG. 36. This control routine is repeatedly executed at certain time intervals.

The routine of FIG. 36 is initiated with step S210 to read an actual displacement Ls of the control shaft 132 as represented by a signal from the shaft position sensor 90, and store it in a work area of the RAM 64.

Next, the control flow proceeds to step S220 to calculate a deviation ΔL of the actual displacement Ls from the target displacement Lt according to an expression (1) as follows:

$$\Delta L \leftarrow Lt - Ls \quad (1)$$

The control flow then proceeds to step S230 to perform PID control calculation based on the deviation ΔL determined as described above, to calculate a duty Lduty of a signal applied to the electromagnetic solenoid 98*k* of the first oil control valve 98 so that the actual displacement Ls approaches the target displacement Lt. The control flow proceeds to step S240 to output the duty Lduty to the drive circuit 96, so that a signal having the duty Lduty is applied to the electromagnetic solenoid 98*k* of the first oil control valve 98. The control routine is once finished with execution of step S240. Then, the above-described steps S210 to S240 are again repeatedly executed in subsequent cycles. In this manner, hydraulic oil is supplied to the lift-varying actuator 100 via the first oil control valve 98 so that the target displacement Lt is achieved.

Figure 37:
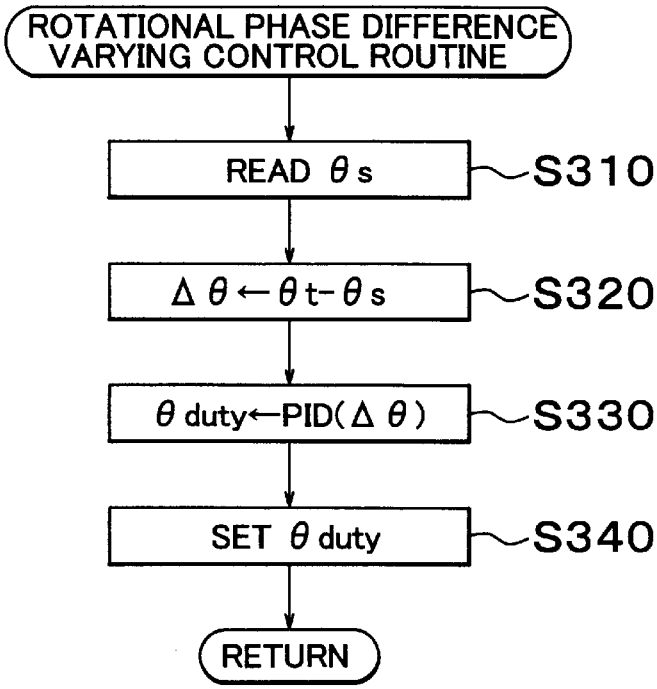
FIG. 37 is a flowchart illustrating a rotational phase difference varying control routine that is executed by the ECU in the first embodiment.

Furthermore, using the target timing advance value θt, the ECU 60 controls a rotational phase difference between the crankshaft 142 and the intake camshaft 45, in accordance with a control routine as illustrated in the flowchart of FIG. 37. This control routine is repeatedly executed at certain time intervals.

The control routine is initiated with step S310 to read an actual timing advance value θs of the intake camshaft 45 that is determined from the relationship between a signal from the cam angle sensor 92 and a signal from the crank angle sensor 82, and store it in a work area of the RAM 64.

Next, step S320 is executed to calculate a deviation Δθ between the target timing advance value θt and the actual timing advance value θs according to an expression (2) as follows:

$$\Delta\theta \leftarrow \theta t - \theta s \quad (2)$$

Then, the control flow proceeds to step S330 to perform PID control calculation based on the deviation Δθ obtained in step S320, to thus calculate a duty θduty of a signal applied to the electromagnetic solenoid 102*k* of the second oil control valve 102 such that the actual timing advance value θs approaches the target timing advance value θt. Step S340 is then executed to output the duty θduty to the drive circuit 96, so that a signal having the duty θduty is applied to the electromagnetic solenoid 102*k* of the second oil control valve 102. The control routine is once finished with execution of step S340. Then, the above-indicated steps S310 to S340 are again repeatedly executed in subsequent cycles. In this manner, hydraulic oil is supplied to the phase-difference-varying actuator 104 via the second oil control valve 102 so as to achieve the target timing advance value θt.

The first embodiment of the invention as described above yields advantages or effects as follows.

(1) Each intermediate drive mechanism 120 has the input portion 122 and the rocking cams 124, 126 as output portions. When the input portion 122 is driven by the intake cam 45*a*, the rocking cams 124, 126 drive the intake valves 12*a*, 12*b* via the rocker arms 13.

The intermediate drive mechanism 120 is rockably supported by the support pipe 130, which is a different shaft from the intake camshaft 45 provided with the intake cams 45*a*. Therefore, with the intake cam 45*a* contacting with and driving the input portion 122, the amount of lift and the operating angle of the intake valves 12*a*, 12*b* can be made in accordance with the operating state of the intake cam 45*a*, via the rocking cams 124, 126 and the rocker arms 13, without requiring a long and complicated link mechanism for connecting the intake cam 45*a* to the intermediate drive mechanism 120.

The relative phase difference between the input portion 122 and the rocking cams 124, 126 of each intermediate drive mechanism 120 can be varied by the lift-varying actuator 100, the control shaft 132, the slider gear 128, the helical splines 122*b* of the input portion 122, and the helical splines 124*b*, 126*b* of the rocking cams 124, 126. More specifically, the relative phase difference between the noses 124*d*, 126*d* formed on the rocking cams 124, 126 and the roller 122*f* of the input portion 122 is made variable. Therefore, the start of lifting of the intake valves 12*a*, 12*b* that occurs in accordance with the operating state of the intake cam 45*a* can be advanced or retarded in timing. Hence, the amount of lift and the operating angle of the intake valves 12*a*, 12*b* that accords with the operation or driving of the intake cam 45*a* can be suitably adjusted.

Thus, the amount of lift and the operating angle of the valves can be varied by a relatively simple arrangement adapted to change the relative phase difference of the rocking cams 124, 126 with respect to the input portion 122, without employing a long and complicated link mechanism. It is thus possible to provide a variable valve drive mechanism that operates with improved reliability.

(2) The rocking cams 124, 126 of each intermediate drive mechanism 120 drive the valves via the rollers 13*a* of the rocker arms 13. With this arrangement, the friction resistance that arises when the intake cam 45*a* drives the intake valves 12*a*, 12*b* via the intermediate drive mechanism 120 is reduced, and therefore the fuel economy can be improved.

(3) The input portion 122 of each intermediate drive mechanism 120 is provided with a roller 122*f* disposed between the distal end portions of the arms 122*c*, 122*d*. Since the roller 122*f* contacts with the intake cam 45*a*, the friction resistance that arises when the intake cam 45*a* drives the intake valves 12*a*, 12*b* via the intermediate drive mechanism 120 is further reduced, and the fuel economy can be further improved.

(4) The intermediate drive mechanism 120 is provided with the slider gear 128, which is moved in the axial direction by the lift-varying actuator 100. With this arrangement, the input portion 122 is rocked by a spline mechanism formed by the input helical splines 128*a* of the slider gear 128 and the helical splines 122*b* of the input portion 122. Furthermore, the rocking cams 124, 126 are rocked by a spline mechanism formed by the output helical splines 128*c*, 128*e* of the slider gear 128 and the helical splines 124*b*, 126*b* of the rocking cams 124, 126. Thus, relative rocking motion between the input portion 122 and the rocking cams 124, 126 is realized.

Since the relative phase difference between the input portion 122 and the rocking cams 124, 126 can be varied or changed by means of the spline mechanisms, the amount of lift and the operating angle of the valves can be varied without requiring a complicated arrangement. Accordingly, the variable valve drive mechanism ensures sufficiently high operating reliability.

(5) Each intermediate drive mechanism 120 has a single input portion 122 and a plurality of rocking cams (two cams 124, 126) in this embodiment). The rocking cams 124, 126 drive the same number of intake valves 12*a*, 12*b* provided for the same cylinder 2*a*. Thus, only one intake cam 45*a* is required for driving a plurality of intake valves 12*a*, 12*b* provided for each cylinder 2*a*, which leads to a simplified structure of the intake camshaft 45.

(6) The lift-varying actuator 100 is able to continuously vary the relative phase difference between the input portion 122 and the rocking cams 124, 126 of the intermediate drive mechanism 120. Since the relative phase difference can be continuously or steplessly changed, the amount of lift and operating angle of the intake valves 12*a*, 12*b* can be set to any desired values that are more precisely suited for the operating state of the engine 2. Thus, the intake air amount can be controlled with improved accuracy.

(7) The intake camshaft 45 is provided with the phase-difference-varying actuator 104 capable of continuously varying the phase difference of the intake camshaft 45 relative to the crankshaft 15. Therefore, it becomes possible to advance and retard the valve timing of the intake valves 12*a*, 12*b* with high accuracy in accordance with the operating state of the engine 2, as well as varying the amount of lift and the operating angle as described above. Accordingly, the engine drive control is performed with further enhanced accuracy.

(8) By executing step S120 in the valve drive control routine of FIG. 32 and executing the control routine of FIG. 36 for varying the lift amount, the amount of lift of the intake valves 12*a*, 12*b* is changed in accordance with the operation of the accelerator pedal 74 by the driver, so as to control the amount of intake air. Thus, the amount of intake air can be adjusted without using a throttle valve, and therefore the engine 2 is simplified in construction and is reduced in weight.

Figure 38:
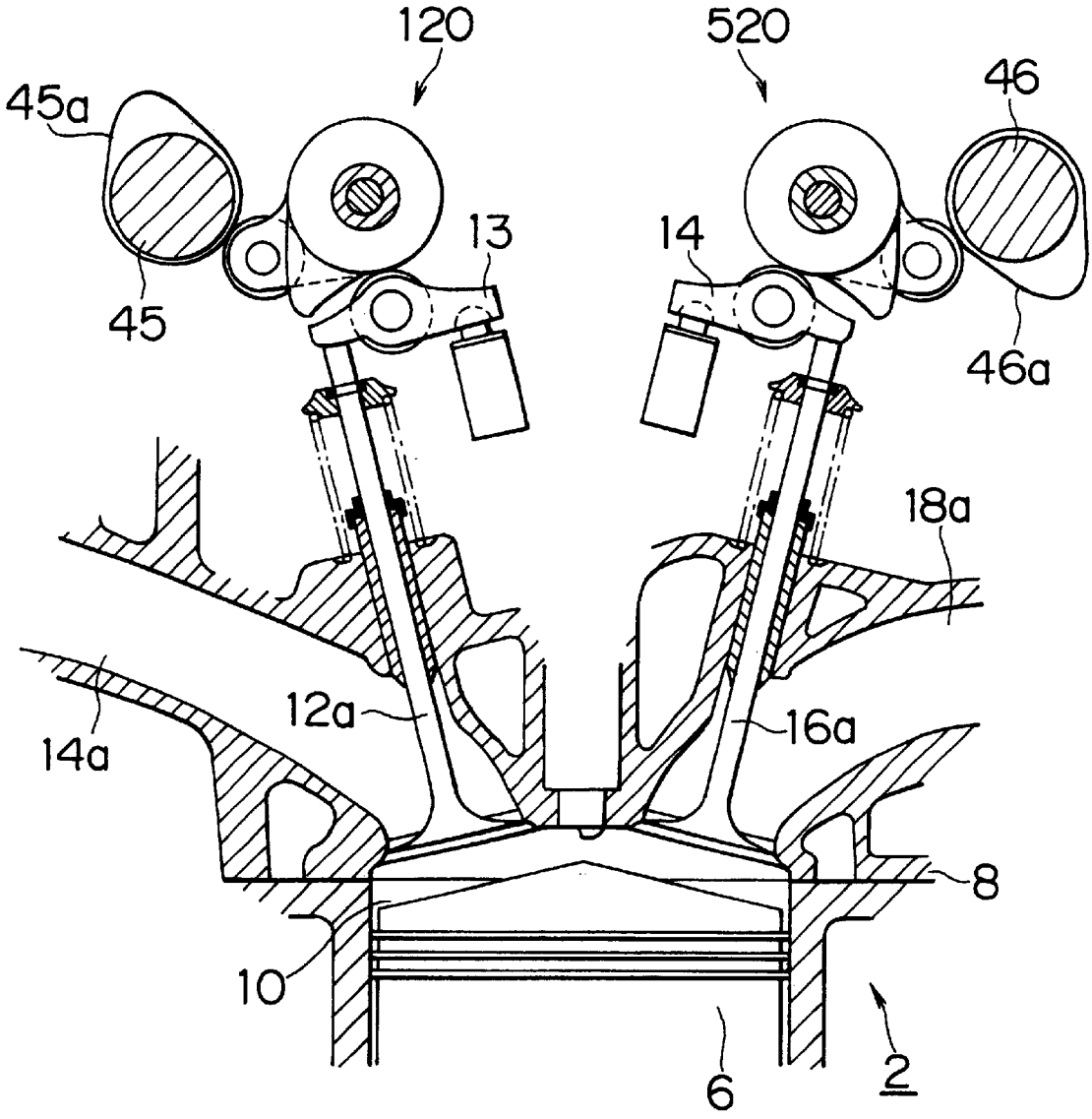
FIG. 38 is a view illustrating a variable valve drive mechanism according to a first modified example of the first embodiment of the invention.

In the first embodiment, the exhaust valves 16*a*, 16*b* are driven by the exhaust cams 46*a* simply via the rocker arms 14 as shown in FIG. 2, so that neither the amount of lift nor the operating angle of the valves 16*a*, 16*b* is adjusted. However, the amount of lift and the operating angle of the exhaust valves 16*a*, 16*b* may also be adjusted so as to perform various control operations, such as exhaust flow control, and control of returning exhaust for internal EGR. That is, an intermediate drive mechanism 520 may be provided between each exhaust cam 46*a* and corresponding rocker arms 14 as shown in FIG. 38, and the amount of lift and the operating angle of the exhaust valves 16*a*, 16*b* may be adjusted in accordance with the operating state of the engine 2 by using a newly provided lift-varying actuator (not shown). Furthermore, a rotational-phase-difference-varying actuator may also be provided for the exhaust camshaft 46 so as to adjust the valve timing of the exhaust valves 16*a*, 16*b*.

Figure 39A:
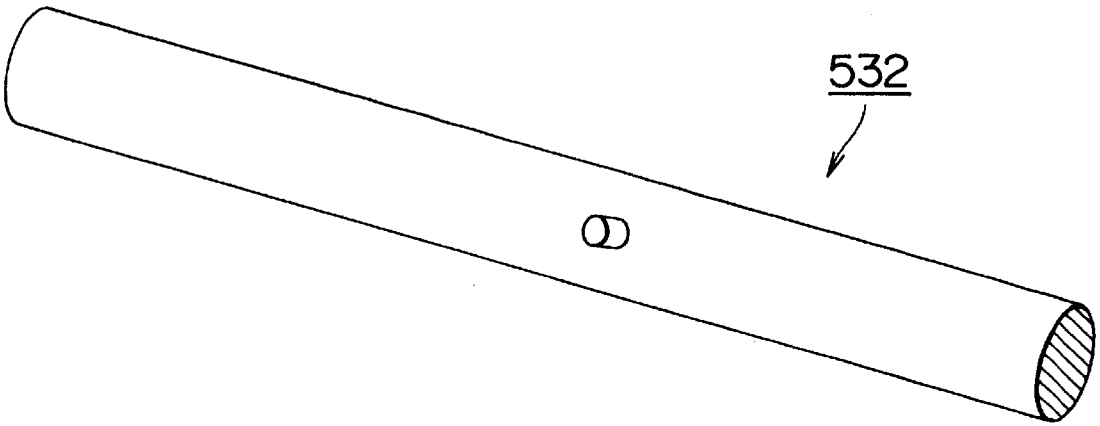
FIGS. 39A and 39B are views showing an intermediate drive mechanism according to a second modified example of the first embodiment of the invention.
Figure 39B:
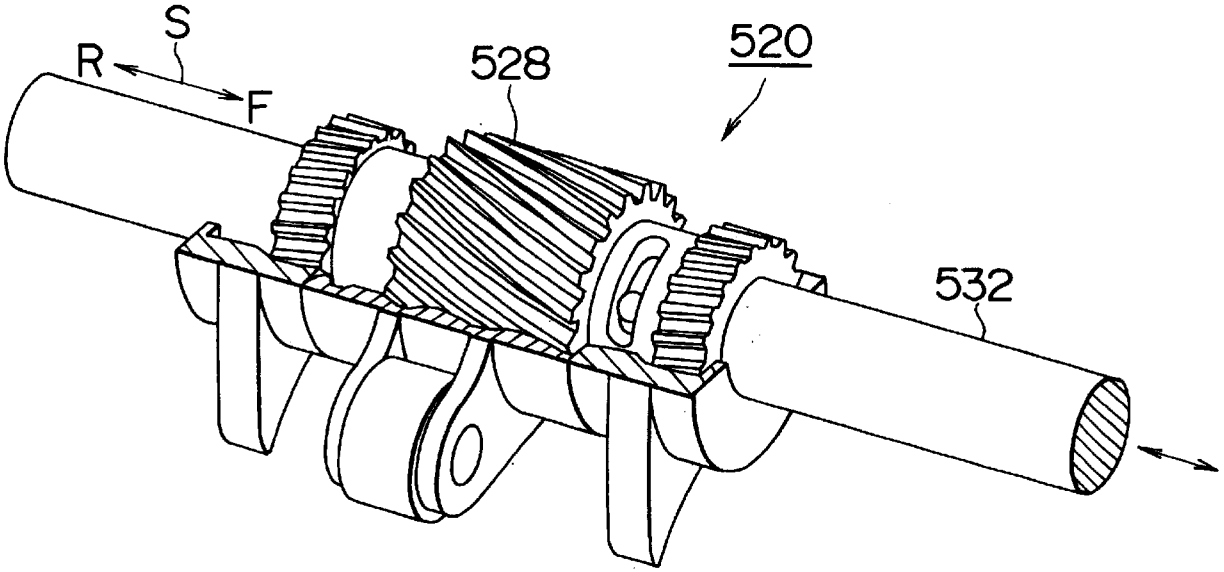

In the first embodiment, the control shaft 132 is received within the support pipe 130, and the entire structure of the intermediate drive mechanism 120 is supported by the support pipe 130. However, it is also possible to provide only a control shaft 532 without providing a support pipe such that the control shaft 532 serves also as a support pipe, as shown in FIG. 39A. Here, the control shaft 532 functions to displace or move a slider gear 528 in the axial direction and also functions to support the entire structure of the intermediate drive mechanism 520, as shown in FIG. 39B. In this case, the control shaft 532 is supported via journal bearings on a cylinder head so as to be slidable in the axial direction.

Figure 40:
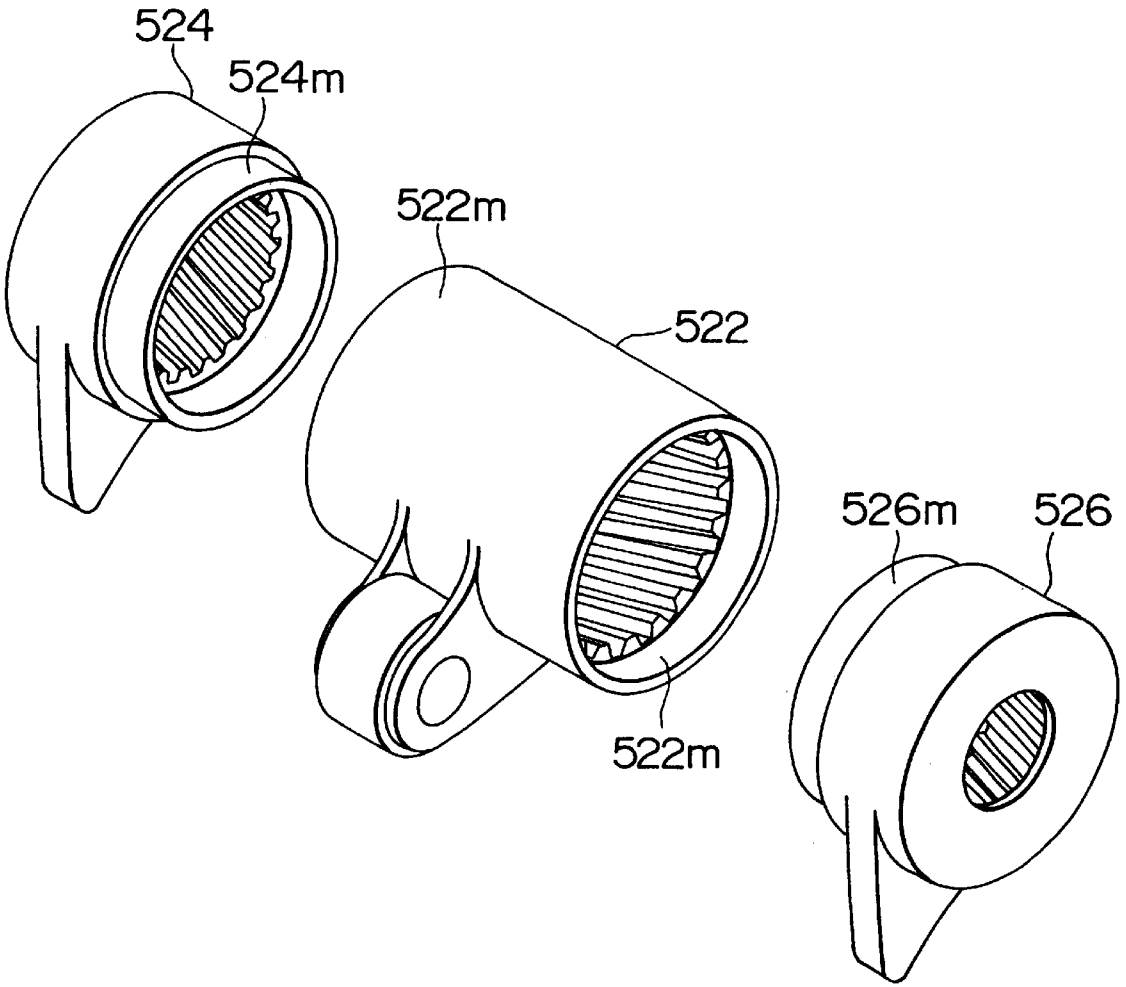
FIG. 40 is a view showing an intermediate drive mechanism according to a third modified example of the first embodiment.

In the first embodiment, the input portion 122 and the rocking cams 124, 126 of the intermediate drive mechanism 120 are disposed side by side with their corresponding end faces being in contact with each other. Instead, the intermediate drive mechanism may be constructed as shown in FIG. 40, in order to more reliably prevent the entry of foreign matters into the intermediate drive mechanism. More specifically, recessed engaging portions 522*m* are formed in opposite end portions of an input portion 522, and protruding engaging portions 524*m*, 526*m* are formed in opening end portions of rocking cams 524, 526, respectively. The protruding engaging portions 524*m*, 526*m* are respectively fitted into the recessed engaging portions 522*m*. These engaging portions are slidable relatively to each other, so that the input portion 522 and the rocking cams 524, 526 are allowed to rock or turn relative to each other. The recessed and protruding engaging portions may be reversed.

In the first embodiment, the first rocking cam 124 and the second rocking cam 126 are coupled to the slider gear 128 via the helical splines having equal helical angles, so that the amount of lift and the operating angle of the two intake valves 12*a*, 12*b* of each cylinder 2*a* are changed or varied by the same degrees. Alternatively, the helical splines of the first rocking cam 124 and the helical splines of the second rocking cam 126 may have different angles, and the first output helical splines 128*c* and second output helical splines 128*e* of the slider gear 128 may be formed in accordance with those splines of the first and second rocking cams 124, 126, respectively, so that the two intake valves of the same cylinder operate with different amounts of lift and different operating angles. With this arrangement, different amounts of intake air can be introduced in different timings from the two intake valves into the corresponding combustion chamber, so that turn flow, such as swirl, can be formed in the combustion chamber. In this way, the combustion characteristic can be improved so as to enhance the engine performance.

In the above arrangement, differences in the angles of the helical splines of the first and second rocking cams give rise to differences in the amount of lift and the operating angle between the two intake valves of the same cylinder. However, differences in the amount of lift and the operating angle between the valves may also be realized by providing differences in the phase between the noses 124*d*, 126*d* of the rocking cams 124, 126 or by providing differences in the shape of the cam faces 124*e*, 126*e* of the noses 124*d*, 126*d*.

Also, in the intermediate drive mechanism 120 of the first embodiment, a relative phase difference between the input portion 122 and at least one of the noses 124*d*, 126*d* of the rocking cams 124, 126 may be maintained at a constant value. In this case, a relative phase difference between the input portion 122 and the remaining output portion, if any, may be made variable.

In the first embodiment, the amount of lift of the intake valves is controlled in order to adjust the amount of intake air in the engine having no throttle valve. However, the invention is also applicable to an engine equipped with a throttle valve. For example, the intermediate drive mechanism may be used for adjusting, for example, the valve timing, since the operating angle is changed by adjusting the intermediate drive mechanism, and the valve timing is adjusted by changing the operating angle.

Figure 41B:
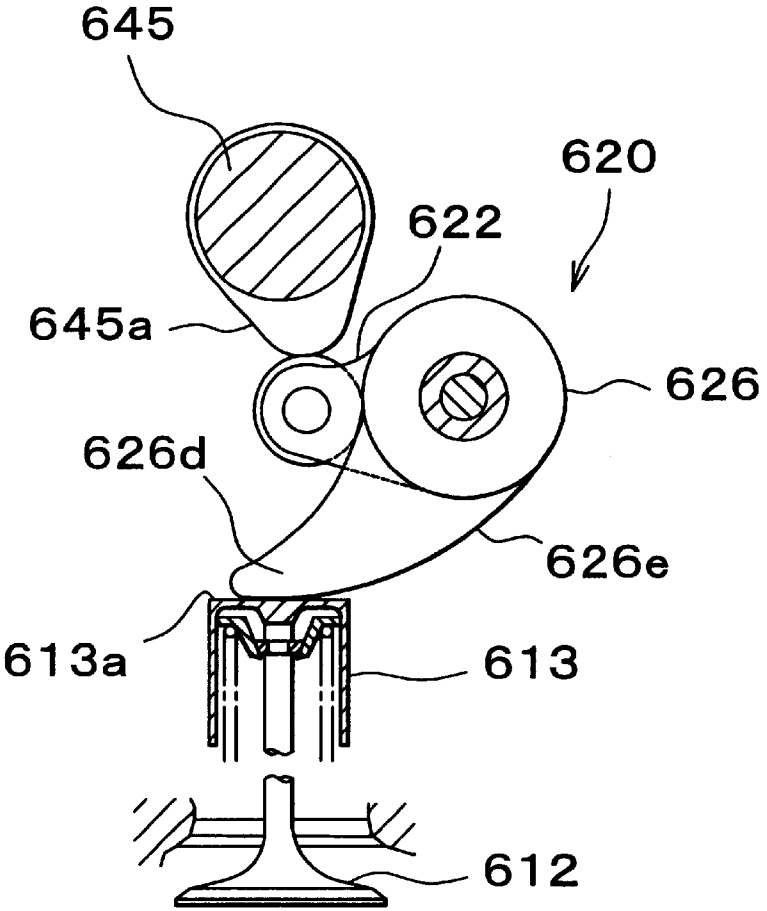
FIGS. 41A and 41B are views showing an intermediate drive mechanism according to a fourth modified example of the first embodiment of the invention.
Figure 41A:
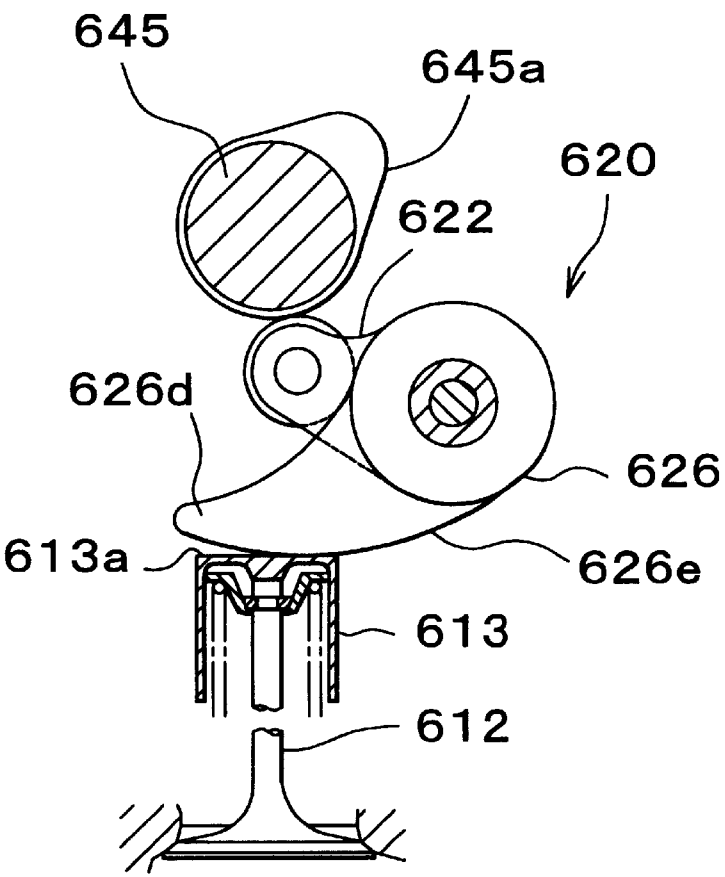
Figure 42B:
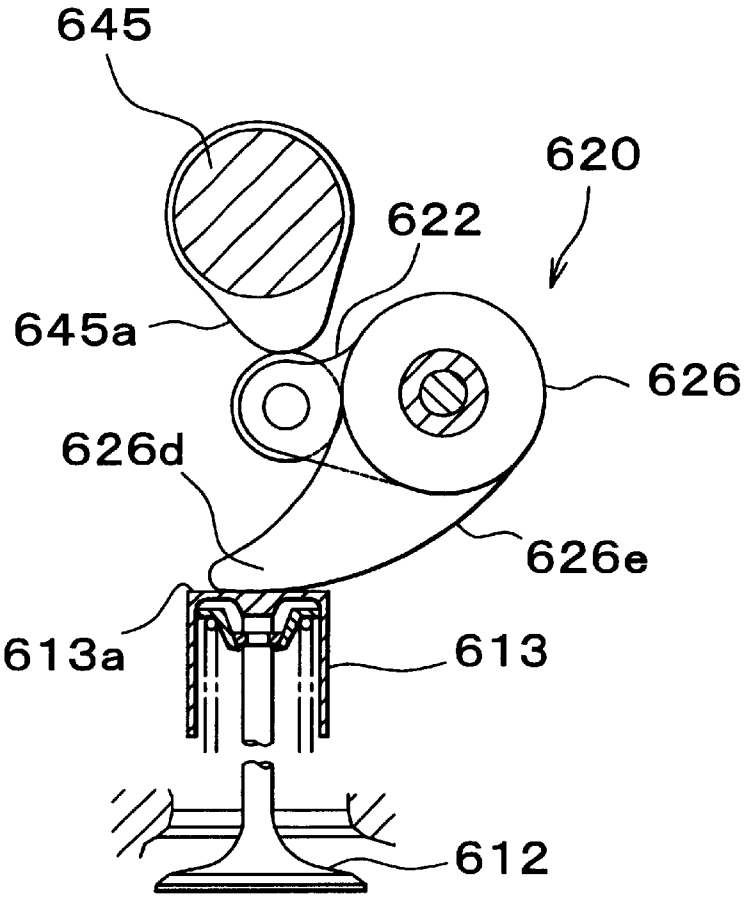
FIGS. 42A and 42B are views for explaining the operation of the intermediate drive mechanism of the fourth modified example of FIGS. 41A and 41B.
Figure 42A:
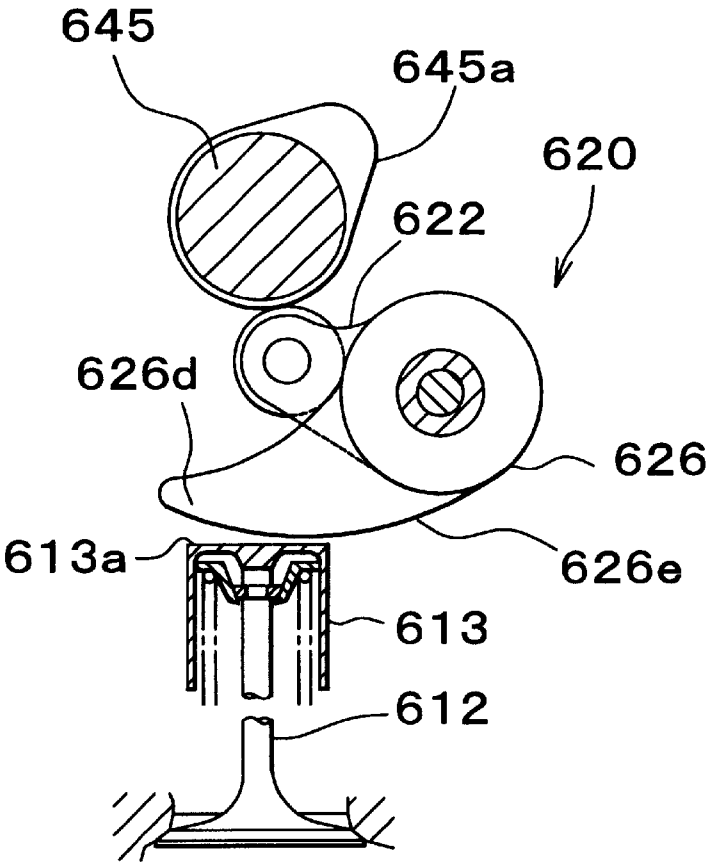
Figure 43B:
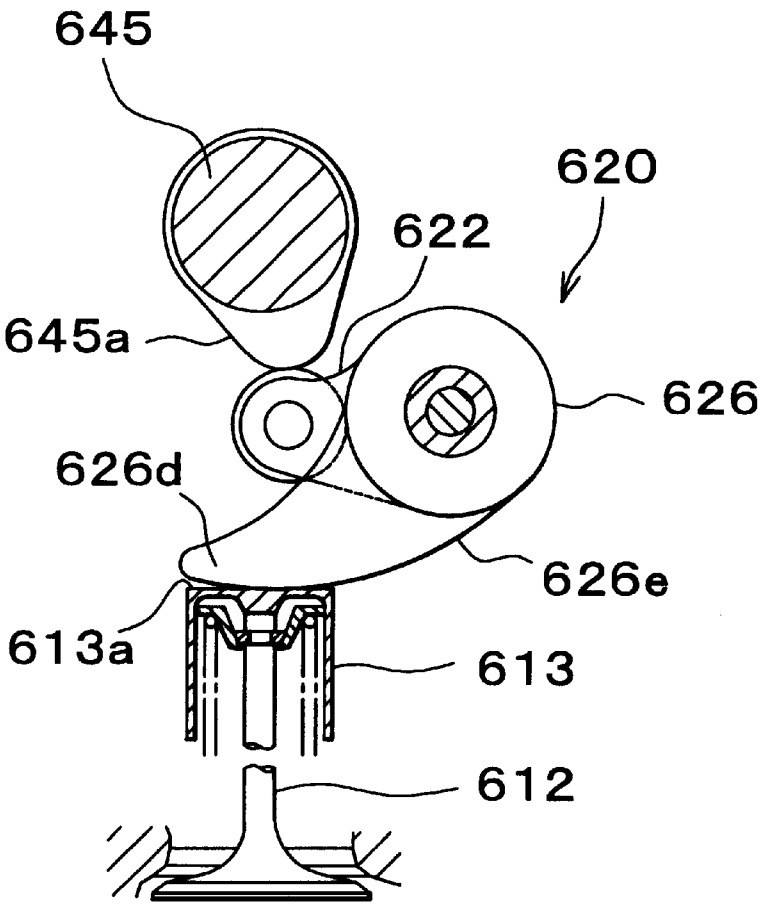
FIGS. 43A and 43B are views for explaining the operation of the intermediate drive mechanism of the fourth modified example of FIGS. 41A and 41B.
Figure 43A:
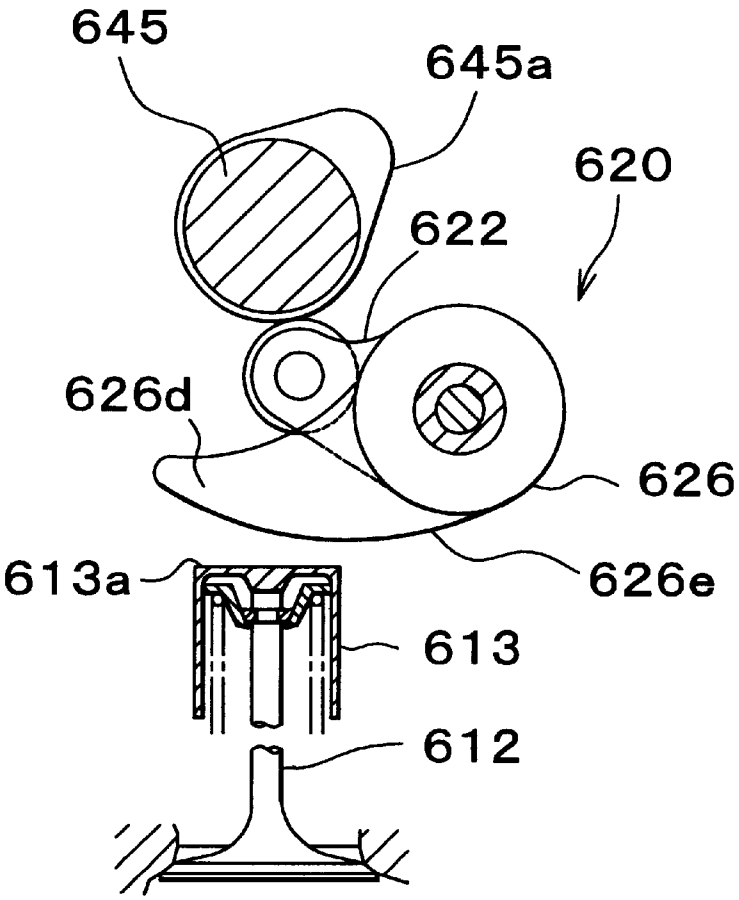
Figure 44B:
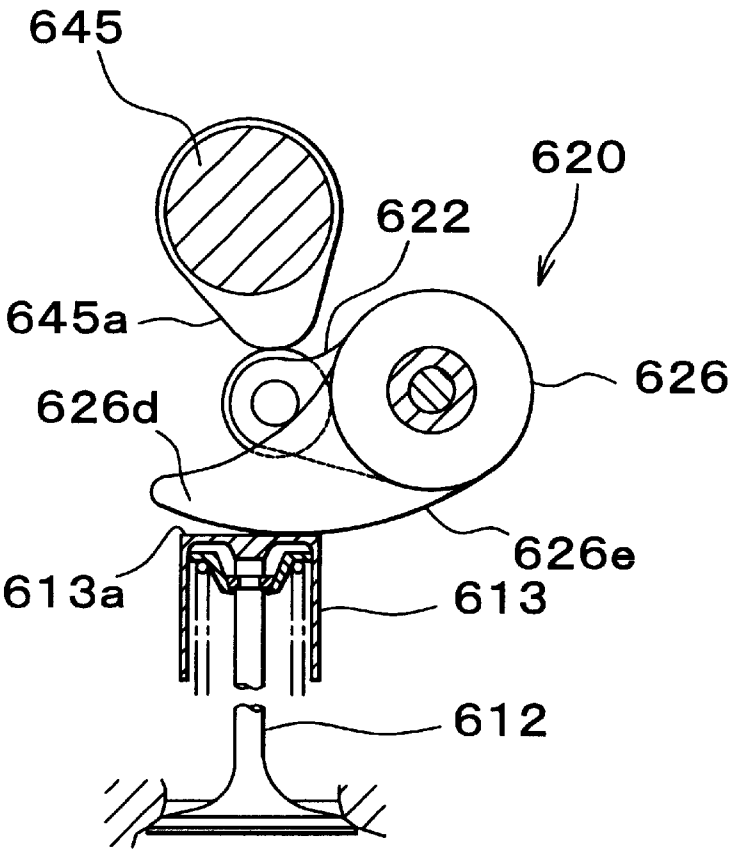
FIGS. 44A and 44B are views for explaining the operation of the intermediate drive mechanism of the fourth modified example of FIGS. 41A and 41B.
Figure 44A:
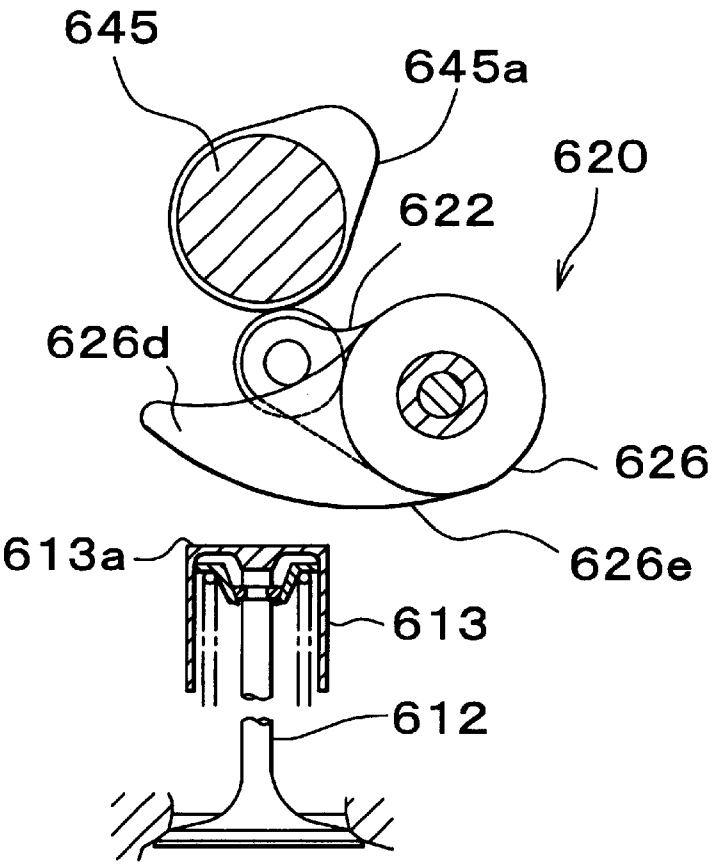

In the first embodiment, rocker arms 13 are interposed between each intermediate drive mechanism 120 and the corresponding intake valves 12*a*, 12*b*. However, an arrangement as shown in FIGS. 41A to 44B may be employed in which a rocking cam 626 of an intermediate drive mechanism 620 contacts with and drives a valve lifter 613 that opens or closes an intake valve 612. FIGS. 41A, 42A, 43A and 44A show the operating states of the valve drive mechanism when the intake valve 612 is closed. FIGS. 41B, 42B, 43B and 44B show the operating states of the valve drive mechanism when the intake valve 612 is opened. Unlike the first embodiment, a nose 626*d* of the rocking cam 626 is curved in a convex shape, and a curved surface 626*e* of the nose 626*d* slidably contacts with a top face 613*a* of the valve lifter 613. A slider gear and a spline mechanism within the intermediate drive mechanism 620 are substantially the same as those of the first embodiment. With this arrangement, the relative phase difference between an input portion 622 and the rocking cam 626 can be changed by moving the slider gear in the axial direction. The relative phase difference between the input portion 622 and the rocking cam 626 as shown in FIGS. 41A and 41B provides the maximum amount of lift and the greatest operating angle. As the relative phase difference decreases from the state of FIGS. 41A and 41B to the states of FIGS. 42A and 42B, FIGS. 43A and 43B and FIGS. 44A and 44B in this order, the amount of lift and the operating angle are reduced with the decrease in the relative phase difference. In the state of FIGS. 44A and 44B, the amount of lift and the operating angle become zero, and the intake valve 612 is kept closed even if an intake cam 645*a* provided on an intake shaft 645 rotates. This arrangement provides substantially the same advantages (1), and (3) to (8) as stated above in conjunction with the first embodiment.

Figure 45B:
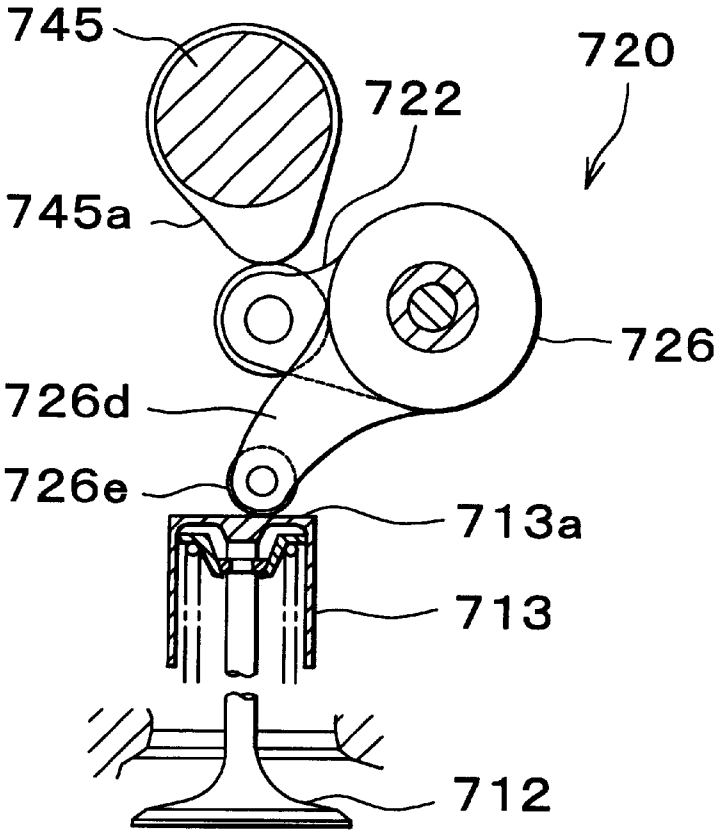
FIGS. 45A and 45B are views showing an intermediate drive mechanism according to a fifth modified example of the first embodiment of the invention.
Figure 45A:
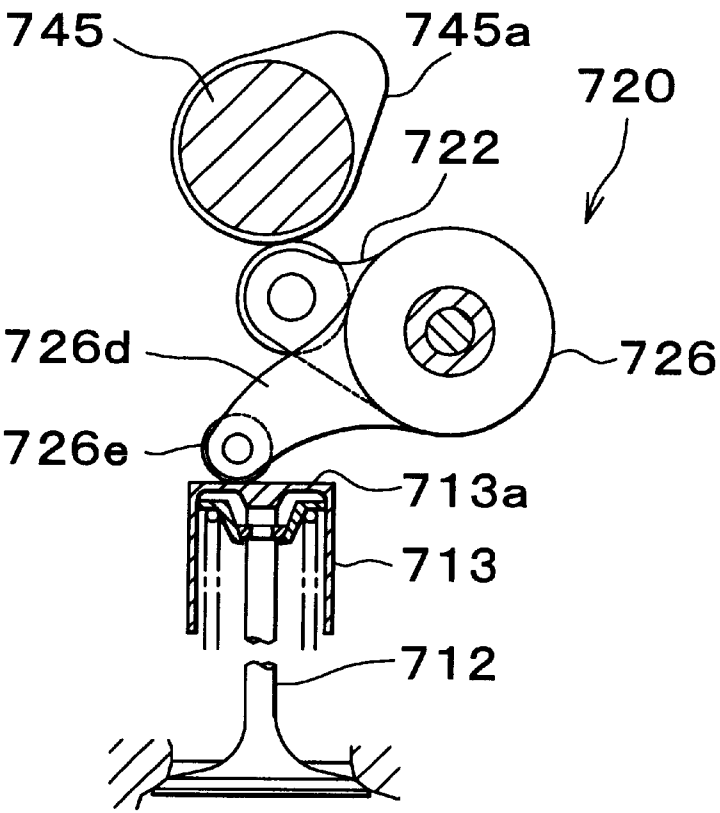
Figure 46B:
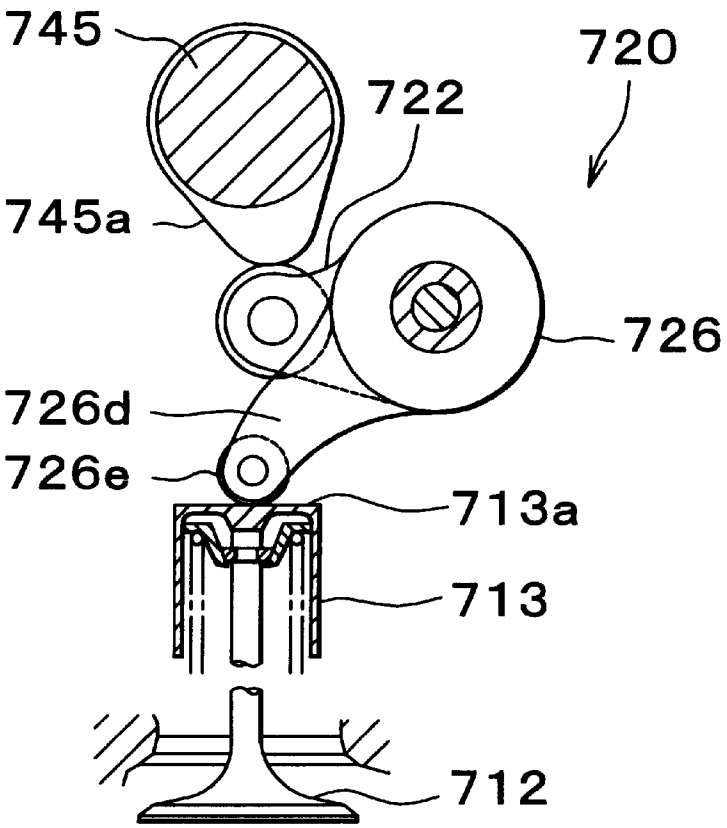
FIGS. 46A and 46B are views for explaining the operation of the intermediate drive mechanism of the fifth modified example of FIGS. 45A and 45B.
Figure 46A:
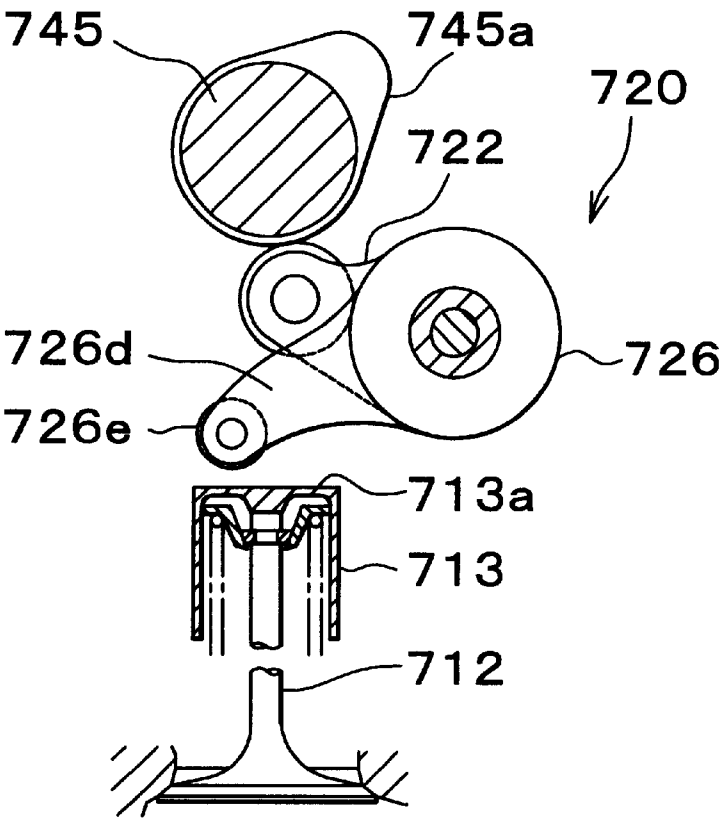
Figure 47B:
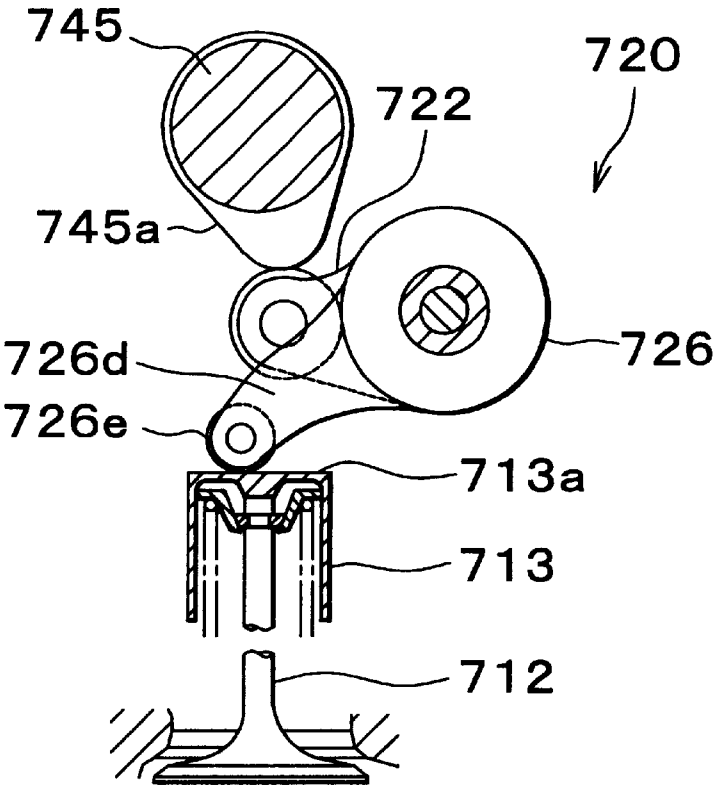
FIGS. 47A and 47B are views for explaining the operation of the intermediate drive mechanism of the fifth modified example of FIGS. 45A and 45B.
Figure 47A:
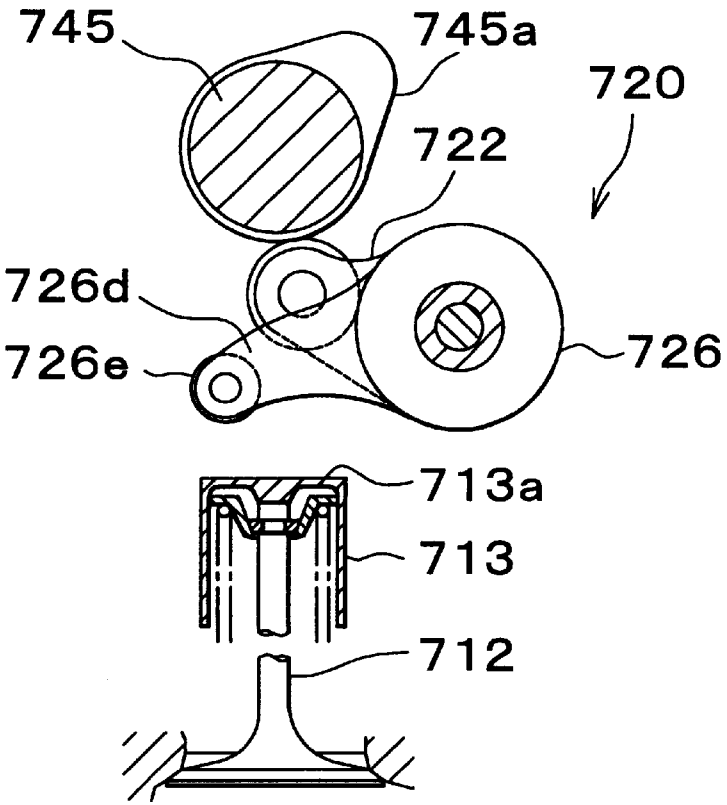
Figure 48B:
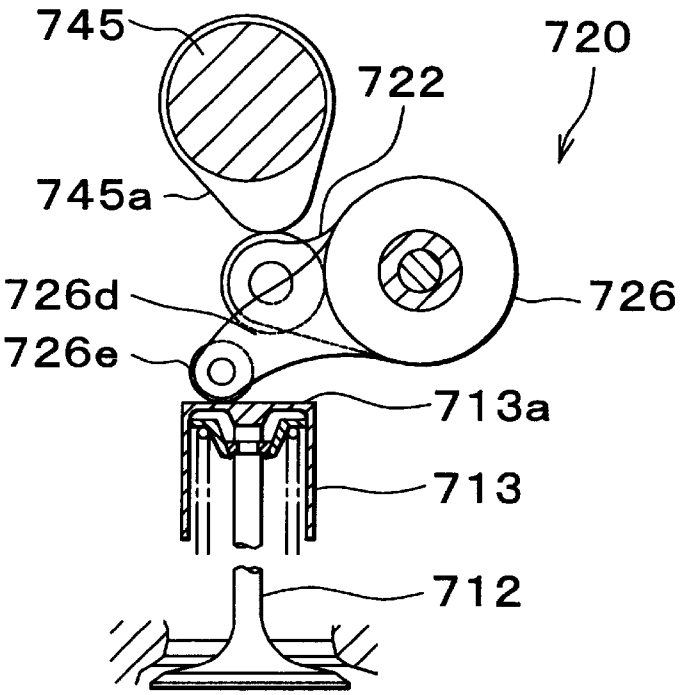
FIGS. 48A and 48B are views for explaining the operation of the intermediate drive mechanism of the fifth modified example of FIGS. 45A and 45B.
Figure 48A:
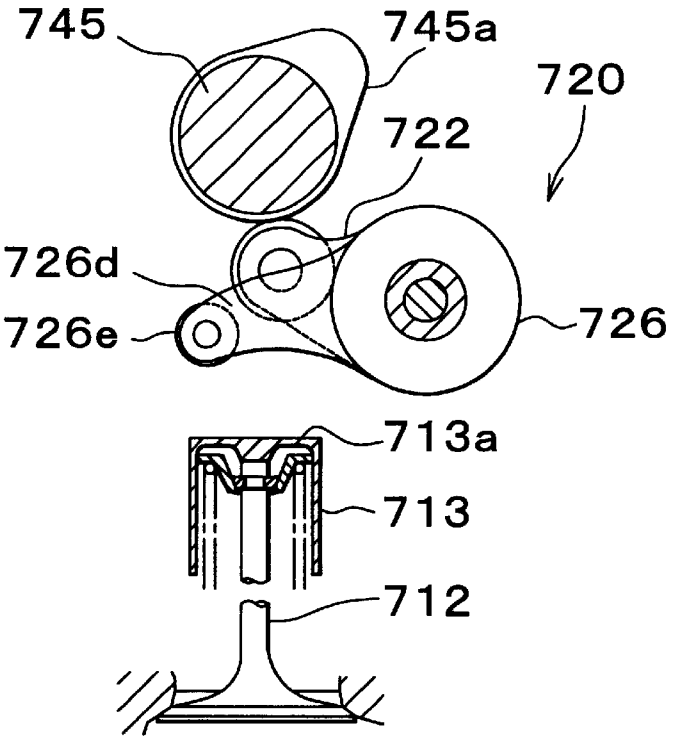

Furthermore, an arrangement as shown in FIGS. 45A to 48B may be employed in which a rocking cam 726 of an intermediate drive mechanism 720 contacts at a roller 726*e* with a valve lifter 713 for opening and closing an intake valve 712. FIGS. 45A, 46A, 47A and 48A show the operating states of the valve drive mechanism when the intake valve 712 is closed. FIGS. 45B, 46B, 47B and 48B show the operating states of the valve drive mechanism when the intake valve 712 is opened. Unlike the first embodiment, a nose 726*d* of the rocking cam 726 is provided at its distal end with the roller 726*e*, and the rocking cam 726 abuts at the roller 726*e* upon a top face 713*a* of the valve lifter 713. A slider gear and a spline mechanism within the intermediate drive mechanism 720 are substantially the same as those of the first embodiment. With this arrangement, the relative phase difference between an input portion 722 and the rocking cam 726 can be changed by moving the slider gear in the axial direction. The relative phase difference between the input portion 722 and the rocking cam 726 as shown in FIGS. 45A and 45B provides the maximum amount of lift and the greatest operating angle. As the relative phase difference decreases from the state of FIGS. 45A and 45B to the states of FIGS. 46A and 46B, FIGS. 47A and 47B and FIGS. 48A and 48B in this order, the amount of lift and the operating angle are reduced with the decrease in the relative phase difference. In the state of FIGS. 48A and 48B, the amount of lift and the operating angle become zero, and the intake valve 712 is kept closed even if an intake cam 745*a* provided on an intake shaft 745 rotates. This arrangement provides substantially the same advantages (1), and (3) to (8) as stated above in conjunction with the first embodiment. Furthermore, since the rocking cam 726 drives the intake valve 712 via the roller 726*e* provided on the distal end of the nose 726*d*, the friction resistance that arises when the intake cam 745*a* drives the intake valve 712 via the intermediate drive mechanism 720 is further reduced, and therefore the fuel economy can be improved.

Figure 49B:
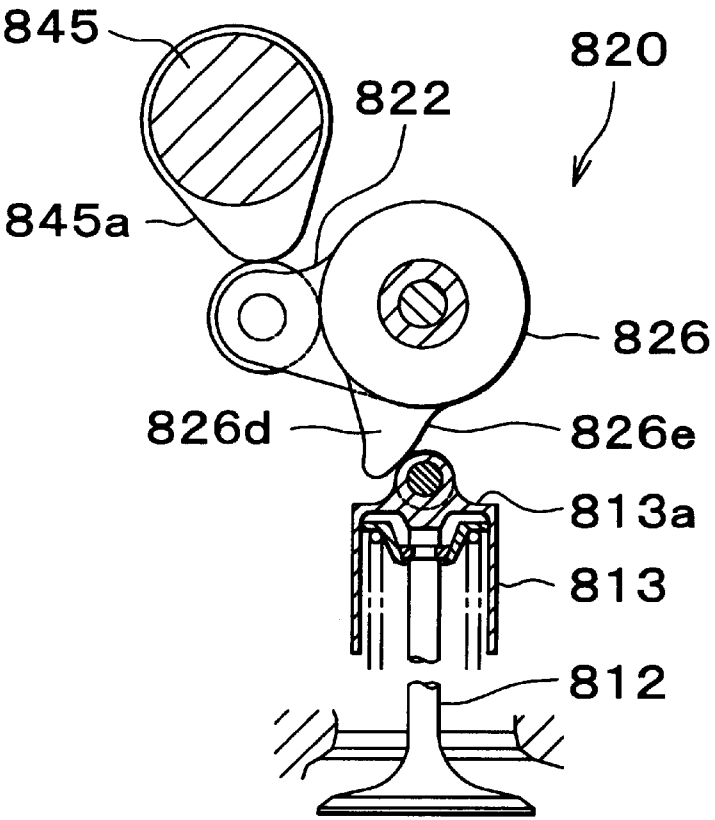
FIGS. 49A and 49B are views showing an intermediate drive mechanism according to a sixth modified example of the first embodiment of the invention.
Figure 49A:
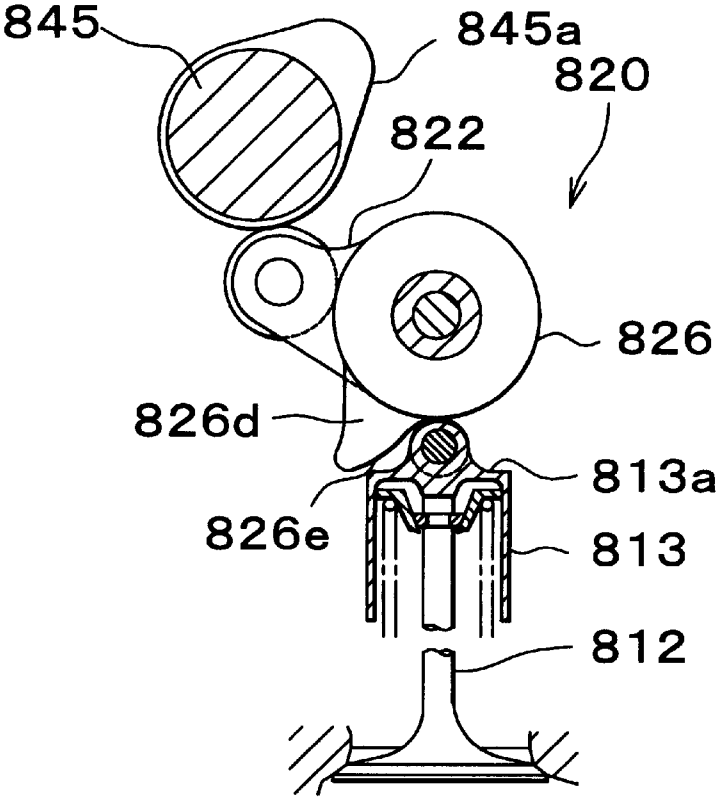
Figure 50B:
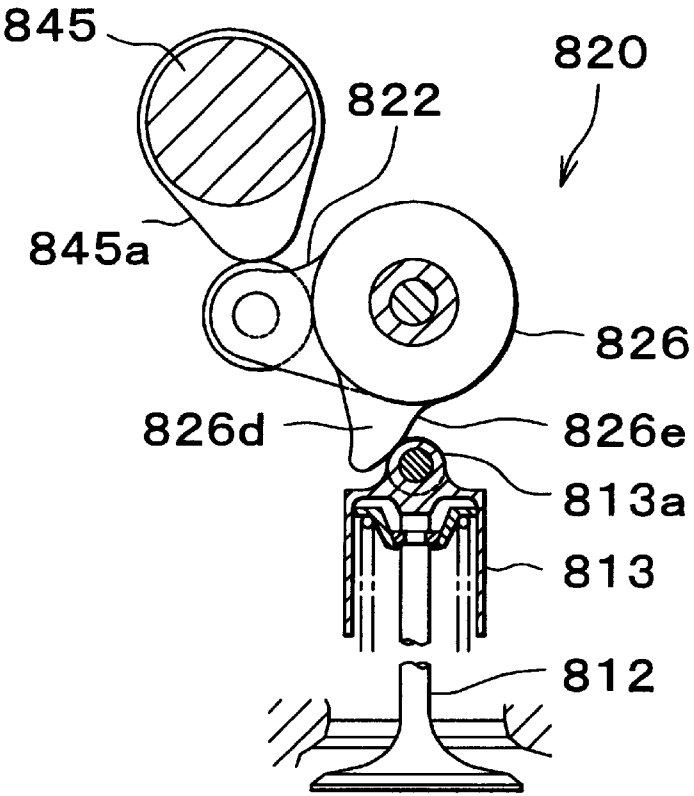
FIGS. 50A and 50B are views for explaining the operation of the intermediate drive mechanism of the sixth modified example of FIGS. 49A and 49B.
Figure 50A:
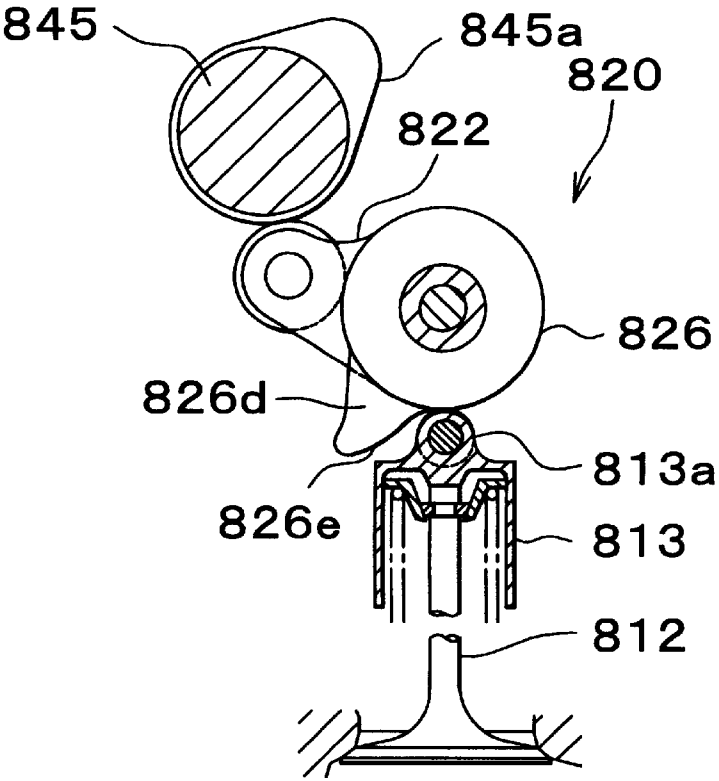
Figure 51B:
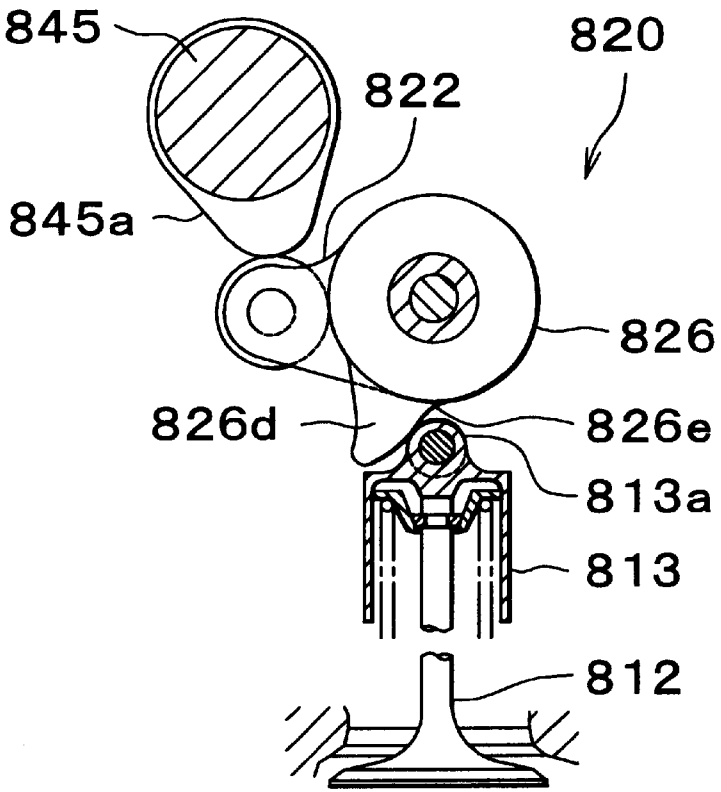
FIGS. 51A and 51B are views for explaining the operation of the intermediate drive mechanism of the sixth modified example of FIGS. 49A and 49B.
Figure 51A:
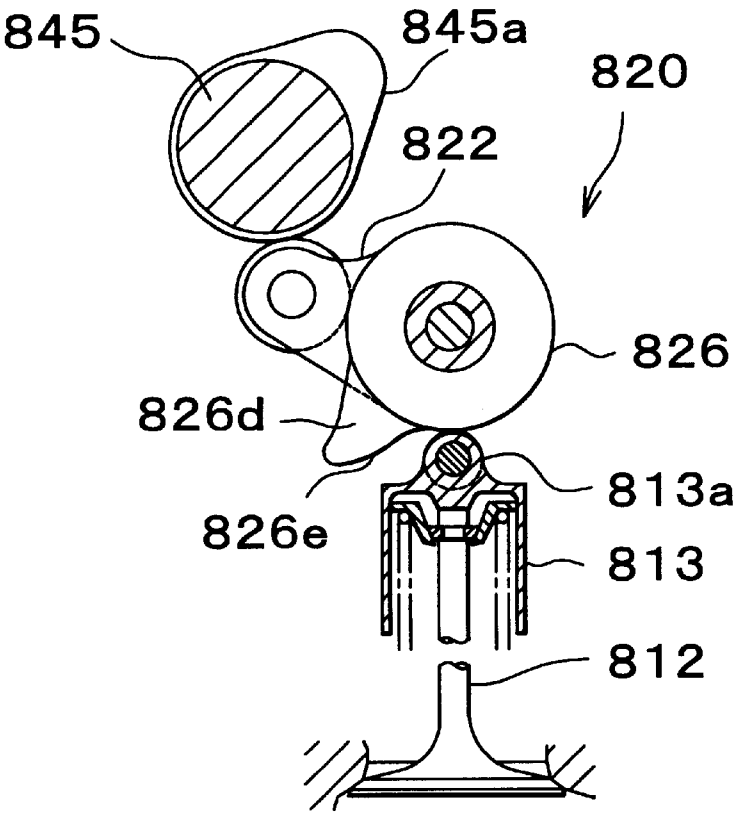
Figure 52B:
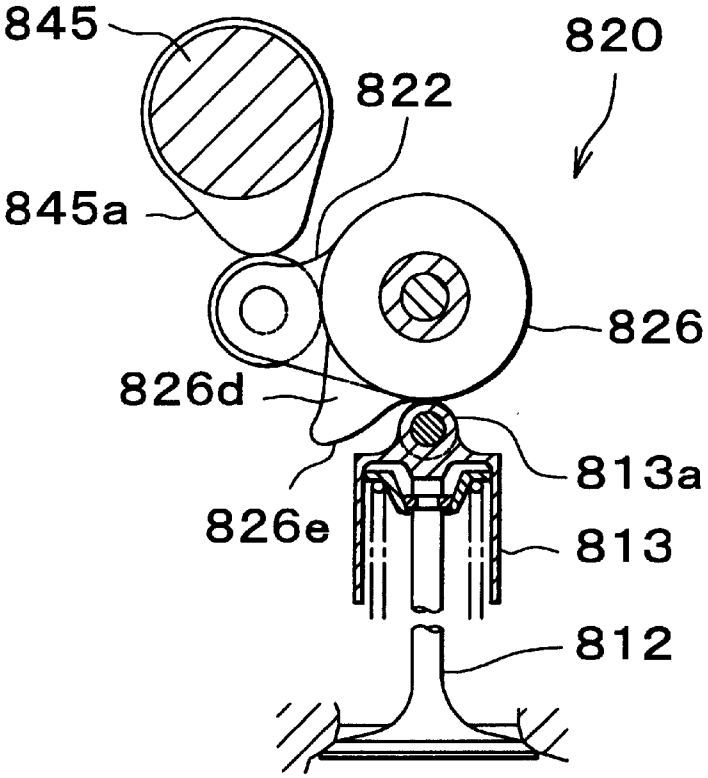
FIGS. 52A and 52B are views for explaining the operation of the intermediate drive mechanism of the sixth modified example of FIGS. 49A and 49B.
Figure 52A:
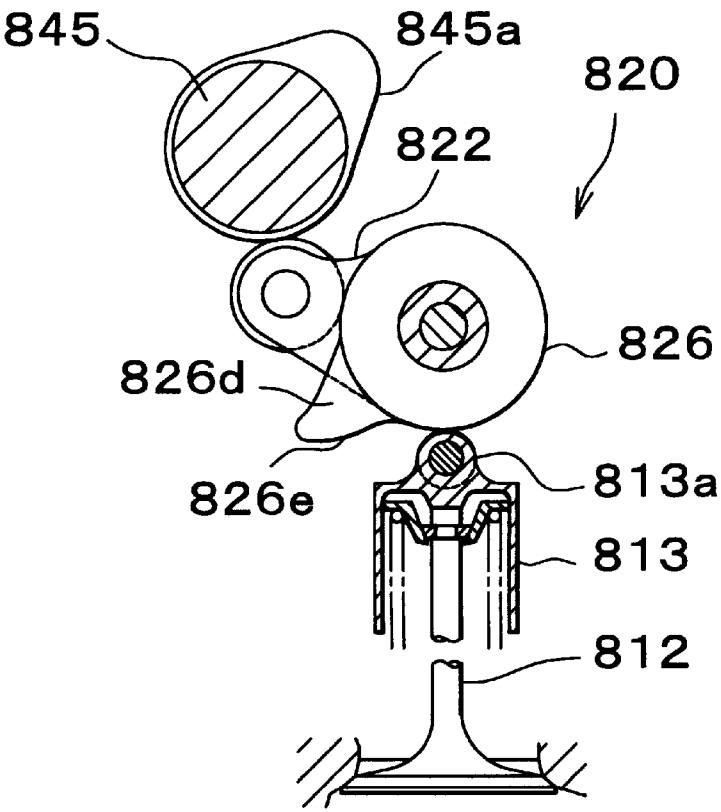

Furthermore, an arrangement as shown in FIGS. 49A to 52B may be employed in which a rocking cam 826 of an intermediate drive mechanism 820 drives an intake valve 812 by contacting with a roller 813*a* provided on a valve lifter 813 for opening and closing the intake valve 812. FIGS. 49A, 50A, 51A and 52A show the operating states of the valve drive mechanism when the intake valve 812 is closed. FIGS. 49B, 50B, 51B and 52B show the operating states of the valve drive mechanism when the intake valve 812 is opened. The valve lifter 813 is provided at the top part thereof with the roller 813*a*. Unlike the first embodiment, a nose 826*d* of the rocking cam 826 is curved in a concave shape at its proximal portion and in a convex shape at its distal portion, and the curved surface 826*e* of the nose 826 abuts on the roller 813*a* of the valve lifter 813. A slider gear and a spline mechanism within the intermediate drive mechanism 820 are substantially the same as those of the first embodiment. With this arrangement, the relative phase difference between an input portion 822 and the rocking cam 826 can be changed by moving the slider gear in the axial direction. The relative phase difference between the input portion 822 and the rocking cam 826 as shown in FIGS. 49A and 49B provides the maximum amount of lift and the greatest operating angle. As the relative phase difference decreases from the state of FIGS. 49A and 49B to the states of FIGS. 50A and 50B, FIGS. 51A and 51B and FIGS. 52A and 52B in this order, the amount of lift and the operating angle are reduced with the decrease in the relative phase difference. In the state of FIGS. 52A and 52B, the amount of lift and the operating angle become zero, and the intake valve 712 is kept closed even if an intake cam 845*a* provided on an intake shaft 845 rotates. This arrangement provides substantially the same advantages (1), and (3) to (8) as stated above in conjunction with the first embodiment.

While the hydraulically operated lift-varying actuator 100 is employed to move the control shaft in the axial directions in the first embodiment, an electrically driven actuator, such as a stepping motor or the like, may be employed instead.

In the first embodiment, the relative phase difference between the input portion and the rocking cams is changed by moving the control shaft in the axial direction. Alternatively, a hydraulically operated actuator may be provided in an intermediate drive mechanism, so that the relative phase difference between the input portion and the rocking cams is changed by supplying regulated hydraulic pressure to the intermediate drive mechanism. It is also possible to provide an electrically operated actuator in an intermediate drive mechanism so that the relative phase difference between the input portion and the rocking cams is changed by controlling an electric signal applied to the actuator.

While each intermediate drive mechanism is provided with one input portion and two rocking cams in the illustrated embodiment, the number of cams may also be one or more than two.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. A variable valve drive mechanism of an internal combustion engine, which is capable of varying a valve characteristic of an intake valve or an exhaust valve of the internal combustion engine, comprising:

a camshaft that is operatively connected to a crankshaft of the engine such that the camshaft is rotated by the crankshaft;

a rotating cam provided on the camshaft;

an intermediate drive mechanism disposed between the camshaft and the valve and supported rockably on a shaft that is different from the camshaft, the intermediate drive mechanism including an input portion operable to be driven by the rotating cam of the camshaft, and an output portion operable to drive the valve when the input portion is driven by the rotating cam; and an intermediate phase-difference varying device positioned and configured to vary a relative phase difference between the input portion and the output portion of the intermediate drive mechanism.

2. A variable valve drive mechanism according to claim 1, wherein the output portion comprises a rocking cam that includes a nose, and the intermediate phase-difference varying device is operable to vary the relative phase difference between the nose of the rocking cam and the input portion.

3. A variable valve drive mechanism according to claim 2, wherein the intermediate phase-difference varying device varies the relative phase difference between the nose of the rocking cam and the input portion, so that an amount of lift of the valve can be adjusted by the nose that moves in accordance with the input portion that is driven by the rotating cam.

4. A variable valve drive mechanism according to claim 2, wherein the intermediate phase-difference varying device varies the relative phase difference between the nose of the rocking cam and the input portion, so that an operating angle of the valve can be adjusted by the nose that moves in accordance with the input portion that is driven by the rotating cam.

5. A variable valve drive mechanism according to claim 2, further comprising a roller disposed between the rocking cam and the valve, wherein driving force is transmitted from the rocking cam to the valve via the roller.

6. A variable valve drive mechanism according to claim 5, further comprising a rocker arm that includes the roller, wherein the rocker arm is disposed between the rocking cam and the valve such that driving force is transmitted from the rocking cam to the valve via the rocker arm.

7. A variable valve drive mechanism according to claim 1, wherein the input portion includes a pair of arms and a contact portion provided at distal end portions of the arms, the contact portion being in contact with the rotating cam to receive driving force from the rotating cam such that the driving force is transmitted to the output portion so as to drive the valve.

8. A variable valve drive mechanism according to claim 7, wherein the contact portion comprises a roller disposed between the arms, the roller being in rolling contact with the rotating cam to receive driving force from the rotating cam.

9. A variable valve drive mechanism according to claim 2, wherein the input portion includes a pair of arms and a contact portion provided at distal end portions of the arms, the contact portion being in contact with the rotating cam to receive driving force from the rotating cam such that the driving force is transmitted to the output portion so as to drive the valve.

10. A variable valve drive mechanism according to claim 9, wherein the contact portion comprises a roller disposed between the arms, the roller being in rolling contact with the rotating cam to receive driving force from the rotating cam.

11. A variable valve drive mechanism according to claim 1, wherein the intermediate phase-difference varying device comprises:

a slider gear that includes a first set of splines and a second set of splines that form different angles with respect to an axis of the slider gear, the slider gear being movable in an axial direction of the intermediate drive mechanism;

an input threaded portion provided in the input portion of the intermediate drive mechanism, the input threaded portion engaging with the first set of splines of the slider gear such that the input portion is rotatable relative to the slider gear as the slider gear moves in the axial direction;

an output threaded portion provided in the output portion of the intermediate drive mechanism, the output threaded portion engaging with the second set of splines of the slider gear such that the output portion is rotatable relative to the slider gear as the slider gear moves in the axial direction; and a displacement adjusting device positioned and configured to adjust a displacement of the slider gear in the axial direction.

12. A variable valve drive mechanism according to claim 2, wherein the intermediate phase-difference varying device comprises:

a slider gear that includes a first set of splines and a second set of splines that form different angles with respect to an axis of the slider gear, the slider gear being movable in an axial direction of the intermediate drive mechanism;

an input threaded portion provided in the input portion of the intermediate drive mechanism, the input threaded portion engaging with the first set of splines of the slider gear such that the input portion is rotatable relative to the slider gear as the slider gear moves in the axial direction;

an output threaded portion provided in the output portion of the intermediate drive mechanism, the output threaded portion engaging with the second set of splines of the slider gear such that the output portion is rotatable relative to the slider gear as the slider gear moves in the axial direction; and a displacement adjusting device positioned and configured to adjust a displacement of the slider gear in the axial direction.

13. A variable valve drive mechanism according to claim 1, wherein the intermediate phase-difference varying device comprises:

input splines provided in the input portion of the intermediate drive mechanism;

output splines provided in the output portion of the intermediate drive mechanism, the output splines being formed with a different angle from the input splines, with respect to an axis of the intermediate drive mechanism;

a slider gear which engages with the input splines and the output splines and which is movable in an axial direction of the intermediate drive mechanism, the slider gear permitting the input portion and the output portion to rotate relative to each other as the slider gear moves in the axial direction; and a displacement adjusting device positioned and configured to adjust a displacement of the slider gear in the axial direction.

14. A variable valve drive mechanism according to claim 2, wherein the intermediate phase-difference varying device comprises:

input splines provided in the input portion of the intermediate drive mechanism;

output splines provided in the output portion of the intermediate drive mechanism, the output splines being formed with a different angle from the input splines, with respect to an axis of the intermediate drive mechanism;

a slider gear which engages with the input splines and the output splines and which is movable in an axial direction of the intermediate drive mechanism, the slider gear permitting the input portion and the output portion to rotate relative to each other as the slider gear moves in the axial direction; and a displacement adjusting device positioned and configured to adjust a displacement of the slider gear in the axial direction.

15. A variable valve drive mechanism according to claim 1, wherein the intermediate drive mechanism includes a single input portion and a plurality of output portions whose number is the same as that of input valves or exhaust valves provided for the same cylinder, the output portions being adapted to drive the input valves or exhaust valves, respectively.

16. A variable valve drive mechanism according to claim 15, wherein the intermediate phase-difference varying device comprises:

a slider gear that includes a plurality of sets of splines whose total number is the same as a total of the input portion and the output portions, the slider gear being movable in an axial direction of the intermediate drive mechanism;

an input threaded portion provided in the input portion of the intermediate drive mechanism, the input threaded portion engaging with a corresponding one of the plurality of sets of splines of the slider gear such that the input portion is rotatable relative to the slider gear as the slider gear moves in the axial direction;

an output threaded portion provided in each of the output portions of the intermediate drive mechanism, the output threaded portion engaging with a corresponding one of the remaining sets of splines of the slider gear such that the output portion is rotatable relative to the slider gear as the slider gear moves in the axial direction; and a displacement adjusting device positioned and configured to adjust a displacement of the slider gear in the axial direction.

17. A variable valve drive mechanism according to claim 15, wherein the intermediate phase-difference varying device comprises:

input splines provided in the input portion of the intermediate drive mechanism;

output splines provided in each of the output portions of the intermediate drive mechanism, the output splines being formed with a different angle from the input splines, with respect to an axis of the intermediate drive mechanism;

a slider gear which engages with the input splines and the output splines and which is movable in an axial direction of the intermediate drive mechanism, the slider gear permitting the input portion and each of the output portions to rotate relative to each other as the slider gear moves in the axial direction; and a displacement adjusting device positioned and configured to adjust a displacement of the slider gear in the axial direction.

18. A variable valve drive mechanism according to claim 15, wherein the intermediate phase-difference varying device is operable to vary the relative phase difference between the input portion and each of the output portions such that the output portions corresponding to the respective intake or exhaust valves have different phase differences relative to the input portion.

19. A variable valve drive mechanism according to claim 18, wherein the intermediate phase-difference varying device maintains the relative phase difference between the input portion and at least one of the output portions at a constant value.

20. A variable valve drive mechanism according to claim 1, wherein the intermediate phase-difference varying device is adapted to continuously vary the relative phase difference between the input and output portions of the intermediate drive mechanism.

21. A variable valve drive mechanism according to claim 1, further comprising a rotational-phase-difference varying device positioned and configured to vary a rotational phase difference of the camshaft relative to the crankshaft, so that the valve timing of the intake or exhaust valve as well as an amount of lift or an operating angle of the valve is made variable.

22. An intake air amount control apparatus of an internal combustion engine, comprising a variable valve drive mechanism capable of varying a valve characteristic of an intake valve or an exhaust valve of the internal combustion engine, the variable valve drive mechanism comprising:

(a) a camshaft that is operatively connected with a crankshaft of the engine such that the camshaft is rotated by the crankshaft;

(b) a rotating cam provided on the camshaft;

(c) an intermediate drive mechanism disposed between the camshaft and the valve and supported rockably on a shaft that is different from the camshaft, the intermediate drive mechanism including an input portion operable to be driven by the rotating cam of the camshaft, and an output portion operable to drive the valve when the input portion is driven by the rotating cam; and (d) an intermediate phase-difference varying device positioned and configured to vary a relative phase difference between the input portion and the output portion of the intermediate drive mechanism;

wherein the intermediate phase-difference varying device is driven so as to change a relative phase difference between the input and output portions of the intermediate drive mechanism, depending upon an intake air amount that is required for the internal combustion engine.

* * * * *